US008406655B2

(12) United States Patent
Sato

(10) Patent No.: US 8,406,655 B2
(45) **Date of Patent: *Mar. 26, 2013**

(54) IMAGE-FORMING DEVICE CAPABLE OF POSITIONING DEVELOPING UNIT AND DEVELOPER CARTRIDGE PRECISELY

(75) Inventor: Shougo Sato, Seto (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/352,525

(22) Filed: Jan. 18, 2012

(65) Prior Publication Data

US 2012/0183329 A1 Jul. 19, 2012

Related U.S. Application Data

(63) Continuation of application No. 12/938,977, filed on Nov. 3, 2010, now Pat. No. 8,116,659, which is a continuation of application No. 11/965,820, filed on Dec. 28, 2007, now Pat. No. 7,853,174.

(30) Foreign Application Priority Data

Dec. 28, 2006 (JP) ..... 2006-356438
Dec. 28, 2006 (JP) ..... 2006-356439

(51) Int. Cl.
*G03G 15/00* (2006.01)

(52) U.S. Cl. ..... 399/110; 399/111; 399/113; 399/119

(58) Field of Classification Search ..... 399/110, 399/111, 113, 119, 292
See application file for complete search history.

(56) References Cited

U.S. PATENT DOCUMENTS 5,260,750 A 11/1993 Ishida et al.
5,441,177 A 8/1995 Yanagisawa
5,534,979 A 7/1996 Ide
6,163,665 A 12/2000 Watanabe et al.
6,185,401 B1 2/2001 Kanamori et al.
6,324,370 B1 11/2001 Isobe et al.
2003/0185589 A1 10/2003 Fujita
2005/0207797 A1 9/2005 Fujita et al.
2005/0281581 A1 12/2005 Kitozaki
2006/0008297 A1 1/2006 Oyama et al.
(Continued)

FOREIGN PATENT DOCUMENTS

CN 1188265 A 7/1998
CN 1841229 10/2006
(Continued)

OTHER PUBLICATIONS

Office Action issued in related Chinese Application No. 201010178029.0, dated Nov. 23, 2011.

(Continued)

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image-forming device which may include a casing and a developing unit that is detachably mounted in the casing and formed with a first opening. The developer unit may have a developer carrying member carrying a developer, wherein the developing unit includes one end. The image-forming device may also include a first shutter configured to open and close the first opening and a developer cartridge that is configured to be detachably mounted in the casing, accommodate the developer, and is formed with a second opening. The second opening may be in alignment with the first opening when the developing unit and the developer cartridge are mounted in the casing. The image-forming device may also include a second shutter configured to open and close the second opening. The image-forming device may also include an alignment member between the developing unit and the developer cartridge.

7 Claims, 25 Drawing Sheets

U.S. PATENT DOCUMENTS

| | | | |
|---|---|---|---|
| 2006/0133855 | A1 | 6/2006 | Yamada |
| 2006/0222412 | A1 | 10/2006 | Ito et al. |
| 2007/0280743 | A1 | 12/2007 | Nakajima et al. |

FOREIGN PATENT DOCUMENTS

| | | |
|---|---|---|
| EP | 0 616 268 | 9/1994 |
| EP | 1 403 734 | 3/2004 |
| JP | 04-372967 | 12/1992 |
| JP | 05-297713 | 11/1993 |
| JP | 06-274029 | 9/1994 |
| JP | 07-199617 | 8/1995 |
| JP | 10-055101 | 2/1998 |
| JP | 10-078697 | 3/1998 |
| JP | 11-024381 | 1/1999 |
| JP | 11-065246 | 3/1999 |
| JP | 11-194600 | 7/1999 |
| JP | 11-194699 | 7/1999 |
| JP | 11-231631 | 8/1999 |
| JP | 11-265110 | 9/1999 |
| JP | 2000-284557 | 10/2000 |
| JP | 2001-134056 | 5/2001 |
| JP | 2003-295562 | 10/2003 |
| JP | 2004-279941 | 10/2004 |
| JP | 2005-049673 | 2/2005 |
| JP | 2005-070702 | 3/2005 |
| JP | 2005-134725 | 5/2005 |
| JP | 2006-030276 | 2/2006 |
| JP | 2006-171537 | 6/2006 |
| JP | 2006-178438 | 7/2006 |

OTHER PUBLICATIONS

Office Action issued on Nov. 8, 2011 in corresponding Japanese Application No. 2011-166435.

Office Action issued in corresponding Japanese Application No. 2006-356439, mailed Oct. 18, 2011.

Office Action for corresponding Japanese Patent Application 2006-356438, mailed May 31, 2011.

Office Action for corresponding Japanese Patent Application No. 2006-356439, mailed May 31, 2011.

Partial European Search Report issued on Jan. 19, 2011 in corresponding European Patent Application No. 07025125.1.

European Search Report mailed Mar. 7, 2011 in European Application No. 07025125.1.

CN Office Action mailed Jun. 19, 2009, CN Application No. 2007103074365.

Extended European Search Report issued in European Application No. 11181341.6, dated Dec. 20, 2011.

JP Office Action dtd May 22, 2012, JP Appln. 2011-166435.

CN OA Oct. 17, 2012, CN App 201010178029.0, English translation.

8

IMAGE-FORMING DEVICE CAPABLE OF POSITIONING DEVELOPING UNIT AND DEVELOPER CARTRIDGE PRECISELY

CROSS REFERENCE TO RELATED APPLICATION

This application is a continuation of co-pending U.S. application Ser. No. 12/938,977 filed Nov. 3, 2010, entitled "Image-Forming Device Capable of Positioning Developing Unit and Developer Cartridge Precisely", which is a continuation of patented U.S. application Ser. No. 11/965,820 filed Dec. 28, 2007, entitled "Image-Forming Device Capable of Positioning Developing Unit and Developer Cartridge Precisely", now U.S. Pat. No. 7,853,174, issued Dec. 14, 2010, which claims priority from Japanese Patent Application No. 2006-356438 filed Dec. 28, 2006, and No. 2006-356439 filed Dec. 28, 2006. The entire content of each of these applications is incorporated herein by reference in its entirety.

TECHNICAL FIELD

The present invention relates to an image-forming device such as a laser printer.

BACKGROUND

Generally, laser printers and other electrophotographic image-forming devices include a developing roller for carrying toner, and a toner box accommodating toner to be supplied to the developing roller. As examples of this laser printer, Japanese unexamined patent application publication No. HEI-10-78697 discloses an image-forming device including a photosensitive member, and image-forming member provided around this photosensitive member for executing sequential steps of charging, exposing, and developing as the photosensitive member rotates.

In the image-forming device disclosed in Japanese unexamined patent application publication No. HEI-10-78697, a toner cartridge for replenishing toner in a developing device is replaceably mounted on a casing of the developing device. When replacing the toner cartridge, the operator opens a front cover of the image-forming device and removes the existing toner cartridge from the developing device.

Since the toner cartridge is mounted on and removed from the casing of the developing device rather than the body of the image-forming device, it is possible that the positioning of the toner cartridge relative to the body of the image-forming device will be less accurate. If the toner cartridge is disposed at a position in the body of the image-forming device deviating from its proper position, there may be a decline in operability for replacing the toner cartridge.

Similarly, if the developing device is made replaceable as with the toner cartridge, the same problems may occur regarding operability or ease of replacing the developing device.

Further, in the image-forming device of disclosed in Japanese unexamined patent application publication No. HEI-7-199617, a toner cartridge is mounted on a casing of the developing device that accommodates a developing roller. The toner cartridge includes one agitator for agitating the toner therein. When the developing device is communicated within the toner cartridge, the toner accommodated in the toner cartridge is supplied to the developing roller with agitation of the toner.

Since the image-forming device includes just one agitator, it is possible that the toner will be less agitation in the image-forming device described above.

SUMMARY

Therefore, it is an object of the present invention to provide an image-forming device with improved operability.

The above and other objects will be attained by an image-forming device including a casing, a developing unit, a first shutter, a developer cartridge, a second shutter, and an alignment member. The developing unit is detachably mounted in the casing and formed with a first opening, the developing unit having a developer carrying member carrying a developer. The first shutter opens and closes the first opening. The developer cartridge is detachably mounted in the casing, accommodates the developer, and is formed with a second opening, the second opening being in alignment with the first opening. The second shutter opens and closes the second opening. The alignment member is disposed between the developing unit and the developer cartridge and is formed a third opening, the third opening being in alignment with the first opening and the second opening.

By providing the alignment member, the developing unit and developer cartridge can be detachably mounted in the casing, thereby avoiding a drop in precision for positioning the developing unit and developer cartridge relative to the casing. Accordingly, the developing unit and developer cartridge can be disposed in the casing at precise positions.

Hence, this construction can improve the operability of the developing unit and developer cartridge, and particularly the ease of replacement operations.

Further, by providing the alignment member between the developing unit and developer cartridge, the developing unit and developer cartridge are independently mounted in the casing, enabling the developing unit and developer cartridge to be separately mounted in the casing or removed therefrom.

It is another object of the present invention enough to agitate the toner accommodated in the toner cartridge.

The above and other objects will be attained by a developer cartridge detachably mounted in an image-forming device, the developer cartridge including a first developer accommodating section, an agitating member disposed in the first developer accommodating section, a second developer accommodating section, and a conveying member. The first developer accommodating section is formed substantially cylindrically shaped and accommodates a developer. The second developer accommodating section is adjacent to the first developer accommodating section. The conveying member conveys the developer in the first developer accommodating section toward the second developer accommodating section. The agitating member is disposed in the first developer accommodating section and includes a plurality of shafts and a plurality of agitating sections. The plurality of agitating sections is disposed in the plurality of the shafts and agitates a developer that is accommodated in the first developer accommodating section. The plurality of shafts is disposed parallel to one another while at different positions in a radial direction of the first developer accommodating.

With this configuration, toner accommodated in the developer passage section can be uniformly agitated in the radial direction rather than agitated locally. By providing the developer accommodating section in addition to the developer passage section, a sufficient amount of toner can be accommodated in the toner cartridge. Further, the accommodating section agitating mechanisms provided in the developer accommodating section can reliably convey toner from the developer accommodating section to the developer passage section.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
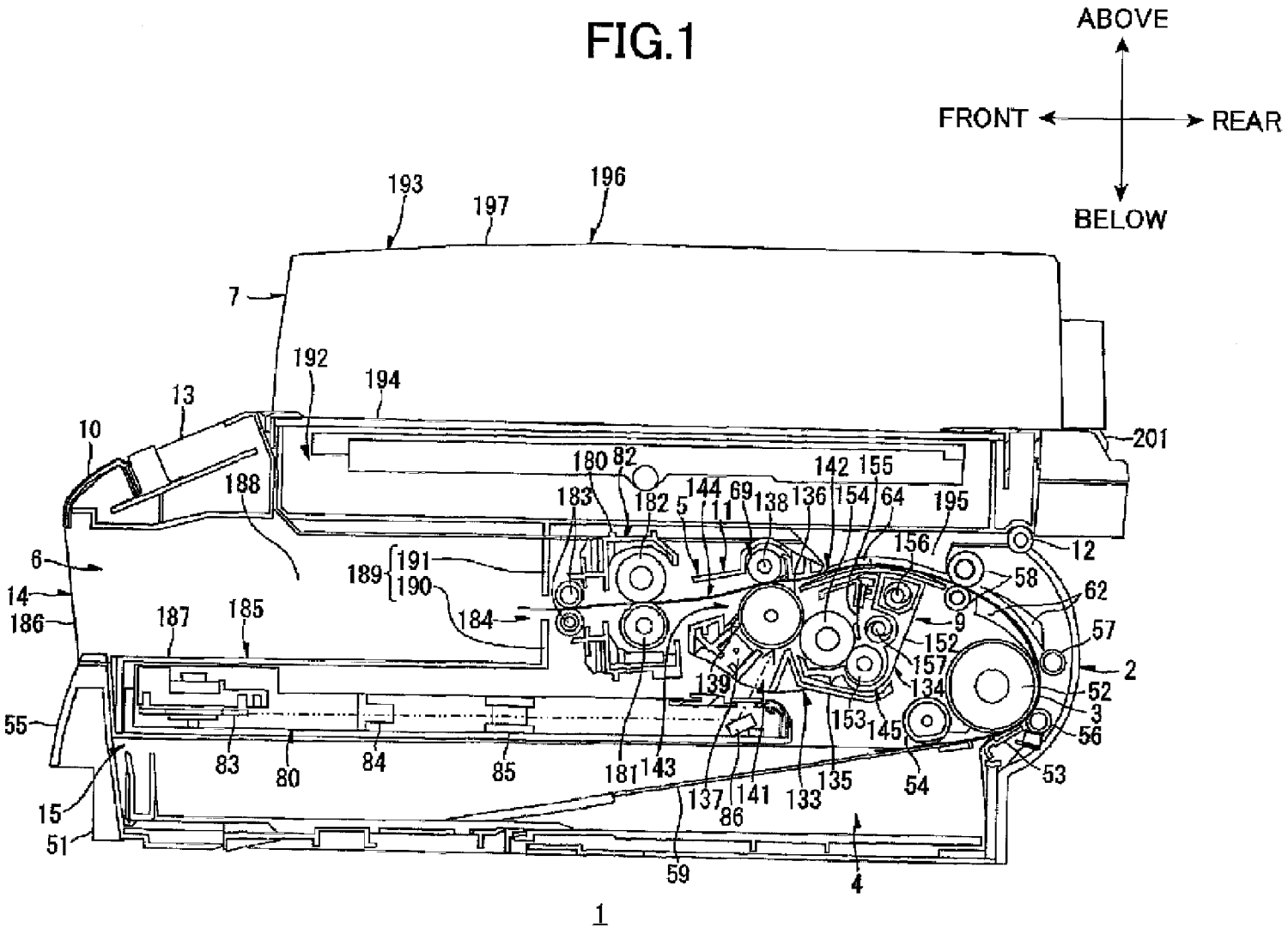
FIG. 1 is a side cross-sectional view of a laser printer as an example of the image-forming device according to the present invention when a scanning unit is closed.

As shown in FIG. 1, a laser printer 1 includes a main casing 2 and, a feeding unit 4 and an image-forming unit 5 disposed within the main casing 2, a discharging unit 6 formed on the main casing 2 and a scanning unit 7 disposed above the main casing 2.

The feeding unit 4 is mounted in the main casing 2 for supplying sheets of a paper. The image-forming unit 5 is mounted in the main casing 2 for forming images on the paper supplied from the feeding unit 4. The scanning unit 7 is disposed in the main casing 2 for scanning image data on the original.

In the following description, the left side in FIG. 1 will be referred to as the "front side" of the laser printer 1 and a process cartridge 8 (described later) when the process cartridge 8 is mounted in the main casing 2, and the right side in FIG. 1 as the "rear side". Further, the near side in FIG. 1 will be referred to as the "right side," and the far side in FIG. 1 will be referred to as the "left side." The right-to-left direction will be referred to as "width direction."

Figure 2:
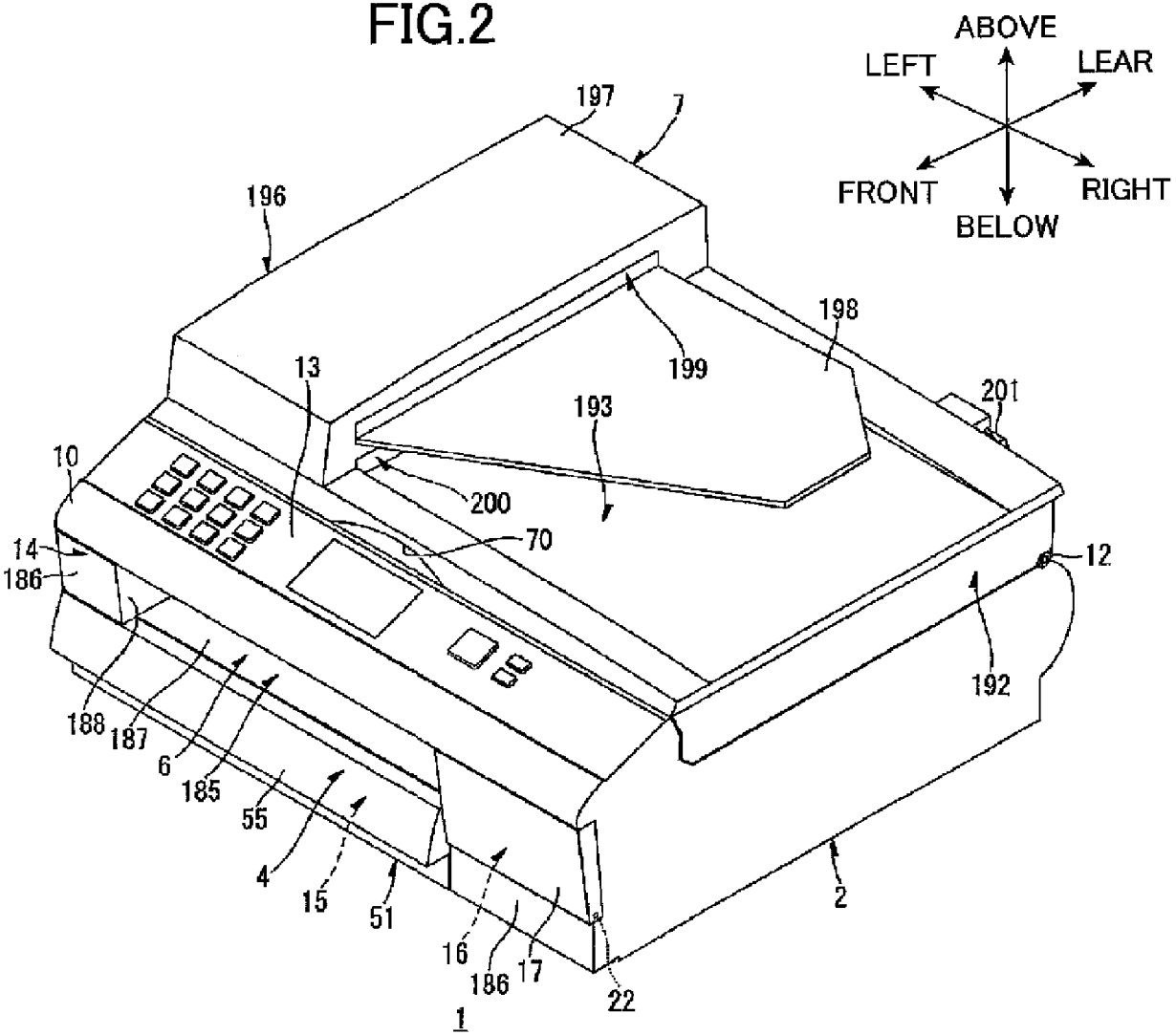
FIG. 2 is a perspective view of the laser printer in FIG. 1 from diagonally above and rightward of the front side thereof.

As shown in FIGS. 1 and 2, the main casing 2 is formed with a hollow substantially box shape. A top wall 10 having a substantially rectangular frame shape in a plan view is formed on the top of the main casing 2.

A control panel 13 is provided on a front side portion of the top wall 10. The control panel 13 includes a liquid crystal panel for displaying the operating status and the like of the laser printer 1, and buttons and the like that the user can operate to set operating conditions for the laser printer 1.

Figure 3:
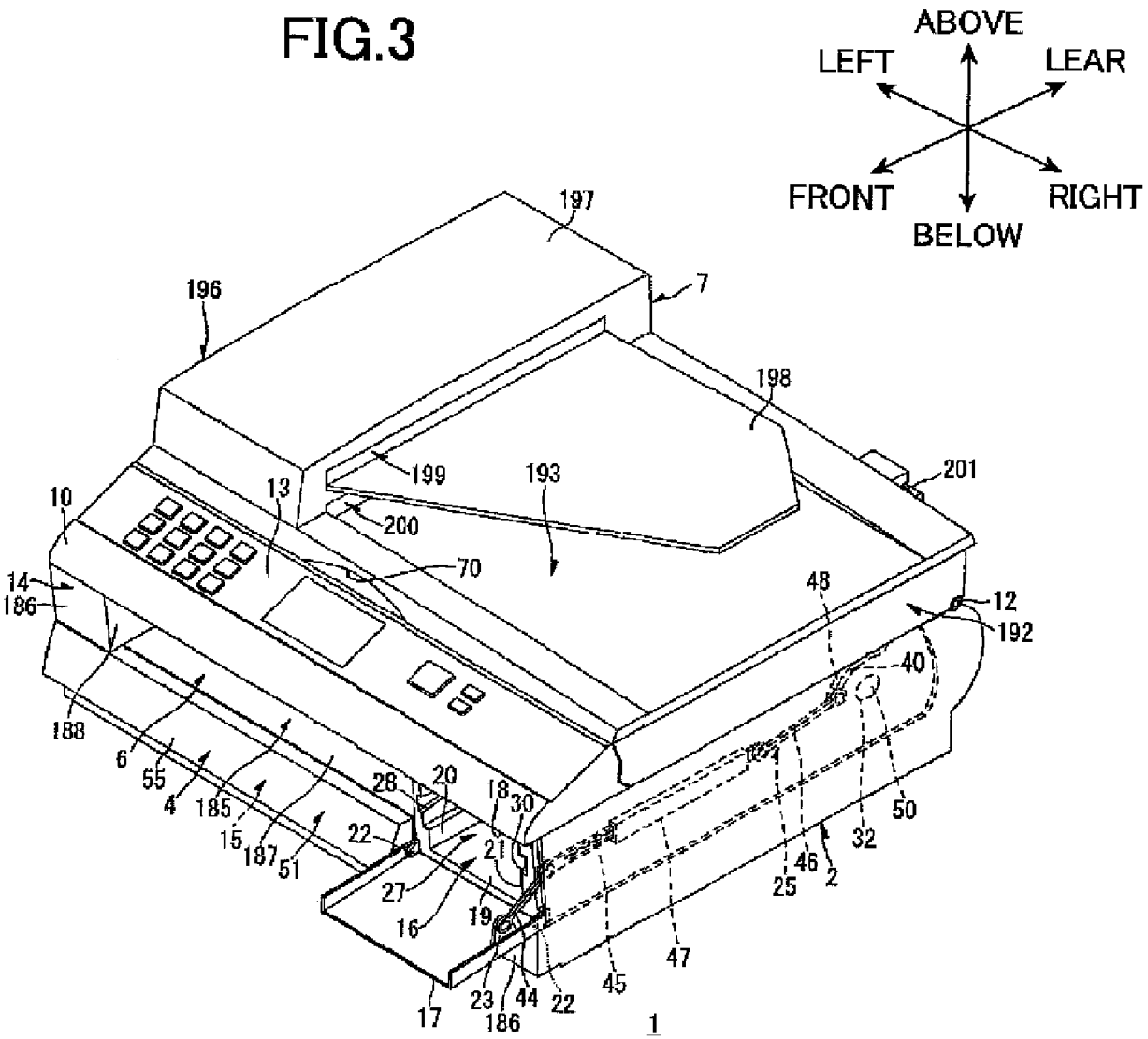
FIG. 3 is the perspective view in FIG. 2 when a cover is in the open position.

The main casing 2 is formed with a process unit mounting opening 11, a paper tray mounting opening 15, and a cartridge mounting opening 16 (see FIG. 3).

Figure 4A:
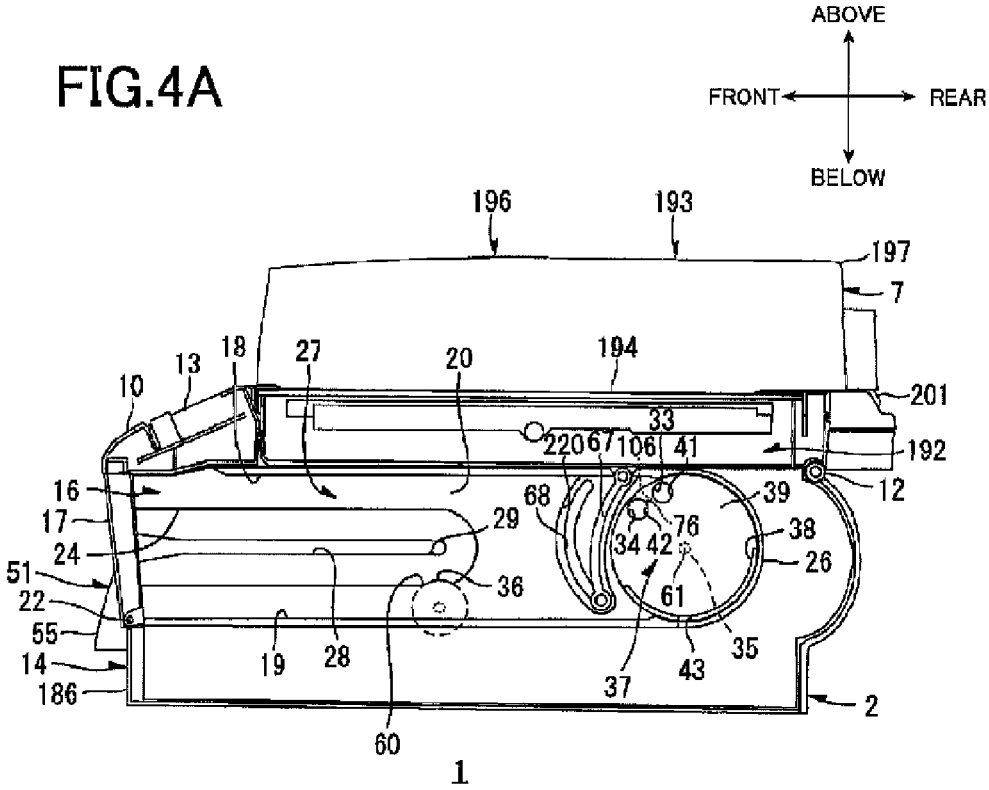
FIG. 4A is a side cross-sectional view of the laser printer for illustrating opening and closing of the scanning unit when the scanning unit is in the closed state.
Figure 4B:
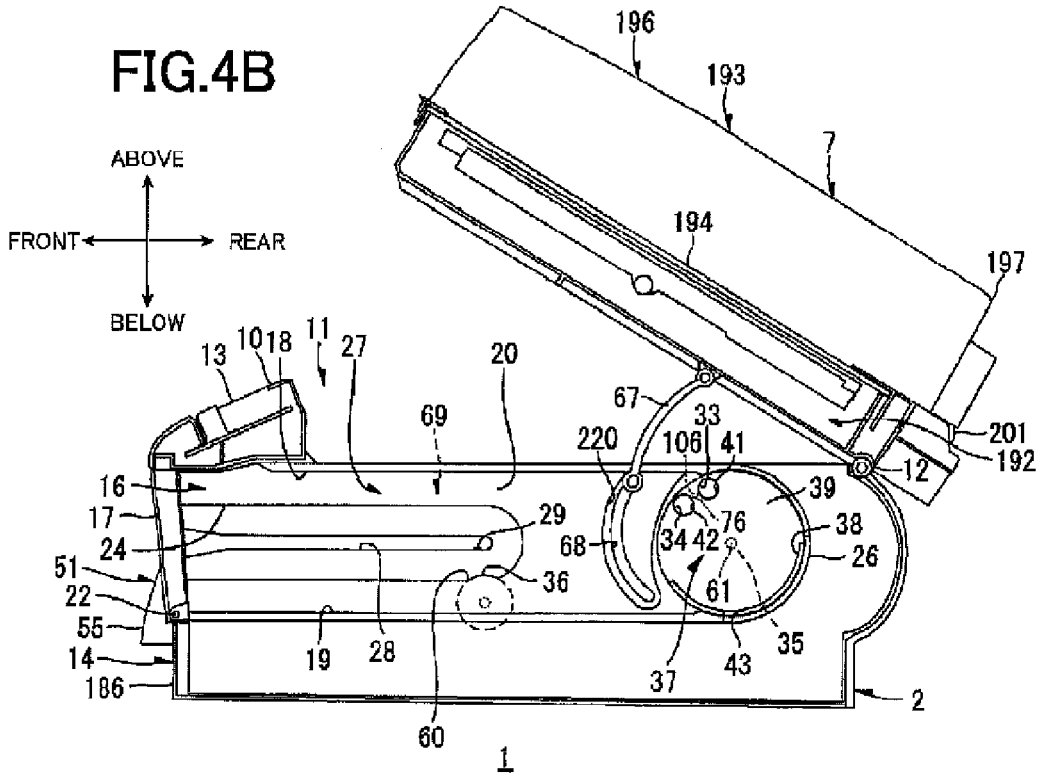
FIG. 4B is a side cross-sectional view of the laser printer for illustrating opening and closing of the scanning unit when the scanning unit is in the open state.

The process unit mounting opening 11 is formed in the top wall 10 in a substantially rectangular shape in a plan view. As shown in FIGS. 4A and 4B, the scanning unit 7 is disposed so as to cover or expose the process unit mounting opening 11. The scanning unit 7 is pivotably supported on the top rear edge of the main casing 2 by a support shaft 12 extending along the width direction of the main casing 2. A guide lever 67 is provided on the underside surface of the scanning unit 7 near the support shaft 12 and extends downward in a substantially arc shape that expands forward in a side view. The bottom end of the guide lever 67 is engaged in a guide groove 68 formed in a left wall 20 of an accommodating section described later. When pivoting the scanning unit 7, the lower end of the guide lever 67 slides along the guide groove 68.

As shown in FIG. 4A, the scanning unit 7 closes the process unit mounting opening 11 when pivoted about the support shaft 12 unit the front end of the scanning unit 7 contacts the top wall 10. The position of the scanning unit 7 in FIG. 4A is the closed position. On the other hand, when the scanning unit 7 is pivoted about the support shaft 12 until the front end of the scanning unit 7 separates from the top wall 10, as shown in FIG. 4B, the process unit mounting opening 11 is opened in a slanted direction upward and toward the front. The position of the scanning unit 7 in FIG. 4B is the open position. The process unit 9 (see FIG. 1) can be detachably mounted in the main casing 2 by inserting the process unit 9 through the open process unit mounting opening 11 in a direction slanted downward and to the rear. In other words, the process unit mounting opening 11 is formed at a position opposing the process unit 9 in the mounting direction of the process unit 9.

As shown in FIG. 2, the main casing 2 has a front wall 14, and the paper tray mounting opening 15 is formed in the bottom half of the front wall 14, substantially in a central position. The paper tray mounting opening 15 has a rectangular shape extending in the width direction, allowing a paper tray 51 (described later) to be mounted in or removed from the main casing 2 via the paper tray mounting opening 15 in the front-to-rear direction.

As shown in FIG. 3, the cartridge mounting opening 16 is formed on the front wall 14 at a position opposing the toner cartridge 8 (described later) in the mounting direction of the toner cartridge 8, and more specifically on the right side of the paper tray mounting opening 15. The cartridge mounting opening 16 has a rectangular shape extending in the width direction and is longer than the paper tray mounting opening 15 vertically and shorter in the width direction. A cover 17 is provided on the main casing 2 over the cartridge mounting opening 16 for covering or exposing the cartridge mounting opening 16.

In a front view, the cover 17 is formed in a rectangular shape slightly larger than the cartridge mounting opening 16. A support shaft 22 is inserted through both widthwise ends on the bottom edge of the cover 17 so that the cover 17 can freely rotate about the support shaft 22 between the closed position (see FIG. 2) and the closed position (see FIG. 3). When in the closed position shown in FIG. 2, the cover 17 is substantially vertical and covers the front side of the cartridge mounting opening 16. When in the open position shown in FIG. 3, the cover 17 is angled in substantially a horizontal direction, revealing the front side of the cartridge mounting opening 16.

As shown in FIG. 3, a connecting part 23 is provided at a midway position on the right edge of the cover 17. The connecting part 23 has a plate shape flush with the right edge portion of the cover 17 and is substantially triangular-shaped, growing narrower toward the cartridge mounting opening 16 side in the opening and closing direction. A transmission member 25 (described later) is coupled with the cover 17 via the connecting part 23.

An accommodating section is formed in the main casing 2 by a top wall 18, a bottom wall 19, the left wall 20, and a right wall 21 extending rearward in a substantially horizontal direction from peripheral edges of the cartridge mounting opening 16. Specifically, the top wall 18 extends from the top edge of the rectangular cartridge mounting opening 16. The bottom wall 19 extends from the bottom edge of the cartridge mounting opening 16. The left wall 20 extends from the left edge of the cartridge mounting opening 16. The right wall 21 extends from the right edge of the cartridge mounting opening 16. As will be described later, the left wall 20 opposes the process unit 9 in the width direction on the left side surface and opposes the toner cartridge 8 in the width direction on the right side surface.

Figure 5:
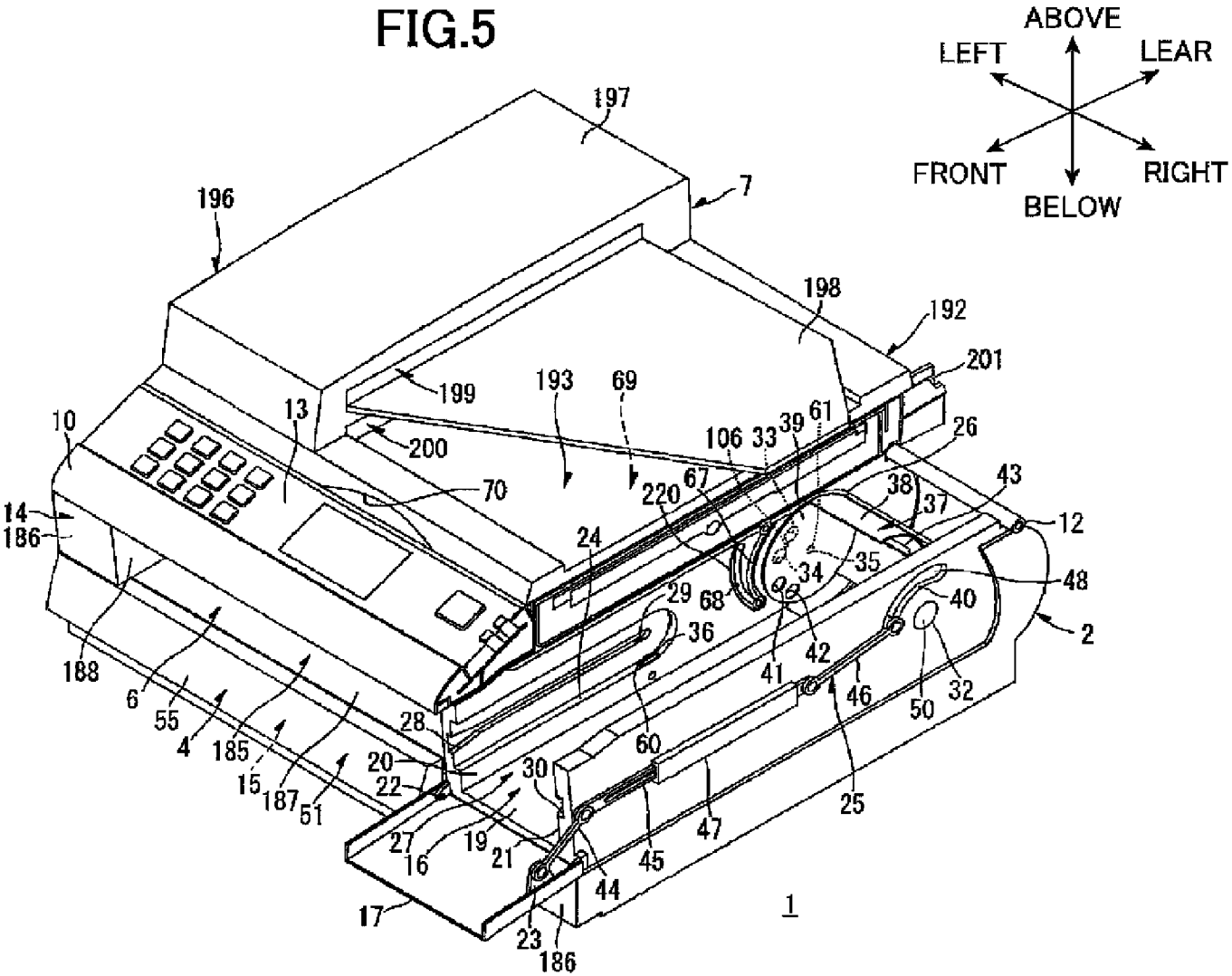
FIG. 5 is the same perspective view in FIG. 3 when the inside of a cartridge accommodating space is exposed.

As shown in FIG. 5, the left wall 20 and right wall 21 have a substantially rectangular shape extending in the front-to-rear direction. The rear edges of the left wall 20 and right wall 21 have a semicircular shape expanding toward the rear. The rear end of the left wall 20 is formed in a circular shape and has a first shaft hole 35 formed in the center of this circular portion. A casing side supply hole 33 is formed in the rear end of the left wall 20 substantially at the 11 o'clock position (about 30° apart in the circle) in a right side view with reference to the first shaft hole 35. A casing side return hole 34 is formed in the rear end of the left wall 20 at a position separated from the casing side supply hole 33 diagonally downward and forward of the same (about 10 o'clock). The casing side supply hole 33 and casing side return hole 34 are circular-shaped holes of approximately the same size for inserting the left wall 20 in the width direction.

A second shaft hole 106 is formed in the left wall 20 between the casing side supply hole 33 and casing side return hole 34.

An accommodating recessed part 220 is also formed in the right side surface of the left wall 20 at a position forward of the casing side supply hole 33 and casing side return hole 34, and more specifically forward of a first casing side shutter 37 described later. The accommodating recessed part 220 is recessed toward the left side and extends downward from the top edge of the left wall 20, forming a substantially arc shape that expands forward in a side view. The depth of the accommodating recessed part 220 is greater than the widthwise dimension of the guide lever 67 described above. The depth of the accommodating recessed part 220 is the widthwise dimension of the same.

The guide groove 68 is formed at a forward position in the accommodating recessed part 220. The guide groove 68 penetrates the left wall 20 in the width direction and is substantially arc-shaped in a side view, conforming to the path along which the lower end of the guide lever 67 follows as the scanning unit 7 pivots. The guide lever 67 is disposed inside the accommodating recessed part 220. In this state, the guide lever 67 is accommodated in the accommodating recessed part 220 so as not to protrude rightward from the right edge of the accommodating recessed part 220.

A gear accommodating groove 24 is also formed in the left wall 20. The gear accommodating groove 24 extends substantially horizontally from an approximate vertical center position on the front edge to an approximate left-to-right center position in the left wall 20.

The gear accommodating groove 24 has a band shape and is recessed leftward in the left wall 20. The rear end of the gear accommodating groove 24 is formed in a semicircular shape that expands rearward. A gear exposing hole 60 has a rectangular shape in a plan view, and is formed in the bottom wall of the gear accommodating groove 24 at a position in the front-to-rear direction substantially equivalent to the circular center of the rear end of the gear accommodating groove 24 formed in the semicircular shape described above. A left guide groove 28 is also formed in the gear accommodating groove 24 at a vertically central position thereof. The left guide groove 28 extends substantially horizontally from the front edge of the left wall 20 to a position near the gear exposing hole 60 relative to the front-to-rear direction. The front-to-rear length of the left guide groove 28 is equivalent to about half the front-to-rear length of the left wall 20.

The left guide groove 28 is a groove recessed further leftward from the gear accommodating groove 24. The width of the left guide groove 28 narrows toward the rear in the front region thereof and is fixed thereafter (rearward of the above-mentioned front region). A positioning protrusion 29 is provided on the lower wall of the left guide groove 28 at a position substantially equivalent to the gear exposing hole 60 in the front-to-rear direction and protrudes slightly upward.

Figure 6:
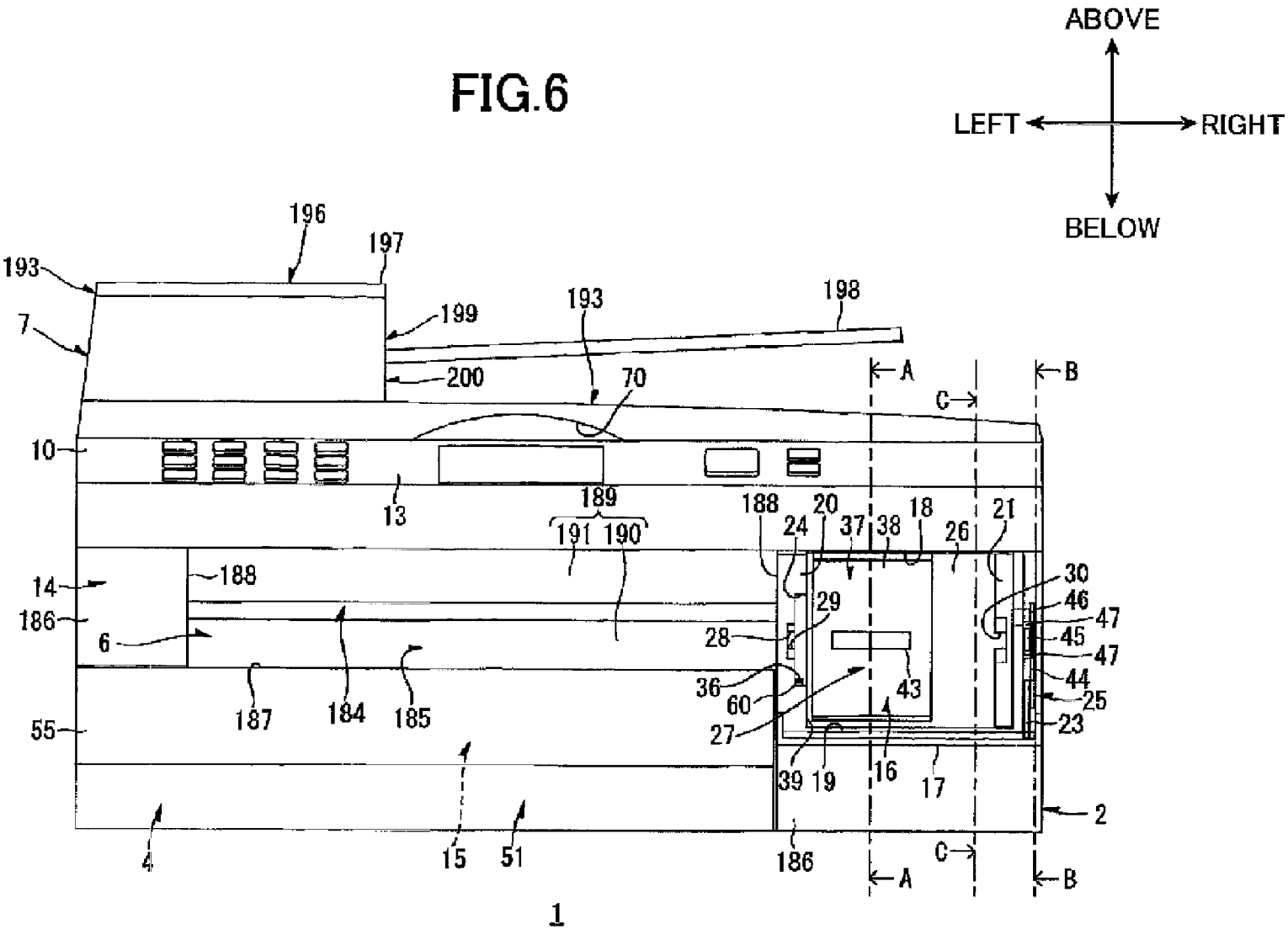
FIG. 6 is a front view of the laser printer when the cover is in the open position.

As shown in FIG. 6, a right guide groove 30 is formed in the right wall 21 at a position opposing the left guide groove 28 in the width direction, and has substantially the same shape and width as the left guide groove 28.

Figure 9A:
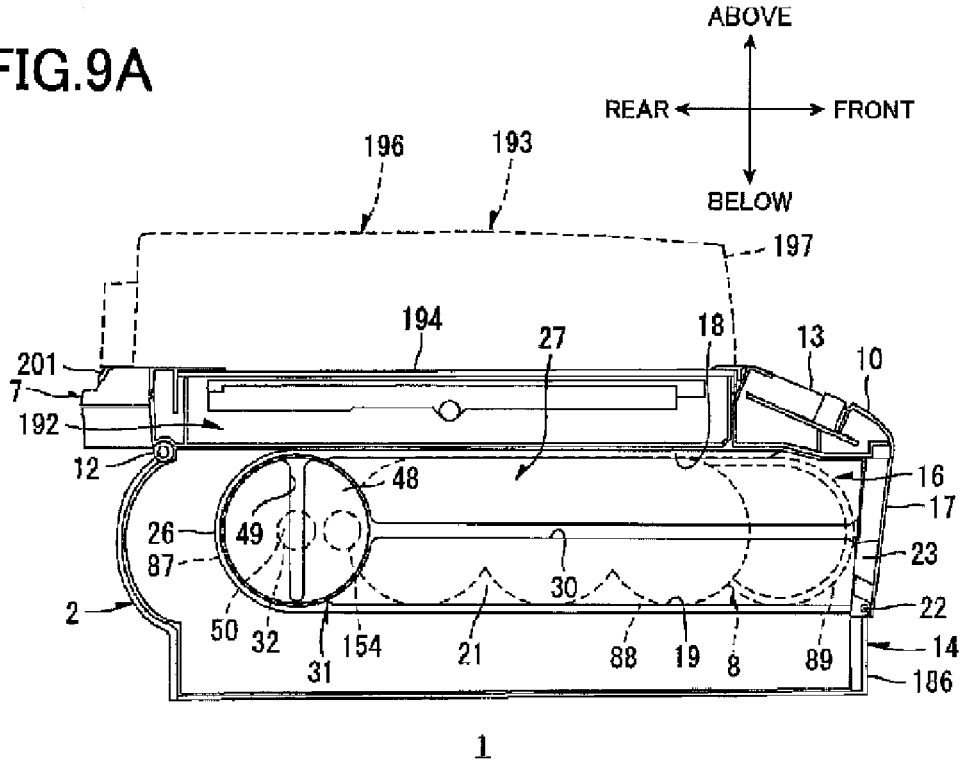
FIG. 9A is a cross-sectional view of the laser printer along the line C-C in FIG. 6 when the cover is in the closed position.
Figure 9B:
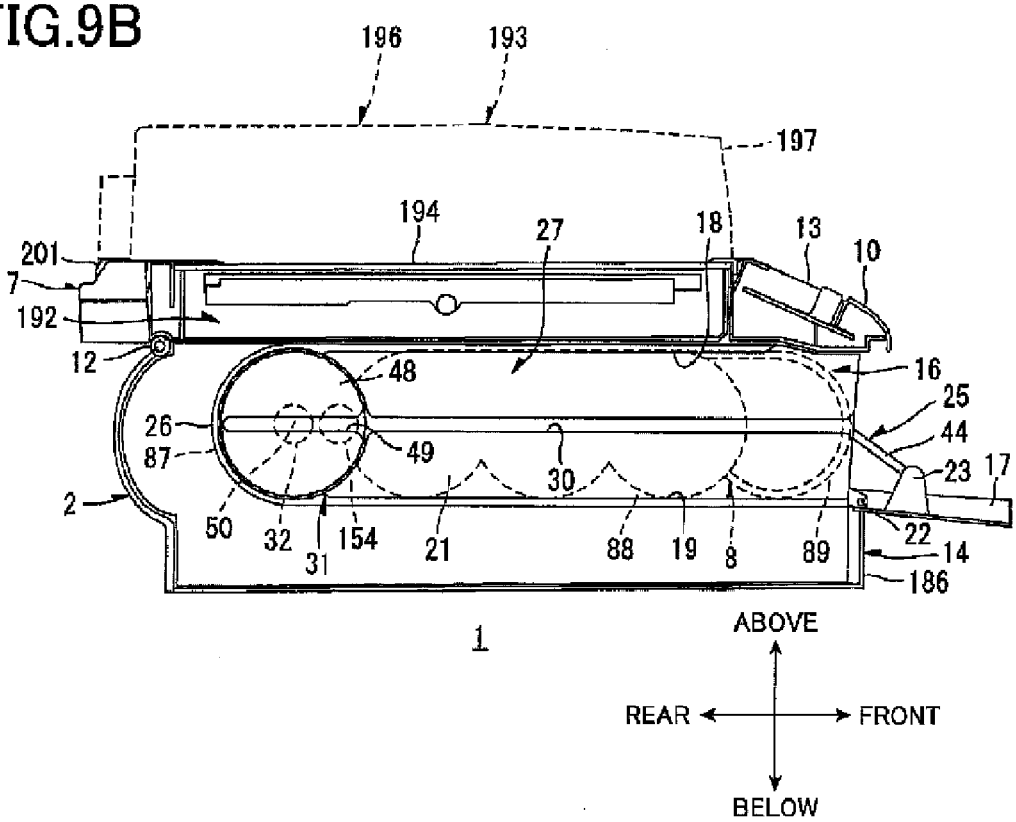
FIG. 9B is a cross-sectional view of the laser printer along the line C-C in FIG. 6 when the cover is in the open position.

As shown in FIGS. 9A and 9B, the right guide groove 30 extends substantially horizontally rearward from the front edge of the right wall 21 and has a front-to-rear length equivalent to substantially three-quarters the front-to-rear length of the right wall 21. The width of the right guide groove 30 narrows toward the rear in the front region thereof and is uniform rearward of the front region. A rotational plate accommodating section 31 is formed in the right wall 21 on the rear side of the right guide groove 30.

The rotational plate accommodating section 31 is formed in a circular shape in a side view recessed toward the right side. The portion of the rotational plate accommodating section 31 in the right wall 21 corresponding to the rear half is a rear end formed in a semicircular shape in the right wall 21, as described above. A shaft hole 32 is formed in the portion of the right wall 21 corresponding to the rotational plate accommodating section 31 at a position in the circular center of the rotational plate accommodating section 31 and penetrates the right wall 21 in the width direction.

Figure 8A:
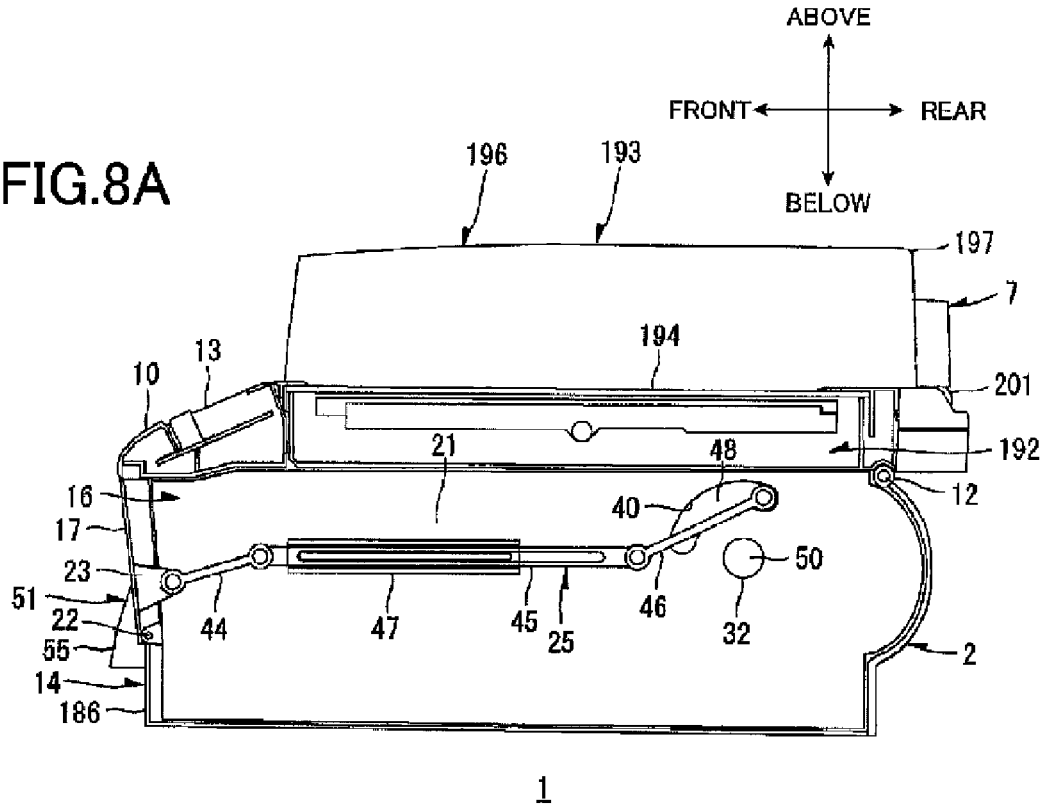
FIG. 8A is a cross-sectional view of the laser printer along the line B-B in FIG. 6 when the cover is in the closed position.
Figure 8B:
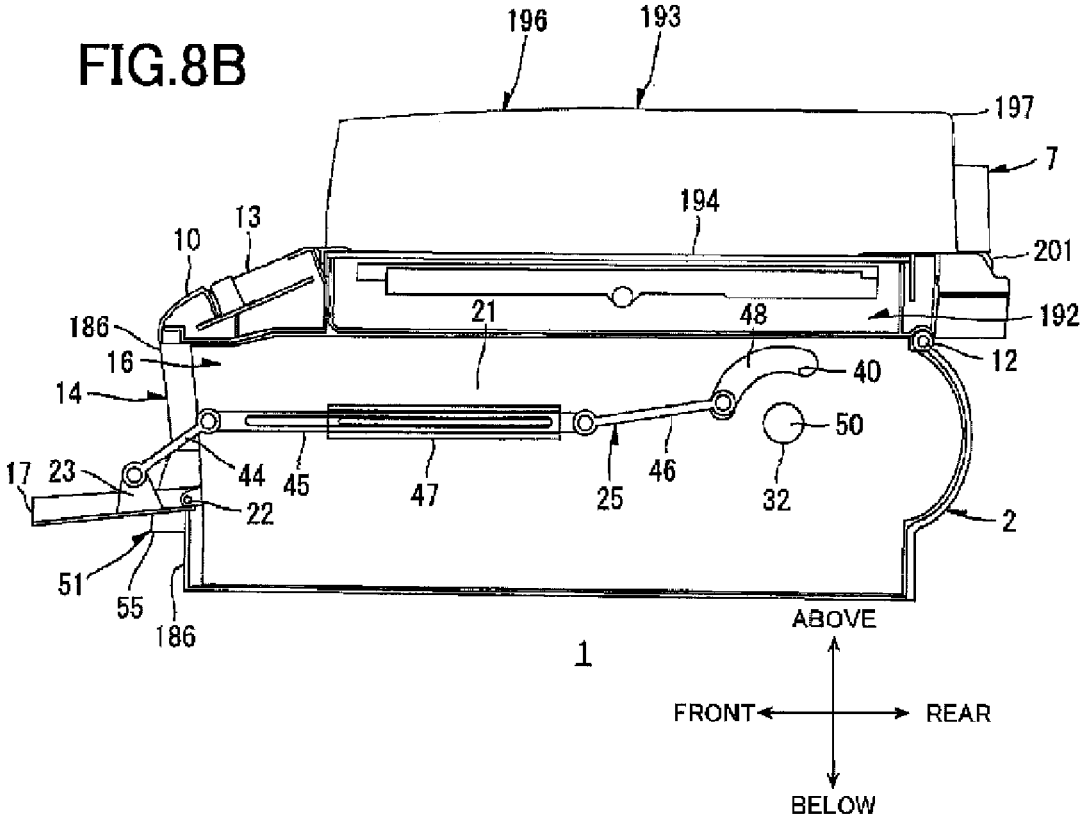
FIG. 8B is a cross-sectional view of the laser printer along the line B-B in FIG. 6 when the cover is in the open position.

As shown in FIGS. 8A and 8B, a substantially arc-shaped through-hole 40 is formed in the portion of the right wall 21 corresponding to the rotational plate accommodating section 31 so as to penetrate the right wall 21 in the width direction over a range from a position at about 9 o'clock to a position at about 1 o'clock (about 30° apart in a circle) with reference to the shaft hole 32 in a right side view.

Figure 7A:
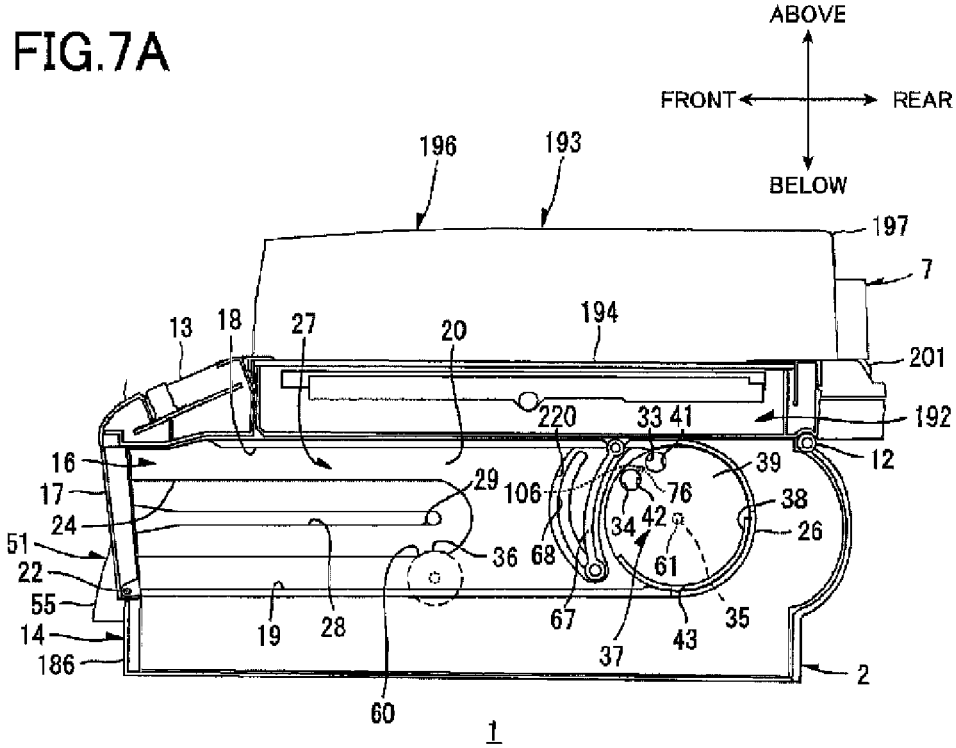
FIG. 7A is a cross-sectional view of the laser printer along the line A-A in FIG. 6 when the cover is in the closed position.
Figure 7B:
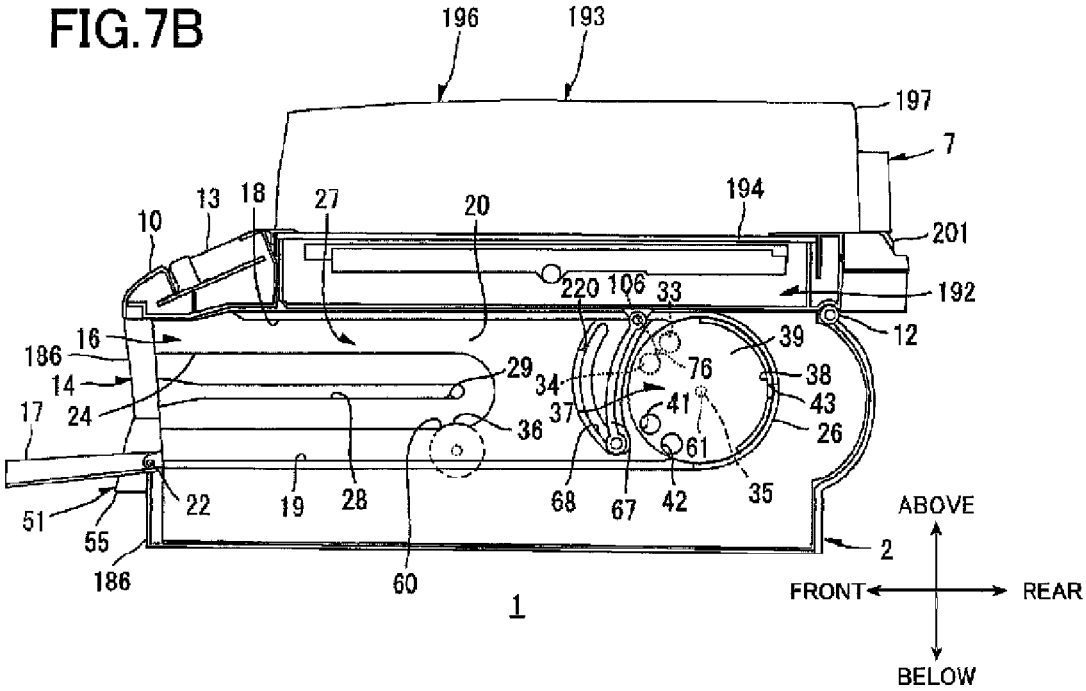
FIG. 7B is a cross-sectional view of the laser printer along the line A-A in FIG. 6 when the cover is in the open position.

As shown in FIGS. 7A and 7B, the top wall 18 and bottom wall 19 have a substantially rectangular shape elongated in the front-to-rear direction. A curved wall 26 connects the rear ends of the top wall 18 and bottom wall 19. The curved wall 26 is a thin plate formed in a substantially semicircular arc shape expanding rearward in a side view. The left edge of the curved wall 26 is connected to the peripheral edge of the semicircular shape described above formed by the rear end of the left wall 20, while the right edge of the curved wall 26 is connected to the peripheral edge of the semicircular shape described above formed by the rear end of the right wall 21 (see FIG. 9). Further, the top edge of the curved wall 26 is connected to the rear edge of the top wall 18, while the bottom edge of the curved wall 26 is connected to the rear edge of the bottom wall 19. The top wall 18, bottom wall 19, left wall 20, right wall 21, and curved wall 26 define a rectangular parallelepiped-shaped cartridge accommodating space 27 in the main casing 2 that is in communication with the cartridge mounting opening 16. The depth of the cartridge accommodating space 27 in the front-to-rear direction is equivalent to about four-fifths the front-to-rear dimension of the main casing 2. The cartridge accommodating space 27 accommodates the toner cartridge 8 (see FIG. 9).

A drive input gear 36 and the first casing side shutter 37 are provided in the cartridge accommodating space 27. The transmission member 25 (see FIG. 6) is provided in the main casing 2 on the right side of the cartridge accommodating space 27.

As shown in FIG. 5, a process unit accommodating space 69 for accommodating the process unit 9 (see FIG. 1) is formed in the main casing 2 on the left side of the cartridge accommodating space 27 with the left wall 20 interposed therebetween. In other words, the left wall 20 is positioned between the toner cartridge 8 (see FIG. 11) accommodated in the cartridge accommodating space 27 and the process unit 9 (see FIG. 1) accommodated in the process unit accommodating space 69 so that the left side surface of the left wall 20 opposes the process unit 9 in the width direction while the right side surface opposes the toner cartridge 8 in the width direction.

The drive input gear 36 is a spur gear having teeth formed along the outer peripheral surface thereof. The drive input gear 36 is disposed so that the upper edge is exposed through the gear exposing hole 60 in the gear accommodating groove 24. A rotational shaft of the drive input gear 36 is rotatably supported in the left wall 20. While not shown in the drawing, the left end of the rotational shaft protrudes from the left side of the left wall 20 and couples with a drive motor (not shown).

When the drive motor (not shown) is driven, the drive input gear 36 rotates clockwise in a right side view.

The first casing side shutter 37 is disposed in the rear side of the cartridge accommodating space 27. The first casing side shutter 37 is integrally provided with an arc-shaped wall 38, and a side wall 39.

As shown in FIG. 5, the arc-shaped wall 38 is a thin plate formed in a semicircular arc shape in a side view following the curved wall 26. A fitting hole 43 (see FIG. 6) is formed in the circumferential center region of the arc-shaped wall 38. The fitting hole 43 has a rectangular shape in a front view that is elongated in the width direction.

The side wall 39 has a circular disc shape in a side view. Half of the outer periphery of the side wall 39 is connected to the left edge of the arc-shaped wall 38.

As shown in FIG. 5, a first rotational shaft 61 is integrally provided on the side wall 39 protruding leftward from the circular center thereof. A first casing shutter supply opening 41 and a first casing shutter return opening 42 are formed in the side wall 39 along the peripheral edge thereof. The first casing shutter return opening 42 is separated from the first casing shutter supply opening 41 in the counterclockwise direction when viewed from the right side. Both the first casing shutter supply opening 41 and first casing shutter return opening 42 penetrate the side wall 39 in the width direction and have a circular shape substantially the same size as the casing side supply hole 33 and casing side return hole 34.

By inserting the first rotational shaft 61 through the first shaft hole 35 of the left wall 20, the first casing side shutter 37 is rotatably supported in the left wall 20. Specifically, the first casing side shutter 37 can freely rotate between the closed position (see FIG. 7B) and the open position (see FIG. 7A).

When the first casing side shutter 37 is in the closed position shown in FIG. 7B, the casing side supply hole 33 and casing side return hole 34 are closed on the right side surface of the left wall 20 by parts of the side wall 39 excluding the first casing shutter supply opening 41 and first casing shutter return opening 42.

However, the first casing side shutter 37 is in the open position shown in FIG. 7A when rotated about 90° clockwise from the closed position when viewed from the right side. When the first casing side shutter 37 is in the open position, the first casing shutter supply opening 41 and casing side supply hole 33 are aligned in the width direction and in communication with each other. Similarly, the first casing shutter return opening 42 and casing side return hole 34 are aligned in the width direction and in communication with each other.

As shown in FIG. 6, the transmission member 25 is disposed in the main casing 2 between the right wall 21 and the right side wall of the main casing 2.

The transmission member 25 is referred to as a linking device. As shown in FIG. 8, the transmission member 25 includes a first linking rod 44, a sliding rod 45, a second linking rod 46, a rod support part 47, and a rotational plate 48.

As shown in FIG. 5, the rod support part 47 has a hollow prismatic shape that is rectangular in a front view and is elongated in the front-to-rear direction. An opening is formed in each of the front and rear ends of the rod support part 47 to allow external communication with the hollowed portion of the rod support part 47. The right wall 21 and the right wall of the main casing 2 support the rod support part 47.

The sliding rod 45 is formed longer in the front-to-rear direction than the rod support part 47 and smaller than the front surface dimensions of the hollow portion in the rod support part 47 in a front view. The sliding rod 45 is supported by the rod support part 47 so as to be capable of sliding in the front-to-rear direction so that both the front and rear ends of the sliding rod 45 are exposed in the openings of the rod support part 47 on the front and rear ends thereof.

The rear end of the first linking rod 44 is coupled with the front end of the sliding rod 45, while the front end of the first linking rod 44 is coupled with the connecting part 23 of the cover 17. The first linking rod 44 can pivot about the part coupled with the sliding rod 45 and the part coupled with the connecting part 23.

As shown in FIG. 9A, the rotational plate 48 is formed in a disc shape in a side view and has a slightly smaller diameter than the side surface of the rotational plate accommodating section 31. The rotational plate 48 is accommodated inside the rotational plate accommodating section 31 of the cartridge accommodating space 27. A rotational plate guide groove 49 is formed in the left side surface of the rotational plate 48. The rotational plate guide groove 49 extends diametrically through the circular center of the rotational plate 48 and is formed as a rightward recess having substantially the same width as the right guide groove 30. A support shaft 50 is formed in the circular center position of the rotational plate 48 and protrudes rightward. By inserting the support shaft 50 into the shaft hole 32 of the rotational plate accommodating section 31, the rotational plate 48 is rotatably supported on the right wall 21 within the rotational plate accommodating section 31. Specifically, the rotational plate 48 can freely rotate between the closed position (see FIG. 9B) and the open position (see FIG. 9A).

More specifically, when the through-hole 40 is in the closed position shown in FIG. 9B, the right guide groove 30 and rotational plate guide groove 49 are linked along the front-to-rear direction. However, the rotational plate 48 is in the open position when rotated about 90° counterclockwise from the closed position in a left side view. When the rotational plate 48 is in the open position shown in FIG. 9A, the rotational plate guide groove 49 is not linked with the right guide groove 30 but is substantially orthogonal thereto. When the rotational plate 48 is supported on the right wall 21, the left side surface of the rotational plate 48 is flush with the left side surface of the right wall 21 in the region forward of the rotational plate accommodating section 31 in a front view.

As shown in FIGS. 8A and 8B, the second linking rod 46 is longer than the first linking rod 44, and the front end of the second linking rod 46 is coupled to the rear end of the sliding rod 45. The rear end of the second linking rod 46 is coupled to the right side surface of the rotational plate 48 via the through-hole 40 of the right wall 21 at a location separated from the support shaft 50 in an outwardly radial direction. The second linking rod 46 can freely pivot about the part coupled with the sliding rod 45 and the part coupled with the rotational plate 48.

Next, the operation of the transmission member 25 will be described.

When the cover 17 is in the open position shown in FIG. 8B, the sliding rod 45 is in the forwardmost position supported in the rod support part 47. Further, the rotational plate 48 is in the closed position (see FIG. 9B). At this time, the cover 17 is rotated from the open position toward the closed position (see FIG. 8A). Consequently, a drive force for rotating the cover 17 is applied to the first linking rod 44 to push the first linking rod 44 rearward. The drive force is transmitted to the sliding rod 45 via the first linking rod 44 to slide the sliding rod 45 rearward. The drive force is further transmitted to the second linking rod 46 via the sliding rod 45 for moving the second linking rod 46 rearward as the second linking rod 46 pivots counterclockwise in a right side view about the part coupled with the sliding rod 45. Since the part of the second linking rod 46 coupled with the rotational plate 48 moves along the arc of the through-hole 40 at this time, the drive force is transmitted to the rotational plate 48 via the second linking rod 46, causing the rotational plate 48 to rotate counterclockwise in a left side view from the closed position (see FIG. 9B) to the open position (see FIG. 9A).

As described above, the rotational plate 48 rotates from the closed position to the open position in association with rotation of the cover 17 from the open position (see FIG. 9B) to the closed position (see FIG. 9A). When the cover 17 is completely rotated into the closed position (when the rotational plate 48 is rotated to the open position), the sliding rod 45 is in the rearwardmost position while supported in the rod support part 47, as shown in FIG. 8A.

On the other hand, when rotating the cover 17 in the closed position toward the open position, the drive force for rotating the cover 17 is applied to the first linking rod 44 for pulling the first linking rod 44 forward. This drive force is subsequently transmitted to the sliding rod 45 via the first linking rod 44 to slide the sliding rod 45 forward, and is further transmitted to the second linking rod 46 via the sliding rod 45 to move the second linking rod 46 forward as the second linking rod 46 pivots clockwise in a right side view about the part of the second linking rod 46 coupled to the sliding rod 45. Since the part of the second linking rod 46 coupled to the rotational plate 48 moves along the arc of the through-hole 40 at this time, the drive force is transmitted to the rotational plate 48 via the second linking rod 46, causing the rotational plate 48 to rotate clockwise in a left side view from the open position (see FIG. 9A) toward the closed position (see FIG. 9B).

As described above, the rotational plate 48 is rotated from the open position to the closed position in association with rotation of the cover 17 from the open position (see FIG. 9A) to the closed position (see FIG. 9B).

Figure 10A:
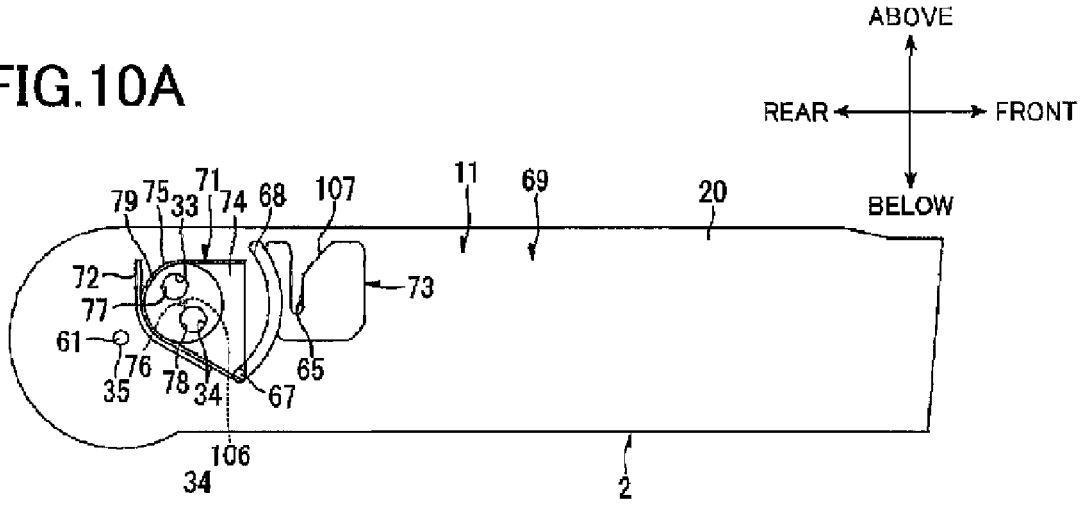
FIG. 10A is a left side view showing the relative region on a left side wall of an accommodating section when a second casing shutter is in the open position.
Figure 10B:
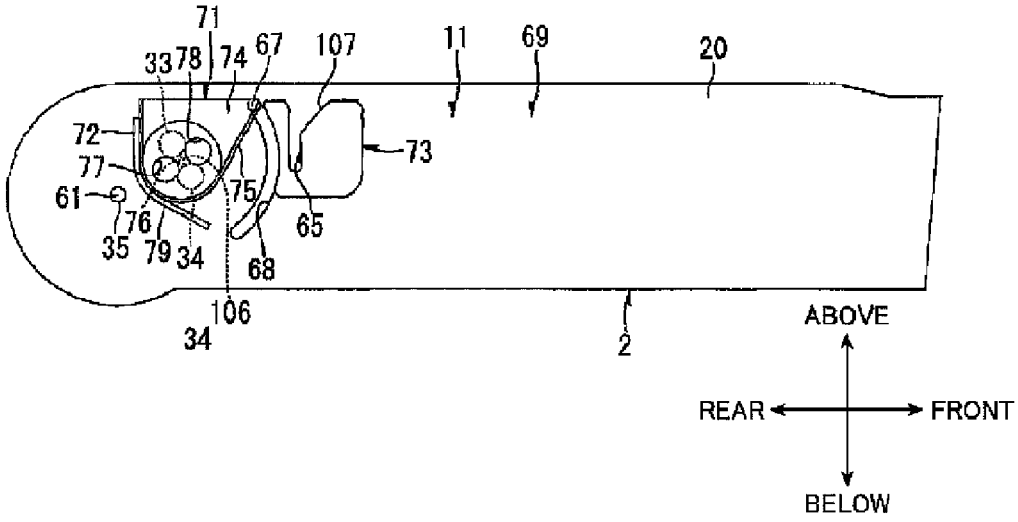
FIG. 10B is a left side view showing the relative region on a left side wall of an accommodating section when the second casing shutter is in the closed position.

FIG. 10A is a left side view showing the relative region on the left side wall of the accommodating section when the second casing shutter is in the open position. FIG. 10B is the left side view of the accommodating section when the second casing shutter is in the closed position. The process unit accommodating space 69 is defined in the left-to-right direction by the left wall 20 and the left wall of the main casing 2. The process unit accommodating space 69 is defined in the front-to-rear direction by a rear discharge wall 189 (see FIG. 1) described later and the rear wall of the main casing 2. The process unit accommodating space 69 is also defined in the vertical direction by the bottom surface of the scanning unit 7 in the closed position, the rear portion of a scanning section 80 described later, and the rear portion of the feeding unit 4 (see FIG. 1).

As shown in FIGS. 10A and 10B, the process unit accommodating space 69 is provided with a second casing shutter 71, a shutter rotational support member 72, and a shaft holding member 73 as an example of the holding member.

The second casing shutter 71 is disposed on the rear end of the process unit accommodating space 69, and specifically to the rear of the guide groove 68 formed in the left wall 20. The second casing shutter 71 is integrally provided with a triangular wall 74 and a peripheral wall 75.

The triangular wall 74 of the second casing shutter is a thin plate having a substantially triangular shape in a side view, and more specifically the peripheral edge on one corner of the triangular wall 74 is substantially arc-shaped. A second rotational shaft 76 protruding rightward is integrally provided on the triangular wall 74 in the center of the arc shape formed by this corner. A second casing shutter supply hole 77 and a second casing shutter return hole 78 are formed in the triangular wall 74 on opposite sides of the second rotational shaft 76 in a side view. The second casing shutter supply hole 77 and second casing shutter return hole 78 both penetrate the triangular wall 74 in the width direction and are formed as circular holes having substantially the same size as the casing side supply hole 33 and casing side return hole 34.

The peripheral wall 75 is a thin plate formed substantially in a U-shape in a side view and conforms to two sides of the triangular wall 74 forming the substantially arc-shaped corner described above. A fitting notch 79 is formed in the peripheral wall 75 near the second casing shutter supply hole 77 and penetrates the thickness of the peripheral wall 75.

By inserting the second rotational shaft 76 into the second shaft hole 106 in the left wall 20, the second casing shutter 71 is rotatably supported on the left side surface of the left wall 20. In this state, the front end of the second casing shutter 71 confronts the guide groove 68 in the width direction, and the lower end of the guide lever 67 (see FIG. 5) is connected to the front end of the second casing shutter 71. More specifically, with reference to FIG. 10A, the lower end of the guide lever 67 is connected to the lower front end of the triangular wall 74. Consequently, when the scanning unit 7 is pivoted, the second casing shutter 71 freely rotates between the closed position (see FIG. 10B) and the open position (see FIG. 10A).

More specifically, when the scanning unit 7 is in the open position (see FIG. 4B), the second casing shutter 71 is in the closed position (see FIG. 10B). However, when the scanning unit 7 is in the closed position (see FIG. 4A), the second casing shutter 71 is in the open position (see FIG. 10A).

When the second casing shutter 71 is in the closed position shown in FIG. 10B, the casing side supply hole 33 and casing side return hole 34 are closed on the left surface side of the left wall 20 by parts of the triangular wall 74 excluding the second casing shutter supply hole 77 and second casing shutter return hole 78. Further, the peripheral edge portion of the triangular wall 74 on which the peripheral wall 75 is not provided is exposed from above via the process unit mounting opening 11. Accordingly, the fitting notch 79 in the peripheral wall 75 is visible from above in the deepest region of the second casing shutter 71.

On the other hand, when rotated about 90° clockwise in a left side view from the closed position, the second casing shutter 71 is in the open position shown in FIG. 10A. When the second casing shutter 71 is in the open position, the second casing shutter supply hole 77 and casing side supply hole 33 are aligned in the width direction and in communication with each other. Similarly, the second casing shutter return hole 78 and casing side return hole 34 are aligned in the width direction and in communication with each other. The peripheral edge portion of the triangular wall 74 on which the peripheral wall 75 is not provided is positioned on the front end of the triangular wall 74. Accordingly, the fitting notch 79 in the peripheral wall 75 can be seen from the front side in the deepest region of the second casing shutter 71.

Hence, the second casing shutter 71 opens and closes in association with pivoting (opening and closing operations) of the scanning unit 7 between the open position and closed position, as described above.

The shutter rotational support member 72 is provided on the left side surface of the left wall 20 adjacent to the rear side of the second casing shutter 71. The shutter rotational support member 72 is substantially V-shaped in a side view, protruding leftward. Specifically, the shutter rotational support member 72 is formed of one piece that extends vertically, and another piece that extends diagonally downward to the front, where the connecting part between the two pieces is curved. The shutter rotational support member 72 is configured so that the first piece follows the rear edge of the second casing shutter 71 in the closed position (see FIG. 10B), and the second piece follows the bottom edge of the second casing shutter 71 in the open position (see FIG. 10A). Accordingly, the rear edge of the second casing shutter 71 contacts the first piece of the shutter rotational support member 72 when the second casing shutter 71 is rotated to the closed position (see FIG. 10B). Further, the bottom edge of the second casing shutter 71 contacts the second piece of the shutter rotational support member 72 when the second casing shutter 71 is rotated to the open position (see FIG. 10A). Therefore, the second casing shutter 71 is supported to rotate between the closed position and the open position.

The shaft holding member 73 is disposed on the left side surface of the left wall 20 in front of the second casing shutter 71, and specifically in front of the guide groove 68. The shaft holding member 73 is formed thinner in the width direction and has a substantially rectangular shape in a side view. A shaft receiving groove 107 is formed in the shaft holding member 73 extending downward from the upper edge thereof. Specifically, the shaft receiving groove 107 extends parallel to the left wall 20 on the left side thereof. The width of the shaft receiving groove 107 is tapered downward in substantially the upper half thereof and is uniform in substantially the lower half thereof. A positioning protrusion 65 is provided on the front side wall of the shaft receiving groove 107 at the bottom end thereof and protrudes slightly rearward.

As shown in FIG. 1, the feeding unit 4 includes a paper tray 51, a supply roller 51, a separating roller 52, a separating pad 53 and a feeding roller 54.

The paper tray 51 is disposed in the lower section of the main casing 2 and can be detachably mounted in the main casing 2 through the front side thereof in the front-to-rear direction. The paper tray 51 has a box shape that is open on the top. A grip part 55 is integrally provided on the front surface of the paper tray 51.

The separating roller 52 and separating pad 53 are disposed above the rear end of the paper tray 51.

the feeding roller 54 is disposed on the front side of the separating roller 52. Further, the feeding unit 4 includes a paper dust roller 56 and a guide roller 57. The paper dust roller 56 is disposed in opposition to the separating roller 52 above the rear edge of the separating pad 53. The guide roller 57 is disposed in the opposition to the separating roller 52 above the paper dust roller 56.

The feeding unit 4 also includes a pair of registration rollers 58 disposed above the separating pad 52. A paper-conveying path 62 is disposed between the guide roller 57 and the registration rollers 58 and guides the paper to the registration rollers 58.

A paper-pressing plate 59 is provided inside the supply tray 51 for supporting the paper 3 in a stacked state. While the paper-pressing plate 59 separates from the main casing 2 via the supply-tray-detaching opening 15, the paper 3 can be stacked on the paper-pressing plate 59.

However, when the supply tray 51 is mounted in the main casing 2, the topmost sheet of paper stacked on the paper-pressing plate 59 is pressed against the feeding roller 54. The rotating feeding roller 54 begins feeding the sheets of the paper toward a separating position between the separating roller 52 and the separating pad 53.

When the feeding roller 54 conveys a sheet of the paper toward the separating position and the sheet becomes interposed between the separating roller 52 and separating pad 53, the rotating separating roller 52 separates and feeds the paper one sheet at a time. Each sheet of paper fed by the separating roller 52 passes between the separating roller 52 and the paper dust roller 53. After the paper dust roller 53 removes paper dust from the sheet of paper, the sheet is conveyed along the U-shaped paper-conveying path 62 on the feeding end, thereby reversing directions in the main casing 2, and is conveyed toward the registration rollers 58.

After registering the paper, the registration rollers 58 convey the paper to a transfer position between a photosensitive drum 136 and a transfer roller 138 described late, at which position a toner image formed on the photosensitive drum 136 is transferred onto the paper.

The image-forming unit 5 includes a scanning unit 80, the process cartridge 8, the process unit 9, and a fixing unit 82.

The scanning section 80 is disposed inside the main casing 2 abutting and overlapping the top of the paper tray 51 from the front edge to a position slightly rearward of the front-to-rear center thereof. The front half of the scanning section 80 also abuts and overlaps the bottom of a discharge tray 185 described later. The scanning unit 4 includes a laser light source (not shown), a polygon mirror 83 that can be driven to rotate, an fθ lens 84, a lens 85, and a reflecting mirror 86. The laser light source emits a laser beam based on image data. As illustrated by a dotted line in FIG. 1, the laser beam is deflected by the polygon mirror 83, passes through the fθ lens 84, is reflected by the reflecting mirror 86, passes through the lens 85, and is reflected downward by the reflecting mirror 86 to be irradiated on the surface of the photosensitive drum 136 in the process unit 9.

Figure 11A:
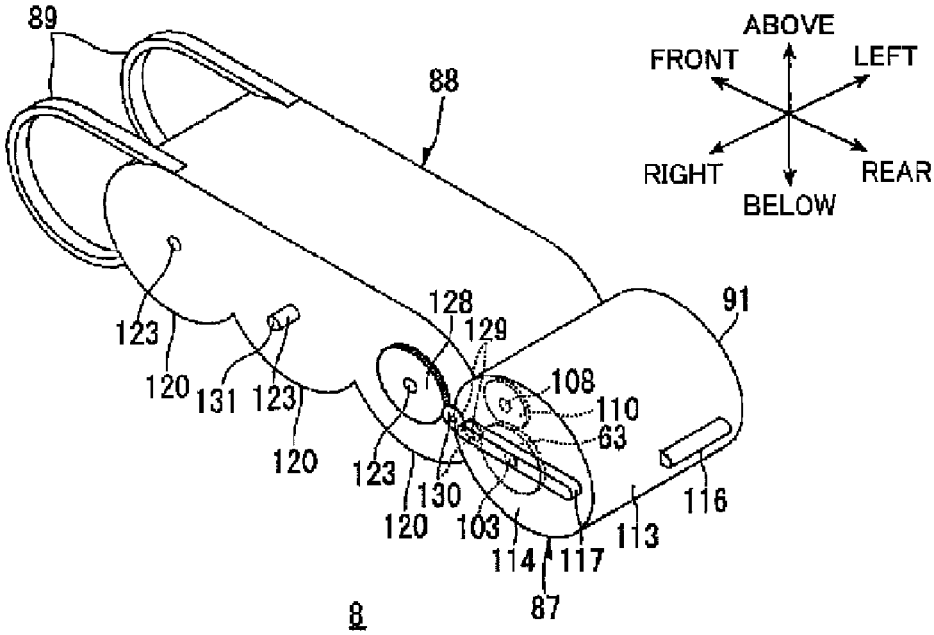
FIG. 11A is a perspective view of the toner cartridge from a position diagonally above and rightward of the rear side thereof when an outer cylinder part is in a closed position.
Figure 11B:
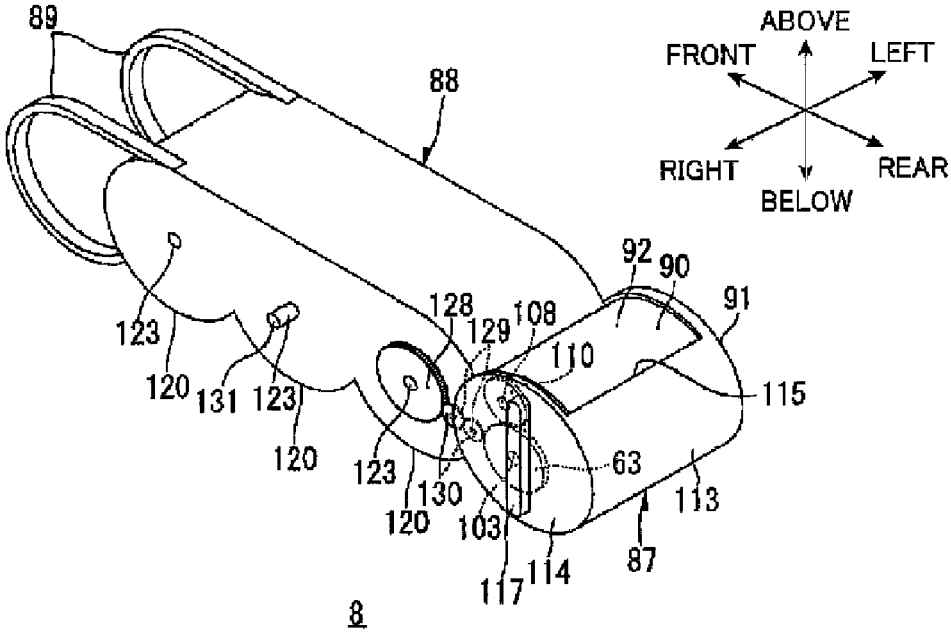
FIG. 11B is a perspective view of the toner cartridge from a position diagonally above and rightward of the rear side thereof when the outer cylinder part is in an open position.

As shown in FIGS. 11A and 11B, the toner cartridge 8 is formed elongated in the front-to-rear direction, and more specifically has maximum dimensions in each of the front-to-rear, left-to-right, and vertical directions that are slightly smaller than the maximum dimensions in each of the front-to-rear, left-to-right, and vertical directions of the cartridge accommodating space 27 (see FIG. 5). The toner cartridge 8 includes a developer passage section 87, a developer accommodating section 88, and handles 89.

The developer passage section 87 has a substantially cylindrical shape that follows the curved wall 26 of the cartridge accommodating space 27 (see FIG. 7). The developer passage section 87 accommodates a positive-charging, nonmagnetic, single-component polymer toner. The developer passage section 87 includes an inner cylinder part 90, and an outer cylinder part 91.

Figure 15:
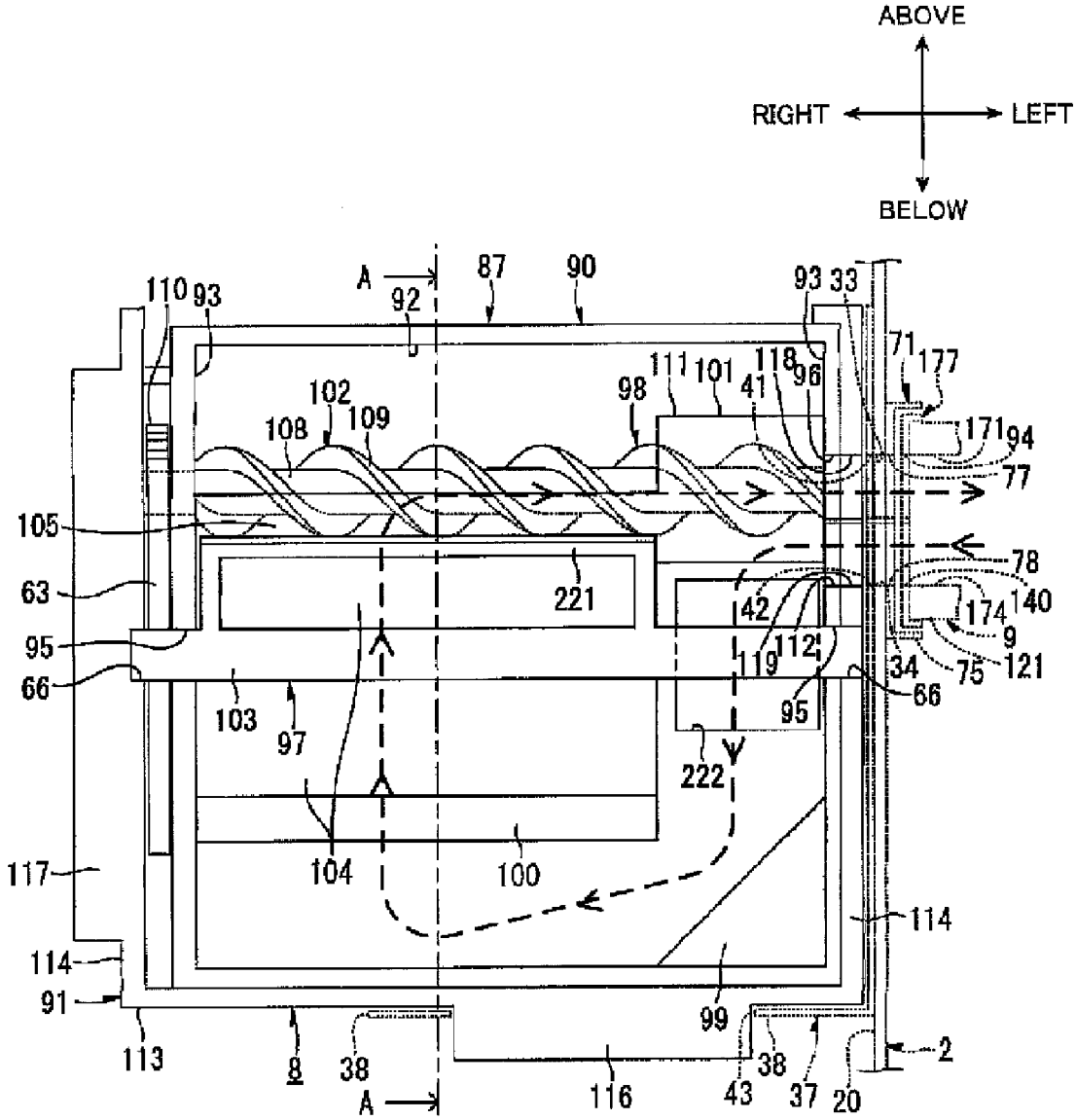
FIG. 15 is a cross-sectional view along the line A-A in FIG. 14B.
Figure 16:
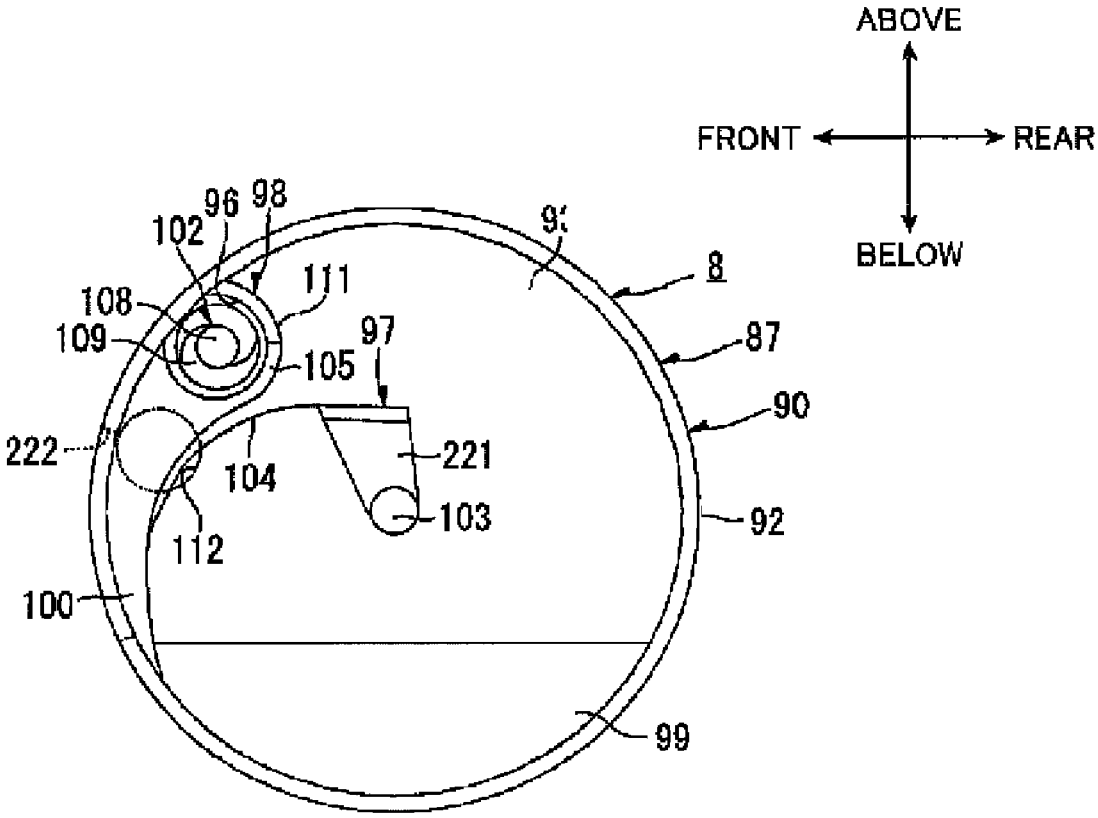
FIG. 16 is a cross-sectional view along the line A-A in FIG. 15, showing only an inner cylinder part.

The inner cylinder part 90 is formed in a substantially cylindrical shape with a hollowed center and is smaller than the outer dimension of the developer passage section 87. As shown in FIGS. 15 and 16, the inner cylinder part 90 is integrally provided with an inner cylindrical wall 92, and inner side walls 93.

The inner cylindrical wall 92 forms the circumferential surface of the inner cylinder part 90. A passage section through-hole 222 penetrates the inner cylindrical wall 92 in the thickness direction, and is formed in the front of the inner cylinder part 90 on the left side of an interference preventing wall 100 described later.

The inner side walls 93 are formed in a circular shape when viewed from the side. Two of the inner side walls 93 are provided for closing both axial (widthwise) ends of the inner cylindrical wall 92, forming the side surfaces of the inner cylinder part 90 in the width direction. Shaft holes 95 are formed in the circular centers of the inner side walls 93, penetrating the inner side walls 93 in the width direction. As shown in FIG. 12, a cartridge supply opening 96 and the second supply side opening are formed in the left inner side wall 93 at about the one o'clock position (about 30° apart in a circles) based on the circular center of the inner side wall 93 viewed from the left side. A cartridge return opening 112 and the second return side opening are also formed in the left inner side wall 93 at a position separated from the cartridge supply opening 96 and diagonally forward and downward therefrom (approximately the two o'clock position). The cartridge supply opening 96 and cartridge return opening 112 both penetrate the inner side wall 93 in the width direction and are formed as circular holes of substantially the same size as the first casing shutter supply opening 41 and first casing shutter return opening 42 (see FIG. 5).

As shown in FIG. 15, the inner cylinder part 90 is provided therein with a passage section agitator 97, a toner conveying mechanism 98, a guide wall 99, and the interference preventing wall 100 (see FIG. 16).

The passage section agitator 97 includes a passage section rotational shaft 103, and a passage section agitating blade 104.

The passage section rotational shaft 103 extends in the width direction and is rotatably supported in the inner side walls 93 by inserting both widthwise ends of the passage section rotational shaft 103 into the shaft holes 95 of the left and right inner side walls 93. The right end of the passage section rotational shaft 103 protrudes from the right side of the right inner side wall 93. A passage section agitator gear 63 is disposed on this protruding part.

An agitating blade support part 221 is integrally provided on the portion of the passage section rotational shaft 103 positioned inside the inner cylinder part 90. The agitating blade support part 221 is formed in a frame-like shape that is substantially rectangular in a rear view and protrudes radially outward from the passage section rotational shaft 103. The widthwise dimension of the agitating blade support part 221 is approximately two-thirds the widthwise dimension of the space inside the inner cylinder part 90. The agitating blade support part 221 is disposed on the passage section rotational shaft 103 in a position shifted toward the right side.

As shown in FIG. 16, the passage section agitating blade 104 is mounted on the agitating blade support part 221. The passage section agitating blade 104 is configured of a flexible film or the like that extends from the agitating blade support part 221 toward the inner cylindrical wall 92 while curving in a counterclockwise direction from a right side view. As shown in FIG. 15, the widthwise dimension of the passage section agitating blade 104 is substantially equivalent to the widthwise dimension of the agitating blade support part 221.

The toner conveying mechanism 98 includes an auger accommodating section 101, and a cartridge auger 102.

The auger accommodating section 101 is integrally provided with a tunnel section 111, and a receiving section 105. The tunnel section 111 has a cylindrical shape extending in the width direction with openings formed in both widthwise ends. The widthwise dimension of the tunnel section 111 is approximately one-third the widthwise dimension of the space inside the inner cylinder part 90. The tunnel section 111 is connected to the left inner side wall 93 so that the left opening in the tunnel section 111 surrounds the cartridge supply opening 96 in a side view (see FIG. 16). The receiving section 105 is provided for linking the right end of the tunnel section 111 to the right inner side wall 93 and is formed as a groove that opens upward in a side cross-sectional view (see FIG. 16). The receiving section 105 opposes the passage section agitating blade 104 in a radial direction of the inner cylindrical wall 92. Further, the groove portion formed in the top surface of the receiving section 105 and the cartridge supply opening 96 are in communication with each other through the inside of the tunnel section 111.

The cartridge auger 102 is elongated in the width direction and is integrally provided with a cartridge rotational shaft 108, and a cartridge conveying part 109.

The cartridge rotational shaft 108 extends in the width direction and is rotatably supported in the right inner side wall 93 at a position overlapping the cartridge supply opening 96 along the axial direction of the cartridge rotational shaft 108 (along width direction). The extended direction of the cartridge rotational shaft 108 is aligned with the direction in which the cartridge auger 102 conveys toner (described later). In a side cross-sectional view, the cartridge rotational shaft 108 and the passage section rotational shaft 103 of the passage section agitator 97 are disposed at different positions along a radial direction of the developer passage section 87 (see FIG. 16). The cartridge rotational shaft 108 and passage section rotational shaft 103 are arranged so as to extend parallel to each other.

The right end of the cartridge rotational shaft 108 protrudes from the right side of the right inner side wall 93, and a cartridge auger gear 110 is provided on the protruding part. The cartridge auger gear 110 is engaged with the passage section agitator gear 63 from a position diagonally above and forward thereof (see FIG. 11), thereby coupling the cartridge rotational shaft 108 with the passage section rotational shaft 103.

As shown in FIGS. 15 and 16, the cartridge conveying part 109 is formed about the peripheral surface of the cartridge rotational shaft 108 in a spiral shape extending along the width direction.

The cartridge auger 102 penetrates the inside of the tunnel section 111 and is accommodated in the auger accommodating section 101 at a position slightly above the top surface of the receiving section 105.

The guide wall 99 is formed in a substantially right triangular shape in a front view, linking the right side surface of the left inner side wall 93 with the bottom inner surface of the inner cylindrical wall 92, and in a substantially semicircular shape in a side view, protruding downward (see FIG. 16). More specifically, the upper edge of the guide wall 99 is positioned between the bottom edge on the right side surface of the left inner side wall 93 and the shaft hole 95, while the right edge is positioned on the bottom edge of the inside surface of the inner cylindrical wall 92 near the bottom left edge of the passage section agitating blade 104.

As shown in FIG. 16, the interference preventing wall 100 is formed substantially in an arc shape in a side cross-sectional view, conforming to the inner surface of the inner cylindrical wall 92, and substantially in a rectangular shape in a rear view (see FIG. 15). More specifically, the inside surface of the interference preventing wall 100 in the radial direction thereof is formed continuously with the rear edge of the receiving section 105 so that the thickness of the interference preventing wall 100 grows gradually larger toward the top in a side cross-sectional view with reference to the peripheral direction of the inner cylindrical wall 92. Further, the widthwise dimension of the interference preventing wall 100 is substantially equivalent to the widthwise dimension of the receiving section 105, and the interference preventing wall 100 and receiving section 105 are disposed substantially in the same position in the width direction (see FIG. 15).

As shown in FIG. 11, the outer cylinder part 91 forms the outer shape of the developer passage section 87, having a substantially cylindrical hollow shape conforming to the inner cylinder part 90. The outer cylinder part 91 is integrally provided with an outer cylinder wall 113, and outer side walls 114.

The outer cylinder wall 113 forms the peripheral surface of the outer cylinder part 91. In the state of the outer cylinder wall 113 shown in FIG. 11B, a cutout 115 that is substantially rectangular in a front view is formed in substantially the front half top portion of the outer cylinder wall 113. In the state of the outer cylinder wall 113 shown in FIG. 11A, a cartridge protrusion 116 protruding rearward is disposed on the rear side of the outer cylinder wall 113 at a slightly leftward position. The cartridge protrusion 116 has a rectangular shape elongated in the width direction in a rear view.

As shown in FIG. 11, the outer side walls 114 have a circular shape in a side view. Two of the outer side walls 114 are provided to close both axial (widthwise) ends of the outer cylinder wall 113, thereby forming the side surfaces of the outer cylinder part 91 in the width direction. A cartridge protrusion 117 protrudes rightward from the right side surface of the right outer side wall 114 and passes through the circular center thereof. In a right side view, the cartridge protrusion 117 is shaped like an elongated rectangle extending in a diametrical direction of the right outer side wall 114. As shown in FIG. 11A, the rear end of the cartridge protrusion 117 is in close proximity to the cartridge protrusion 116.

Figure 12A:
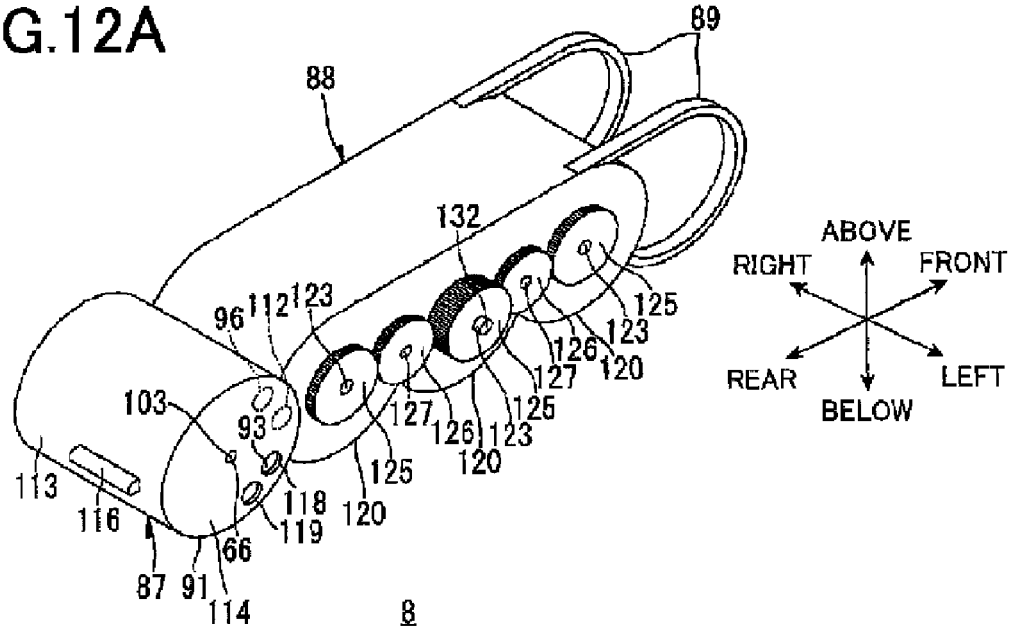
FIG. 12A is a perspective view of the toner cartridge from a position diagonally above and leftward of the rear side thereof when the outer cylinder part is in the closed position.
Figure 12B:
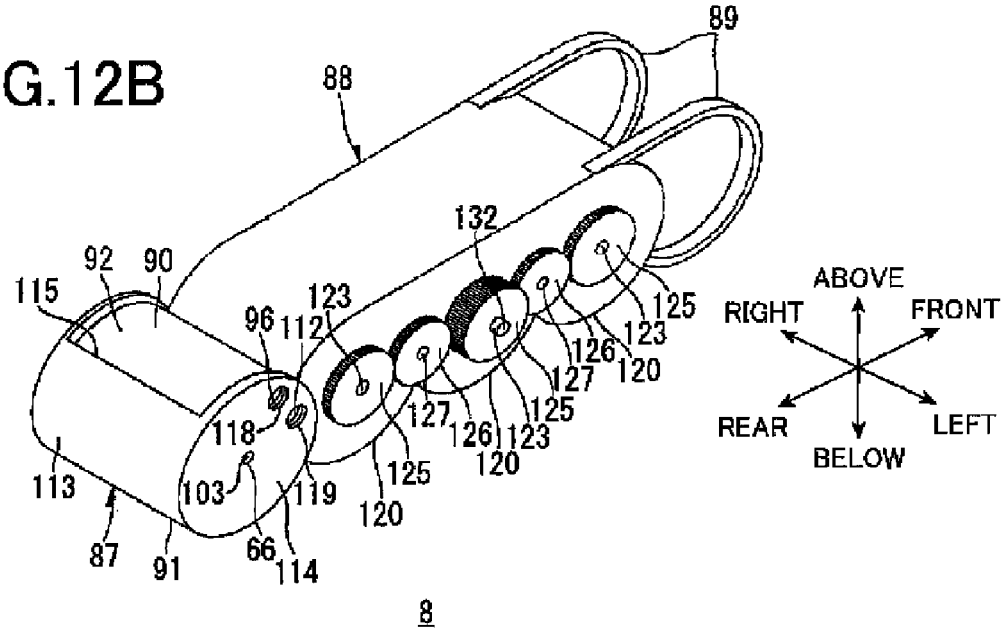
FIG. 12B is a perspective view of the toner cartridge from a position diagonally above and leftward of the rear side thereof when the outer cylinder part is in the open position.
Figure 13:
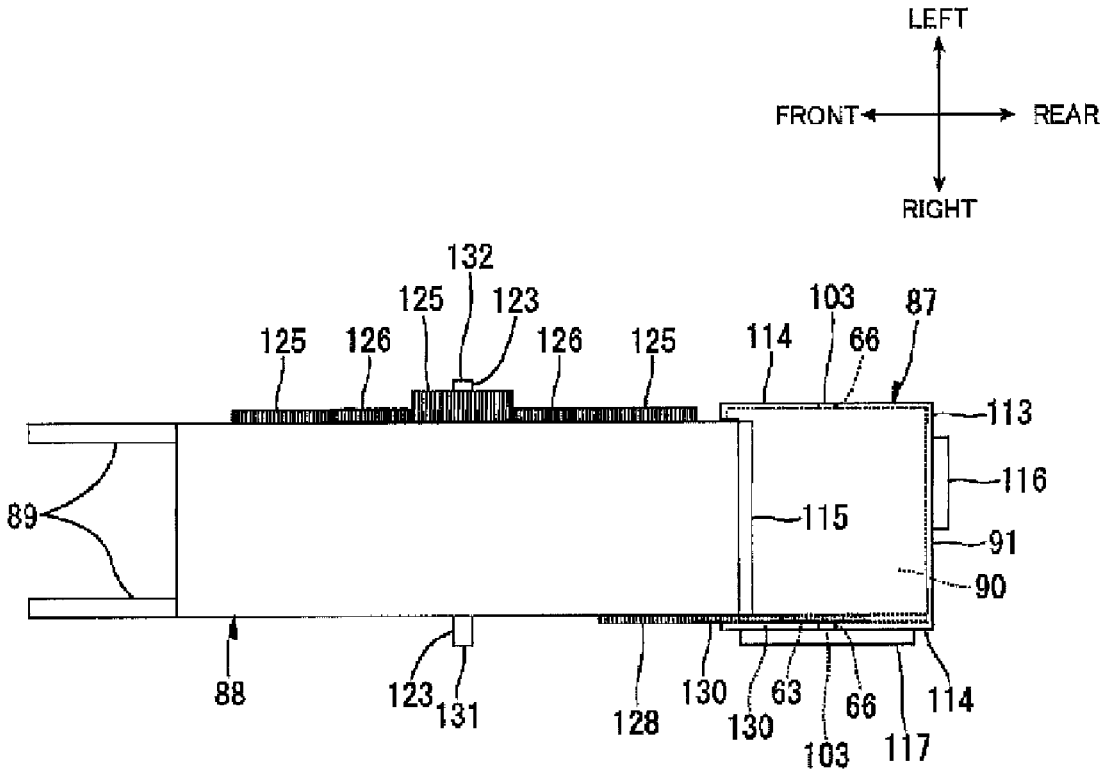
FIG. 13 is a plan view of the toner cartridge when the outer cylinder part is in the closed position.

As shown in FIGS. 12A and 12B, a cartridge shutter supply opening 118 and a cartridge shutter return opening 119 are formed in the left outer side wall 114 at positions along the periphery thereof. The cartridge shutter return opening 119 is spaced apart from the cartridge shutter supply opening 118 in the clockwise direction when viewed from the left side. The cartridge shutter supply opening 118 and cartridge shutter return opening 119 both penetrate the outer side wall 114 in the width direction and are formed as circular holes having substantially the same size as the cartridge supply opening 96 and cartridge return opening 112. A shaft hole 66 is also formed in the circular center of each outer side wall 114. As shown in FIG. 13, both widthwise ends of the passage section rotational shaft 103 described above are rotatably fitted into the shaft holes 66.

As shown in FIG. 12, the outer cylinder part 91 accommodates the inner cylinder part 90. The outer cylinder part 91 is rotatably supported on the inner cylinder part 90 via the passage section rotational shaft 103, whereby the inner peripheral surface of the outer cylinder wall 113 slides over the outer peripheral surface of the inner cylindrical wall 92 in the inner cylinder part 90. More specifically, the outer cylinder part 91 can freely rotate between the closed position (see FIG. 12A) and the open position (see FIG. 12B).

When the outer cylinder part 91 is in the closed position shown in FIG. 12A, the cartridge supply opening 96 and cartridge return opening 112 are closed on the left side by parts of the outer side wall 114 excluding the cartridge shutter supply opening 118 and cartridge shutter return opening 119. Further, the cartridge protrusion 116 is positioned on the rear of the developer passage section 87 (see FIG. 14A), and the cartridge protrusion 117 is aligned with the front-to-rear direction, as shown in FIG. 11A.

On the other hand, the outer cylinder part 91 is in the open position when rotated about 90° clockwise in a right side view from the closed position. When the outer cylinder part 91 is in the open position shown in FIG. 12B, the cartridge supply opening 96 and the cartridge shutter supply opening 118 are aligned in the width direction and in communication with each other. Similarly, the cartridge return opening 112 and cartridge shutter return opening 119 are aligned in the width direction and in communication with each other. Further, the cartridge protrusion 116 is positioned on the bottom of the developer passage section 87 (see FIG. 14B), and the cartridge protrusion 117 is aligned vertically, as shown in FIG. 11B.

When the outer cylinder part 91 is rotated between the closed position and the open position, the passage section through-hole 222 of the inner cylinder part 90 described above (see FIG. 16) is always positioned within the rotating range of the cutout 115 formed in the outer cylinder part 91.

The developer accommodating section 88 abuts the front side of the developer passage section 87. The developer accommodating section 88 is formed of three substantially hollow cylinders joined together in the front-to-rear direction, the top surface of which is formed flat and follows the horizontal. The three cylinders are referred to as sub-cylinders 120. The interior of the sub-cylinders 120 are in communication with each other. As with the developer passage section 87, the developer accommodating section 88 also accommodates a positive-charging, nonmagnetic, single-component polymer toner.

As shown in FIG. 14, an accommodating section agitating mechanism 122 is provided in each of the sub-cylinders 120. Each accommodating section agitating mechanism 122 includes an accommodating section rotational shaft 123, and an accommodating section agitator 124.

The accommodating section rotational shaft 123 is rotatably supported in both widthwise walls of the sub-cylinder 120, with the left end protruding outward from the left wall of the sub-cylinder 120. Specifically, the accommodating section rotational shaft 123 in the centrally positioned sub-cylinder 120 protrudes farthest leftward in order to be exposed from an accommodating section agitator gear 125 described later (see FIG. 13).

Further, as shown in FIGS. 11A and 11B, the right end of the accommodating section rotational shafts 123 in the rearmost and center sub-cylinders 120 protrude from the right side wall of the corresponding sub-cylinders 120. More specifically, the accommodating section rotational shaft 123 in the center sub-cylinder 120 protrudes farther rightward than the accommodating section rotational shaft 123 in the rearmost sub-cylinder 120.

As shown in FIGS. 12A and 12B, the accommodating section agitator gears 125 are mounted on parts of the left ends of the accommodating section rotational shafts 123 protruding from the left side walls of the sub-cylinders 120 so as to be incapable of rotating relative to the accommodating section rotational shafts 123. The accommodating section agitator gear 125 mounted on the center sub-cylinder 120 is formed thicker than the other accommodating section agitator gears 125. Further, an intermediate gear 126 is provided between adjacent accommodating section agitator gears 125. Each intermediate gear 126 is rotatably supported on a support shaft 127 provided on the left wall of the sub-cylinder 120 and engages with the accommodating section agitator gears 125 on both front and rear sides thereof.

Further, as shown in FIGS. 11A and 11B, an agitator transmission gear 128 is mounted on the right end portion of the accommodating section rotational shaft 123 protruding from the right side wall of the rearmost sub-cylinder 120 so as to be incapable of rotating relative to the accommodating section rotational shaft 123.

Figure 14A:
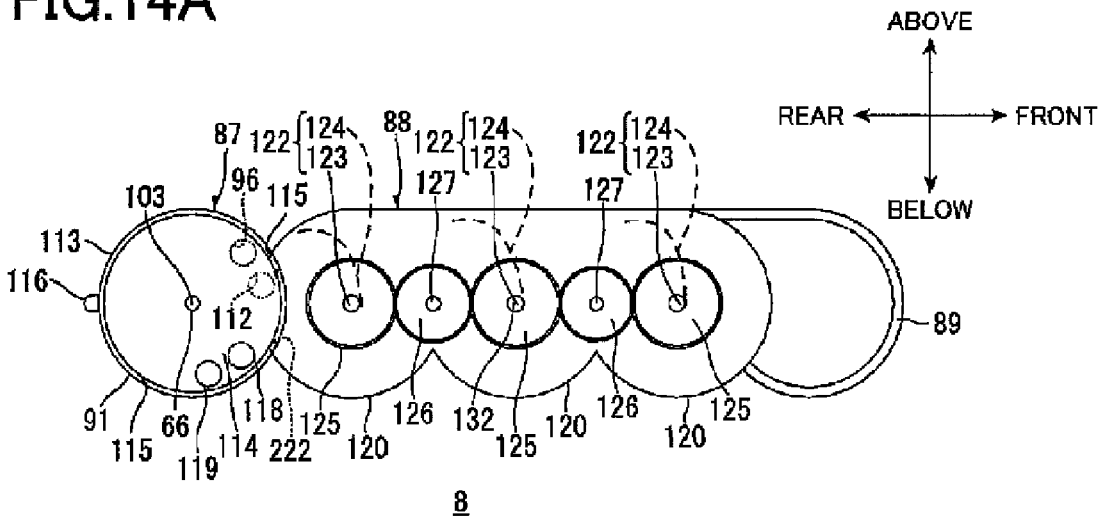
FIG. 14A is a left side view of the toner cartridge when the outer cylinder part is in the closed position.
Figure 14B:
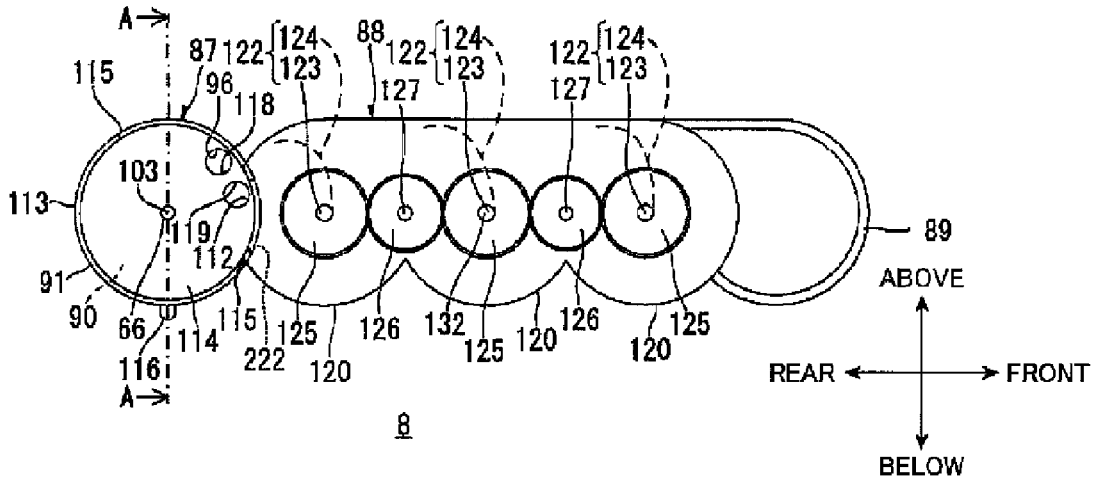
FIG. 14B is a left side view of the toner cartridge when the outer cylinder part is in the open position.

As shown in FIGS. 14A and 14B, the accommodating section agitator 124 is provided on each accommodating section rotational shaft 123. The accommodating section agitator 124 is formed of a flexible film or the like substantially rectangular in shape and elongated in a radial direction from the accommodating section rotational shaft 123 and curved in a counterclockwise direction when viewed from the left side.

The developer accommodating section 88 is also connected to the inner cylinder part 90 in the developer passage section 87. More specifically, the interior of the developer accommodating section 88 is in communication with the interior of the inner cylinder part 90 via the passage section through-hole 222.

As shown in FIGS. 11A and 11B, two support shafts 129 spaced at a prescribed interval in the front-to-rear direction and protruding rightward. The two support shafts 129 are provided on the connecting parts of the developer accommodating section 88 and inner cylinder part 90, and more specifically connecting parts of the right wall on the rearmost sub-cylinder 120 and the right inner side wall 93 of the inner cylinder part 90.

An intermediate gear 130 is rotatably mounted on each support shaft 129. The intermediate gears 130 mounted on the support shafts 129 are engaged with each other, the front intermediate gear 130 is engaged with the rear side of the agitator transmission gear 128, and the rear intermediate gear 130 is engaged with the front side of the passage section agitator gear 63.

The handles 89 are formed with a narrow width and are ring-shaped in a side view. The handles 89 are formed on the front portion of the sub-cylinder 120 on both widthwise ends thereof, for gripping the handles 89 and pulling the toner cartridge 8 out of the main casing 2 (see FIG. 1). More specifically, each handle 89 extends horizontally forward from the top of the sub-cylinder 120 and gradually circles downward, connecting to a part of the sub-cylinder 120 between the top and bottom edges.

When the toner cartridge 8 is mounted in the main casing 2, the operator first rotates the cover 17 on the main casing 2 to the open position described above, revealing the cartridge mounting opening 16, as shown in FIG. 3. Next, the operator grips the handles 89 on the toner cartridge 8 while the outer cylinder part 91 is in the closed position shown in FIG. 11A. While maintaining the toner cartridge 8 in a horizontal orientation, the operator inserts the cartridge protrusions 117 and the right end of the accommodating section rotational shaft 123 (referred to as a right guide part 131) in the center sub-cylinder 120 into the right guide groove 30 of the right wall 21 (see FIG. 3).

Next, the operator inserts the accommodating section agitator gear 125 of the center sub-cylinder 120 shown in FIG. 12A into the gear accommodating groove 24 (see FIG. 5), and subsequently inserts the left end of the accommodating section rotational shaft 123 on the center sub-cylinder 120 (referred to as a left guide part 132) into the left guide groove 28 of the left wall 20 (see FIG. 5).

Next, the operator pushes the toner cartridge 8 rearward into the cartridge accommodating space 27 (see FIG. 5). At this time, the cartridge protrusion 117 and right guide part 131 (see FIG. 11A) are guided along the right guide groove 30 (see FIG. 9B), while the right guide part 132 (see FIG. 12A) is guided along the left guide groove 28 (see FIG. 7B). Accordingly, the toner cartridge 8 passes through the cartridge mounting opening 16 and moves rearward into the cartridge accommodating space 27 in a horizontal direction.

As shown in FIG. 9B, by pushing the toner cartridge 8 rearward, the cartridge protrusions 117 (see FIG. 11A) pass through and out of the right guide groove 30 and are received in the rotational plate guide grooves 49 formed in the rotational plates 48, which are in the closed position.

After pushing the toner cartridge 8 farther rearward, the right guide part 132 (see FIG. 11A) passes over the positioning protrusion 29 and contacts the rear end of the left guide groove 28 as shown in FIG. 7B. At the same time, the cartridge protrusion 116 (see FIG. 11A) is fitted into the fitting hole 43 of the first casing side shutter 37, which is in the open position. At this time, as shown in FIG. 9B, the cartridge protrusions 117 (see FIG. 11A) are received in the rotational plate guide grooves 49 without protruding out of the rotational plate guide grooves 49. In other words, when the cartridge protrusions 117 are received in the rotational plate guide grooves 49, the outer cylinder part 91 of the toner cartridge 8 (see FIG. 11A) and the cover 17 are linked by the transmission member 25.

Further, as shown in FIG. 12A, the part of the accommodating section agitator gear 125 on the center sub-cylinder 120 that protrudes farther leftward than the other accommodating section agitator gears 125 is engaged with the drive input gear 36 (see FIGS. 5 and 7), at which time the toner cartridge 8 is completely accommodated in the cartridge accommodating space 27. At this time, the toner cartridge 8 opposes a developing roller 154 (see FIG. 1) in the developer passage section 87 described later. More specifically, the left outer side wall 114 on the outer cylinder part 91 opposes the developing roller 154 in the width direction. While not shown in the drawings, the cartridge supply opening 96 in the toner cartridge 8 is aligned in the width direction with the casing side supply hole 33 of the main casing 2, with the left outer side wall 114 of the outer cylinder part 91 and the first casing side shutter 37 interposed therebetween (see FIGS. 7B and 14A). At the same time, the cartridge return opening 112 is aligned with the casing side return hole 34 (see FIG. 7B) in the width direction.

Once the toner cartridge 8 is completely accommodated in the cartridge accommodating space 27, the cover 17 is rotated from the open position (shown in FIG. 9B) to the closed position (shown in FIG. 9A). Consequently, the rotational plate 48 is rotated from the closed position in FIG. 7B to the open position shown in FIG. 7A, as described above. With the cartridge protrusions 117 engaged with the rotational plate guide grooves 49 of the rotational plates 48 (see FIG. 9B), the outer cylinder part 91 rotates to the open position (see FIG. 11B) in association with the rotation of the rotational plates 48 to the open position (see FIG. 11A), through the transmission of a drive force generated by rotating the cover 17.

Next, as shown in FIG. 7B, while the cartridge protrusion 116 of the outer cylinder part 91 (see FIG. 12A) is fitted into the fitting hole 43, the first casing side shutter 37 rotates to the open position shown in FIG. 7A in association with the rotation of the outer cylinder part 91 to the open position (see FIG. 14B).

In this state, as shown in FIG. 15, the casing side supply hole 33 of the main casing 2 is in communication with the cartridge supply opening 96 via the first casing shutter supply opening 41 and the cartridge shutter supply opening 118 of the toner cartridge 8. Further, the casing side return hole 34 of the main casing 2 is in communication with the cartridge return opening 112 via the first casing shutter return opening 42 and the cartridge shutter return opening 119 of the toner cartridge 8.

Once the cover 17 covers the cartridge mounting opening 16 in the closed position shown in FIG. 9A, mounting of the toner cartridge 8 in the main casing 2 is complete. At this time, the handles 89 (see FIG. 11B) on the toner cartridge 8 oppose and abut the closed cover 17 in the front-to-rear direction.

When the toner cartridge is removed from the main casing 2, the operator first rotates the cover 17 from the closed position to the open position to reveal the cartridge mounting opening 16 (see FIG. 9B), exposing the handle 89 (see FIG. 11A) in the cartridge mounting opening 16. Consequently, the rotational plates 48 are also rotated from the open position (see FIG. 7A) to the closed position (see FIG. 7B).

Further, since the cartridge protrusions 117 as shown in FIG. 11A are received in the rotational plate guide grooves 49 of the rotational plates 48 (see FIG. 9B), the outer cylinder part 91 rotates to the closed position (see FIG. 12A)) in association with the rotation of the rotational plates 48 to the closed position (see FIG. 7B) by the transmission of the drive force generated by rotating the cover 17. Further, since the cartridge protrusion 116 of the outer cylinder part 91 (see FIG. 11A) is engaged with the fitting hole 43, the first casing side shutter 37 rotates to the closed position (see FIG. 12A) in association with the rotation of the outer cylinder part 91 to the closed position (see FIG. 7B).

Consequently, the casing side supply hole 33 and casing side return hole 34 in the main casing 2 are closed by the first casing side shutter 37 (see FIG. 7B), and the cartridge supply opening 96 and cartridge return opening 112 in the toner cartridge 8 are closed by the outer cylinder part 91 (see FIG. 12A). Accordingly, the casing side supply hole 33 and cartridge supply opening 96 and the casing side return hole 34 and cartridge return opening 112 are no longer in a communicating state.

Subsequently, as shown in FIG. 12A, the operator grips the handles 89 and pulls the toner cartridge 8 forward, at which time the right guide part 132 slides over the positioning protrusion 29 and is guided along the left guide groove 28 (see FIG. 7B). Further, as shown in the FIG. 11A, the cartridge protrusions 117 and right guide part 131 are guided along the right guide groove 30 (see FIG. 9B). The cartridge protrusions 117 are also guided by the rotational plate guide grooves 49 in FIG. 9B. Consequently, the toner cartridge 8 passes through the cartridge mounting opening 16 and moves forward through the cartridge accommodating space 27 in a horizontal direction.

As shown in FIG. 5, after the right guide part 132 (see FIG. 12A) is extracted from the left guide groove 28, the cartridge protrusions 117 and right guide part 131 (see FIG. 12A) are extracted from the right guide groove 30, and the center accommodating section agitator gear 125 (see FIG. 12A) is extracted from the gear accommodating groove 24, the toner cartridge 8 is removed from the cartridge accommodating space 27.

In this way, removal of the toner cartridge 8 from the main casing 2 is complete.

In the above description related to mounting the toner cartridge 8 in and removing the toner cartridge 8 from the main casing 2, the first casing side shutter 37 opens and closes in association with the rotation (opening and closing operations) of the cover 17.

In the following description, the toner cartridge 8 is mounted in the main casing 2. Hence, as shown in FIG. 15, the casing side supply hole 33 of the main casing 2 is in communication with the cartridge supply opening 96 of the toner cartridge 8, and the casing side return hole 34 of the main casing 2 is communication with the cartridge return opening 112 of the toner cartridge 8.

The process unit 9 is elongated in the widthwise direction and disposed in the process unit accommodating space 69, as described above. Further, as shown in FIG. 1, the process unit 9 is disposed so that the front part overlaps the top of the scanning section 80, and the rear part overlaps the top of the paper tray 51. As described above, since the process unit 9 is detachably mounted in the main casing 2, the process unit 9 is integrally provided with a drum section 133 and a developing section 134.

Figure 17:
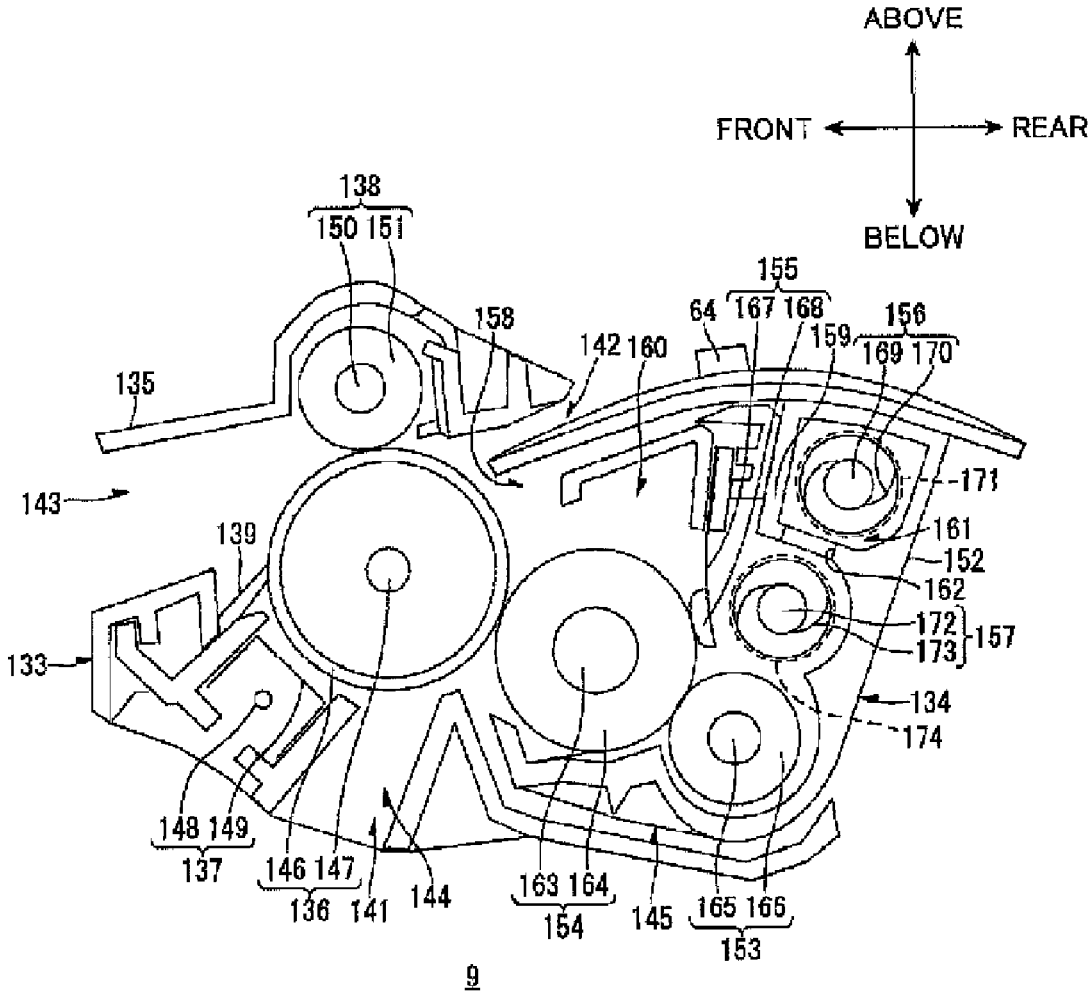
FIG. 17 shows the process unit in FIG. 1 when removed from the laser printer.

As shown in FIG. 17, the drum section 133 includes a drum casing 135 and, within the drum casing 135, the photosensitive drum 136, a Scorotron charger 137, the transfer roller 138 and a cleaning blush 139.

The drum casing 135 extends in the width direction and is formed substantially in a box shape that opens on the front side and rear side.

A laser passage 141 for irradiating on the surface of the photosensitive drum 136 with the laser beam is formed in intermediary of the front-to-rear direction. A first passage 142 is formed between the rear edge on the top wall of the drum casing 135 and the front edge on the top wall a developer casing 152 in the developing section 134 described later. A second passage 143 is formed in the front wall of the drum casing 135. The first passage 142 and second passage 143 are both formed in a rectangular shape elongated in the width direction.

As shown in FIG. 18, a drum shaft hole 175 is formed in both widthwise side walls of the drum casing 135 in substantially the vertical and front-to-rear center thereof. A developing roller shaft receiving hole 176 having an elliptical shape in a side view is formed to the rear of each drum shaft hole 175.

As shown in FIG. 17, a drum accommodating section 144 is the portion of the drum casing 135 defined by the front half portions of each of the left wall, right wall, and bottom wall; the front wall; and the top wall. The drum accommodating section 144 accommodates the photosensitive drum 136, charger 137, transfer roller 138, and cleaning brush 139.

Further, a developer positioning section 145 is the portion of the drum casing 135 defined by the rear half portions of each of the left wall, right wall, and bottom wall of the drum accommodating section 144 that is disposed in the developer positioning section 145. The developer positioning section 145 has a frame structure with a bottom and sides in a front view and is open on the top.

The drum accommodating section 144 and developer positioning section 145 are in communication with each other.

The photosensitive drum 136 includes a main drum body 146 that is cylindrical in shape, and a drum shaft 147. The main drum body 146 has a positive charging photosensitive layer formed of polycarbonate or the like on its outer surface. The drum shaft 147 is formed of metal and extends through the axial center of the main drum body 146 along the axial direction thereof.

The drum shaft 147 is supported on the main drum body 135 by throwing the end of the drum shaft 147 in shaft holes 175 (see FIG. 18) that is formed on the drum side frames of the main drum body 135, and the main drum body 135 is rotatably supported relative to the drum shaft 147. With this construction, the photosensitive drum 136 is disposed in the main drum body 135 and is capable of rotating about the drum shaft 147. The photosensitive drum 136 is driven to rotate by a driving force inputted from a motor (not shown). Further, the right end of drum shaft 147 is exposed as to protrude rightward from right side frame of the main drum casing 135 as shown in FIG. 18. The photosensitive drum 136 is driven to rotate by a driving force inputted from a motor (not shown).

As shown in FIG. 17, the charger 137 is supported on the rear frame of the main drum casing 135 diagonally below and rearward of the photosensitive drum 136. The charger 137 opposes the photosensitive drum 136 but is separated a prescribed distance from the photosensitive drum 136 so as not to contact the same. The charger 137 includes a discharge wire 148 and a grid 149. The discharge wire 148 disposed in opposition to but separated a prescribed distance from the photosensitive drum 136. The grid 149 provided between the discharge wire 148 and the photosensitive drum 136 for controlling the amount of corona discharge from the discharge wire 148 that reaches the photosensitive drum 136.

By applying a high voltage to the discharge wire 148 for generating a corona discharge from the discharge wire 148 at the same time a bias voltage is applied to the grid 149, the charger 137 can charge the surface of the photosensitive drum 136 with a uniform positive polarity.

The transfer roller 138 is disposed in the main drum casing 135 above the photosensitive drum 136 and contacts the photosensitive drum 136 in a vertical direction from the top thereof so as to form a nip part with the photosensitive drum 136. The nip part is the transfer position between the photosensitive drum 136 and the transfer roller 138.

The transfer roller 138 is configured of a roller shaft 150 and a roller 151. The roller shaft 138 is formed of a metal and is rotatably supported in the side flames of the main drum casing 135. The roller 151 is formed of an electrically conductive rubber material for covering the roller shaft 150. The transfer roller 138 is driven to rotate by a driving force inputted from a motor (not shown). Further, a transfer bias is applied to the transfer roller 138 during a transfer operation.

The cleaning blush 139 is mounted on the front frame of the main drum casing 135 in a position confronting and contacting the photosensitive drum 136 from the front side thereof.

The transfer roller 138 is disposed in the main drum casing 135 above the photosensitive drum 136 and contacts the photosensitive drum 136 in a vertical direction from the top thereof so as to form a nip part with the photosensitive drum 136.

A developing section 134 is integrally disposed on the developer accommodating section 145 of the main drum casing 135. The developing section 134 is integrally mounted on the drum section 133.

Figure 18A:
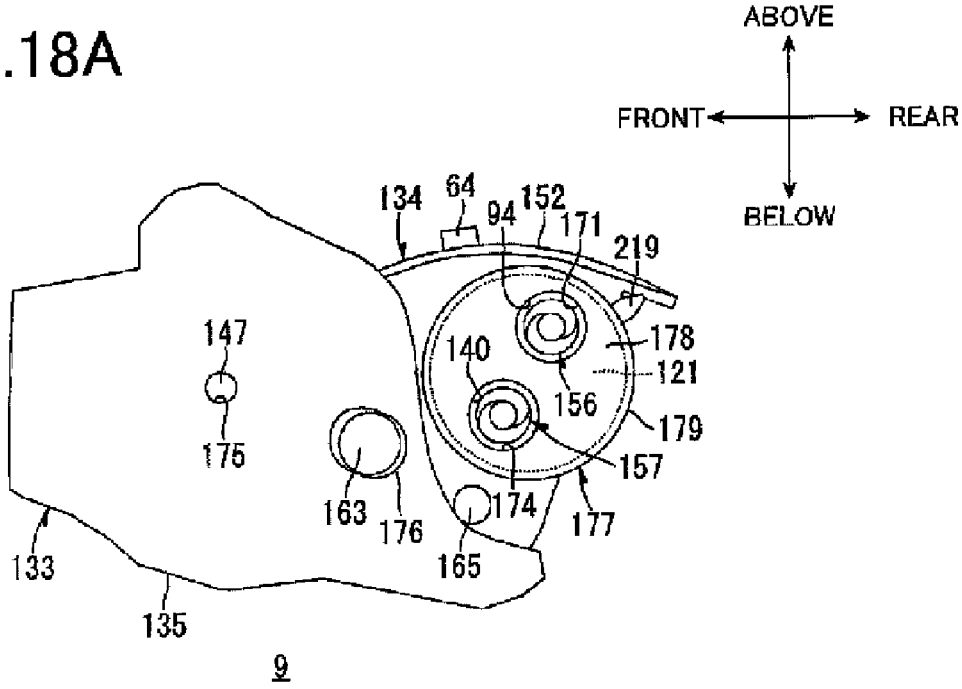
FIG. 18A is a right side view of the process unit when a developer shutter is in the open position.
Figure 18B:
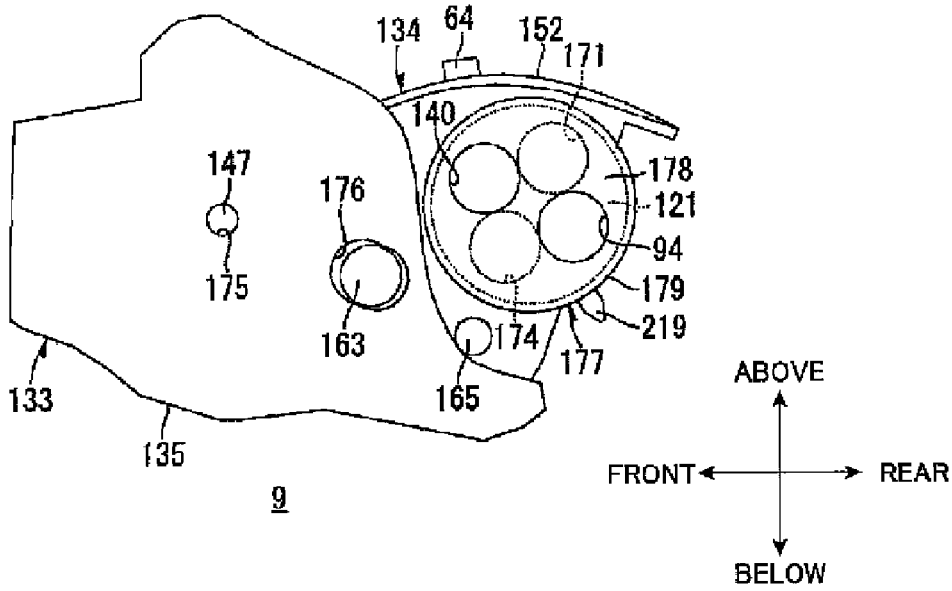
FIG. 18B is a right side view of the process unit when the developer shutter is in the closed position.

As shown in FIGS. 18A and 18B, the developing section 134 is provided with the developer casing 152, and a developer shutter 177. Within the developer casing 152 are additionally provided a supply roller 153, the developing roller 154, a thickness-regulating blade 155, a supply auger 156, and a return auger 157.

As shown in FIG. 17, the developer casing 152 is substantially rectangular in a side view and has a box shape elongated in the width direction. A developer through-hole 158 is formed in the front wall of the developer casing 152 and has a rectangular shape in a front view elongated in the width direction. The top wall of the developer casing 152 has an arc shape in a side view, forming a convex curve facing upward. Spacers 64 protruding upward are provided on both widthwise ends of the ceiling in the developer casing 152.

The rear edge and top edge on the right wall of the developer casing 152 are formed as a step protruding farther rightward than the other portions of the right wall, as shown in FIG. 18. This protruding part is referred to as a protruding part 121; the protruding part 121 is formed substantially in a circular shape in a side view.

As shown in FIG. 17, a developer partition 159 is formed substantially L-shaped in a side cross-sectional view and extends in the width direction inside the developer casing 152. The developer partition 159 partitions the inside of the developer casing 152 into a developer chamber 160, and a toner supply chamber 161.

The toner supply chamber 161 is positioned in the upper rear section of the developer casing 152 and has a substantially rectangular shape in a side cross-sectional view. The toner supply chamber 161 confronts the protruding part 121 described above (see FIG. 18) in the width direction. A toner through-hole 162 is formed in the lower left portion of the developer partition 159 and penetrates the developer partition 159 vertically. The supply auger 156 is disposed in the toner supply chamber 161. The developer chamber 160 and toner supply chamber 161 are in communication via the toner through-hole 162. Within the developer chamber 160 are provided the developing roller 154, supply roller 153, thickness-regulating blade 155, and return auger 157.

The developing roller 154 is disposed rearward the photosensitive drum 136 in the main drum casing 135, and contacts the photosensitive drum 136. The developing roller 154 is exposed frontward via the developer through-hole 158. The developing roller 154 is configured of a roller shaft 163 and a roller 164. The roller shaft 163 is formed of a metal and is rotatably supported in the side flames of the developer casing 152. The roller 164 is formed of an electrically conductive rubber material for covering the roller shaft 163. Both widthwise ends of the developing roller rotational shaft 163 protrude outward in the width direction from both widthwise side walls of the developer casing 152 and are exposed therefrom. The ends of the developing roller rotational shaft 163 are fitted into the corresponding developing roller shaft receiving holes 176 in the drum casing 135 (see FIG. 18). The developing roller 154 is driven to rotate by a driving force inputted from a motor (not shown). Further, a transfer bias is applied to the transfer roller 138 during a transfer operation.

The supply roller 153 is configured of a roller shaft 165 and a roller 166. The roller shaft 165 is formed of a metal and is rotatably supported in the side flames of the developer casing 152. The roller 165 is formed of an electrically conductive sponge for covering the roller shaft 165. Both widthwise ends of the developing roller rotational shaft 163 protrude outward in the width direction from both widthwise side walls of the developer casing 152 and are exposed therefrom (see FIGS. 18A and 18B). The supply roller 153 is driven to rotate by a driving force inputted from a motor (not shown).

The thickness-regulating blade 155 includes a main blade member 167 and a pressing part 168. The main blade member 167 is configured of a metal leaf spring member. The pressing part 168 has a semicircular cross section and is formed of an insulating silicon rubber. A base end of the main blade member 167 is supported on the developer casing 152 above the developing roller 154 so that the elastic force of the main blade member 167 causes the pressing part 158 to contact the surface of the developing roller 154 with pressure.

The supply auger 156 is integrally provided with a supply side rotational shaft 169 elongated in the width direction, and a supply side conveying part 170. The supply side rotational shaft 169 is rotatably supported in both widthwise side walls of the developer casing 152. The supply side conveying part 170 is formed on the peripheral surface of the supply side rotational shaft 169 in a spiral shape extending in the width direction. A gear part (not shown) is also provided on the left end of the supply side rotational shaft 169 for transmitting a drive force from a drive motor (not shown) in the main casing 2. Through transmission of this drive force, the supply auger 156 is driven to rotate. A developer supply hole 171 (see FIG. 18) is formed in the protruding part 121 on the right wall of the developer casing 152. The developer supply hole 171 is formed in a region opposing the supply auger 156 and allows external communication with the inside of the toner supply chamber 161.

The return auger 157 is positioned above the supply roller 153 and below the supply auger 156, and is integrally provided with a return side rotational shaft 172 elongated in the width direction, and a return side conveying part 173. The return side rotational shaft 172 is rotatably supported in both widthwise side walls of the developer casing 152. The return side conveying part 173 is formed along the outer peripheral surface of the return side rotational shaft 172 in a spiral shape along the width direction. The return side rotational shaft 172 spirals in the opposite direction than the supply side conveying part 170. A gear part (not shown) is provided on the left end of the return side rotational shaft 172 for transmitting a drive force from the drive motor (not shown) in the main casing 2. The transmitted drive force drives the return auger 157 to rotate. A developer return hole 174 (see FIG. 18) is formed in the protruding part 121 on the right wall of the developer casing. The developer return hole 174 is formed in a region opposing the return auger 157 for providing external communication with the inside of the developer chamber 160.

As shown in FIGS. 18A and 18B, the developer shutter 177 is formed as a cover with a circular shape in a side view that is slightly larger than the side surface of the protruding part 121 provided on the developer casing 152. The developer shutter 177 is integrally provided with a developer shutter disc wall 178, and a developer shutter circumferential wall 179.

The developer shutter disc wall 178 is formed as a thin plate with a circular shape in a side view. A developer shutter supply hole 94 and a developer shutter return hole 140 are formed in the developer shutter disc wall 178 on opposing sides of the circular center. The developer shutter supply hole 94 and developer shutter return hole 140 both penetrate the developer shutter disc wall 178 in the width direction and are formed as circular holes of approximately the same size as the developer supply hole 171 and developer return hole 174.

The developer shutter circumferential wall 179 is formed in a ring shape extending continuously leftward from the peripheral edge of the developer shutter disc wall 178. A developer shutter protrusion 219 is integrally provided at one location on the peripheral surface of the developer shutter circumferential wall 179, and specifically near the developer shutter supply hole 94, protruding radially outward.

The developer shutter 177 fits over the right side of the protruding part 121 and is rotatably supported thereon. More specifically, the developer shutter 177 can freely rotate between the closed position (see FIG. 18B) and the open position (see FIG. 18A).

When the developer shutter 177 is in the closed position shown in FIG. 18B, the developer supply hole 171 and developer return hole 174 are closed from the right side by parts of the developer shutter disc wall 178 excluding the developer shutter supply hole 94 and developer shutter return hole 140. Further, the developer shutter protrusion 219 protrudes in a direction diagonally downward and rearward.

On the other hand, the developer shutter 177 is in the open position (see FIG. 18A) when rotated about 90° counterclockwise in a right side view from the closed position (see FIG. 18B). When the developer shutter 177 is in the open position, the developer shutter supply hole 94 and developer supply hole 171 are aligned in the width direction and in communication with each other. At the same time, the developer shutter return hole 140 and developer return hole 174 are aligned in the width direction and in communication with each other. Further, the developer shutter protrusion 219 protrudes in a diagonal direction upward and toward the rear.

Next, mounting the process unit 9 into and removing the process unit 9 from the main casing 2 will be described.

When mounting the process unit 9 into the main casing 2, first the operator opens the scanning unit 7 by rotating the scanning unit 7 to the open position (see FIG. 4B). Consequently, the process unit mounting opening 11 is exposed, and the second casing shutter 71 is rotated to the closed position (see FIG. 10B). With the developer shutter 177 in the closed position (see FIG. 18B), the process unit 9 is inserted into the process unit accommodating space 69 through the process unit mounting opening 11.

At this time, the process unit 9 slides down into the process unit accommodating space 69 while the right end of the drum shaft 147 (see FIG. 18B) of the photosensitive drum 136 is guided along the shaft receiving groove 107 of the shaft holding member 73. When the right end of the drum shaft 147 slides over the positioning protrusion 65 and contacts the bottom of the shaft receiving groove 107, downward movement of the process unit 9 is halted, completing mounting of the process unit 9 in the main casing 2. At this time, the right end of the drum shaft 147 is held in the shaft holding member 73. The protruding part 121 of the process unit 9 (see FIG. 18B) is received in the second casing shutter 71, which is in the closed position.

In this state, the developer shutter circumferential wall 179 of the developer shutter 177 is gripped in the peripheral wall 75, while the developer shutter protrusion 219 is fitted into the fitting notch 79 of the peripheral wall 75 (see FIG. 18B). Further, the developer supply hole 171 of the process unit 9 is aligned with the casing side supply hole 33 of the main casing 2 in the width direction, with the developer shutter 177 and second casing shutter 71 interposed therebetween. Similarly, the developer return hole 174 is aligned with the casing side return hole 34 in the width direction.

Accordingly, when the toner cartridge 8 is mounted in the main casing 2, the developer supply hole 171 is aligned with the cartridge supply opening 96 of the toner cartridge 8 in the width direction, while the developer return hole 174 is aligned with the cartridge return opening 112 in the width direction (see FIG. 15).

If the scanning unit 7 is pivoted to the closed position from this state (see FIG. 4A), the second casing shutter 71 rotates from the closed position to the open position shown in FIG. 10A, as described above. With the developer shutter protrusion 219 fitted into the fitting notch 79 of the second casing shutter 71 (see FIG. 18B), the developer shutter 177 rotates to the open position (see FIG. 18A) in association with the rotation of the second casing shutter 71 to the open position.

In this state, the casing side supply hole 33 in the main casing 2 is in communication with the developer supply hole 171 via the second casing shutter supply hole 77 and the developer shutter supply hole 94 of the developer shutter 177, as shown in FIG. 15. Further, the casing side return hole 34 of the main casing 2 is in communication with the developer return hole 174 via the second casing shutter return hole 78 and the developer shutter return hole 140 of the developer shutter 177. Here, the casing side supply hole 33 communicates with the cartridge supply opening 96 of the toner cartridge 8, while the casing side return hole 34 communicates with the cartridge return opening 112, as described above. Hence, the developer supply hole 171 and cartridge supply opening 96 are in communication with each other, and the developer return hole 174 and cartridge return opening 112 are in communication with each other.

However, when removing the process unit 9 from the main casing 2, the operator rotates the scanning unit 7 to the open position (see FIG. 4B), thereby exposing the process unit mounting opening 11 and rotating the second casing shutter 71 to the closed position (see FIG. 10B). With the developer shutter protrusion 219 fitted into the fitting notch 79 of the second casing shutter 71 (see FIG. 18A), the developer shutter 177 rotates to the closed position (see FIG. 18B) in association with the rotation of the second casing shutter 71 to the closed position.

Accordingly, the casing side supply hole 33 and casing side return hole 34 in the main casing 2 are closed by the second casing shutter 71 (see FIG. 10B), and the developer shutter supply hole 94 and developer shutter return hole 140 in the process unit 9 are closed by the developer shutter 177 (see FIG. 18B). Consequently, the communicative states described above between the casing side supply hole 33 and developer shutter supply hole 94 and between the casing side return hole 34 and developer shutter return hole 140 are eliminated.

Subsequently, the operator pulls the process unit 9 upward. As shown in FIG. 10B, the process unit 9 rises up through the process unit accommodating space 69 at this time while the right end of the drum shaft 147 in the photosensitive drum 136 (see FIG. 18B) slides over the positioning protrusion 65 of the shaft holding member 73 and is guided along the shaft receiving groove 107. As the process unit 9 is pulled upward, the developer shutter protrusion 219 (see FIG. 18B) separates from the fitting notch 79 of the second casing shutter 71.

When the right end of the drum shaft 147 leaves the shaft receiving groove 107, the process unit 9 is removed from the process unit accommodating space 69, thereby completing removal of the process unit 9 from the main casing 2.

As described above, the opening and closing operations (rotation) of the developer shutter 177 is independent of the opening and closing operations (rotation) of the outer cylinder part 91 in the toner cartridge 8.

Next, a developer transferring operation performed on the image-forming unit 5 will be described. In the following description, the developer supply hole 171 and cartridge supply opening 96 are in communication with each other, and the developer return hole 174 and cartridge return opening 112 are in communication with each other (see FIG. 15).

During image formation, a drive motor (not shown) is driven to rotate the drive input gear 36 (see FIG. 7A) clockwise in a right side view. The drive force is transmitted from the drive input gear 36 to the accommodating section agitator gear 125 of the center sub-cylinder 120 engaged with the drive input gear 36 (see FIG. 14B), driving this accommodating section agitator gear 125 to rotate clockwise in a left side view. As shown in FIG. 14B, this drive force is transmitted to the accommodating section agitator gears 125 of the forwardmost and rearmost sub-cylinders 120 via the intermediate gears 126.

In this way, the accommodating section agitator gear 125 of each sub-cylinder 120 is driven to rotate clockwise in a left side view, and the accommodating section rotational shafts 123 and accommodating section agitators 124 also rotate clockwise in a left side view together with the accommodating section agitator gears 125. Accordingly, the accommodating section agitators 124 in the accommodating section agitating mechanisms 122 stir the toner in the sub-cylinders 120, moving the toner rearward. In other words, with respect to the entire developer accommodating section 88, toner is moved rearward and conveyed into the inner cylinder part 90 of the developer passage section 87 through the passage section through-hole 222 described above (see FIG. 16).

Further, the agitator transmission gear 128 rotates counterclockwise in a right side view along with the rotation of the accommodating section rotational shaft 123 in the rearmost sub-cylinder 120, as shown in FIG. 11B. The drive force for rotating the agitator transmission gear 128 is transmitted to the passage section agitator gear 63 via the two intermediate gears 130 and drives the passage section agitator gear 63 to rotate clockwise in a right side view. Consequently, the passage section rotational shaft 103 and passage section agitating blade 104, i.e. the passage section agitator 97, rotates clockwise in the right side view together with the passage section agitator gear 63, as shown in FIG. 16. At this time, the passage section agitating blade 104 rotates while the distal end of the passage section agitating blade 104 scrapes against the inner surface of the inner cylinder part 90 and the interference preventing wall 100.

When the passage section agitating blade 104 slidingly contacts the interference preventing wall 100, the passage section agitating blade 104 flexes more in the counterclockwise direction in a right side view than when sliding contacting other parts of the inner cylinder part 90. The flexed state of the passage section agitating blade 104 is maintained immediately after the passage section agitating blade 104 passes over the interference preventing wall 100, thereby preventing the passage section agitating blade 104 from interfering with the cartridge auger 102 that is exposed in the receiving section 105 of the passage section agitating blade 104 after passing the interference preventing wall 100.

Further, the cartridge auger gear 110 engaged with the passage section agitator gear 63 also rotates counterclockwise in a right side view as shown in FIGS. 11A and 11B. Accordingly, the drive force for rotating the passage section rotational shaft 103 of the passage section agitator 97 is transmitted to the cartridge rotational shaft 108 for rotating the cartridge auger 102 counterclockwise in a right side view.

The passage section agitator 97 agitates toner in the inner cylinder part 90 and conveys the toner in a circumferential direction in the inner cylinder part 90, supplying toner to the receiving section 105 of the auger accommodating section 101. The rotating cartridge auger 102 agitates toner supplied onto the receiving section 105 and conveys the toner leftward over the receiving section 105, conveying the toner to the cartridge supply opening 96 through the tunnel section 111. As indicated by the dotted line and arrows in FIG. 15, the toner passes leftward in a horizontal direction through the cartridge shutter supply opening 118, first casing shutter supply opening 41, casing side supply hole 33, second casing shutter supply hole 77, developer shutter supply hole 94, and developer supply hole 171. The toner is discharged into the toner supply chamber 161 of the process unit 9 (see FIG. 17).

As shown in FIG. 17, the supply side conveying part 170 of the rotating supply auger 156 conveys toner discharged into the toner supply chamber 161 leftward through the toner supply chamber 161. At the left end of the toner supply chamber 161, the conveyed toner drops through the toner through-hole 162, is conveyed to the developer chamber 160, and is supplied to the left end of the return auger 157. The return side conveying part 173 of the rotating return auger 157 conveys toner supplied to the left end of the return auger 157 rightward, while supplying the toner to the supply roller 153 disposed below the return auger 157.

Toner that reaches the developer return hole 174 without being supplied to the supply roller 153 passes rightward as indicated by the dotted line with arrows in FIG. 15. More specifically, the toner that reaches the developer return hole 174 is conveyed in a horizontal direction through the developer shutter return hole 140, second casing shutter return hole 78, casing side return hole 34, first casing shutter return opening 42, and cartridge shutter return opening 119. Subsequently, toner passes through the cartridge return opening 112 into the inner cylinder part 90 of the toner cartridge 8. More specifically, toner received in the inner cylinder part 90 drops to the guide wall 99 immediately after passing through the cartridge return opening 112 and is guided rightward along the sloped surface of the guide wall 99. Next, toner is again agitated by the passage section agitator 97.

In this way, toner not supplied to the supply roller 153 can be circulated between the developing section 134 (see FIG. 17) and the toner cartridge 8. Toner that reaches the developer return hole 174 includes toner conveyed by the return side conveying part 173 according to the circulation process described above, or toner that accumulated in the developer chamber 160 and was subsequently conveyed by the return side conveying part 173, arriving at the developer return hole 174. The gaps between the toner cartridge 8 and left wall 20 and between the process unit 9 and left wall 20 are sealed to prevent circulated toner from leaking.

As shown in FIG. 17, toner supplied onto the supply roller 153 is supplied onto the developer roller 154 by the rotating supply roller 153. At this time, the toner is positively tribo-charged between the supply roller 153 and the developing roller 154. The toner supplied to the surface of the developing roller 154 passes between the roller 154 of the developing roller 154 and the pressing part 168 of the thickness-regulating blade 155, thereby maintaining a uniform thickness of toner on the surface of the roller 154 of the developing roller 154.

As this time, the charger 137 charges the surface of the main drum casing 146 of the photosensitive drum 136 with a uniform positive polarity by corona discharging. After the surface of the main drum casing 146 is charged the uniform positive polarity, a laser beam emitted from a laser beam window (not shown) of the scanning unit 80 (see FIG. 1) is scanned at a high speed over the surface of the photosensitive drum 136 via the laser passage 141, forming an electrostatic latent image corresponding to an image to be formed on the paper.

Next, positively charged toner carried on the surface of the developing roller 154 comes into contact with the photosensitive drum 136 as the drum body 146 of the photosensitive drum 136 rotates and is supplied to areas on the surface of the positively charged photosensitive drum 136 that were exposed to the laser beam and, therefore, have a lower potential. In this way, the latent image on the photosensitive drum 136 is transformed into a visible image according to a reverse developing process so that a toner image is carried on the surface of the drum body 146.

Subsequently, as the registration rollers 58 (see FIG. 1) convey a sheet of the paper from the first opening 142 into the drum casing 135 and through the transfer position between the photosensitive drum 136 and transfer roller 138, the toner image carried on the surface of the photosensitive drum 136 is transferred onto the paper 3 by the transfer bias applied to the transfer roller 138.

The paper 3 conveyed along the U-shaped paper-conveying path (see in FIG. 1) around the separating roller 52 is conveyed toward above the process unit 9. Subsequently, after the paper 3 is conveyed through a gap between the ceiling of the develop section 134 and bottom surface of the scanning unit 4, the paper 3 is conveyed toward the transfer position via the first opening 142 of the drum section 133. The gap is formed by the spacers 64 of the developing section 134 contacting the bottom surface of the scanning unit 7 (a paper conveying guide 195 described later) and is equivalent in size to the protruding length of the spacers 64.

After the toner image is transferred, the paper 3 is conveyed out of the drum casing 135 via a second opening 143 (see FIG. 17) and is conveyed to the fixing unit 82.

Toner remaining on the photosensitive drum 136 after the transfer operation is recovered by the developing roller 154. Further, paper dust deposited on the photosensitive drum 136 from the paper 3 is recovered by the cleaning brush 139.

The fixing unit 82 is disposed above the scanning section 80 and adjacent to the same, and is disposed on the rear side of the process unit 9. In other words, the fixing unit 82 is disposed opposite side of the developing roller 154 from the photosensitive drum 136. The fixing unit 82 includes a fixed frame 180; and a heating roller 181, a pressure roller 182 and a discharge roller 183 provided within the fixed frame 180.

The heating roller 181 includes a metal tube, the surface of which has been coated with a fluorine resin, and a halogen lamp disposed inside the metal tube for heating the same. The heating roller 181 is driven to rotate by a driving force inputted from a motor (not shown).

The pressure roller 182 is disposed above and in opposition to the heating roller 181 and contacts the heating roller 181 with pressure. The pressure roller 182 is configured of a metal roller shaft covered with a roller that is formed of a rubber material. The pressure roller 182 follows the rotational drive of the heating roller 181.

The pair of discharge rollers 183 is disposed downstream of the heating roller 181 and the pressure roller 182 in the conveying direction of the paper 3. In the fixing unit 82, a toner image transferred onto the paper 3 at the transfer position is fixed to the paper 3 by heat as the paper 3 passes between the heating roller 181 and pressure roller 182. After the toner image is fixed to the paper 3, the heating roller 181 and pressure roller 182 continue to convey the paper 3 along a discharge end paper-conveying path toward a discharge tray 185 formed on the top surface of the main casing 2 by the discharge roller 183.

The discharge section 6 is disposed on the front of the main casing 2, in other words, on the opposite side of the photosensitive drum 136 and includes a discharge passage 184 and the discharge tray 185.

As shown in FIG. 2, a pair of front end walls 186 are provided on the widthwise ends of the front wall 14 in the main casing 2. The cartridge mounting opening 16 is formed in the right front end wall 186. The discharge tray 185 is formed in the portion of the front wall 14 interposed between the front end walls 186 in the width direction and is recessed toward the rear. As shown in FIG. 1, the discharge tray 185 is stacked over the front portions of the paper tray 51 and the scanning section 80.

More specifically, the discharge tray 185 includes a bottom discharge wall 187, a pair of side discharge walls 188, and a rear discharge wall 189. The bottom discharge wall 187 has a rectangular plate shape in a plan view and extends continuously rearward from the top edge on the portion of the front wall 14 interposed between the front end walls 186 in the width direction.

The pair of side discharge walls 188 are erected upward from both widthwise edges of the developer passage section 87 and face each other in the width direction.

The rear discharge wall 189 has a rectangular plate shape in a front view and bridges the side discharge walls 188, extending continuously upward from the rear edge of the bottom discharge wall 187. The rear discharge wall 189 includes a first rear discharge wall 190 forming the lower half portion thereof, and a second rear discharge wall 191 forming the upper half portion thereof. The rear discharge wall 189 is disposed adjacent to and forward of the fixing unit 82.

The upper edge of the first rear discharge wall 190 vertically opposes and is separated by a gap from the lower edge of the second rear discharge wall 191. The gap formed between the first rear discharge wall 190 and second rear discharge wall 191 is greater than the thickness of the paper and corresponds to the discharge opening 184 providing communication between the fixing unit 82 and discharge tray 185.

After an image has been fixed by heat on the paper in the fixing unit 82, the discharge rollers 183 discharge the paper onto the bottom discharge wall 187 of the discharge tray 185 through the discharge opening 184.

The discharge tray 185 is open on the front side when the scanning unit 7 is closed and the process unit mounting opening 11 in the main casing 2 is closed, but is open on the top when the scanning unit 7 is open and the process unit mounting opening 11 is open.

The scanning unit 7 includes an original base 192, and an original holding cover 193 rotatably supported on the original base 192.

The original base 192 is formed as a thick plate that is rectangular in a plan view. A glass surface 194 on which an original document is placed is formed on the top surface of the original base 192. The paper conveying guide 195 is formed on the bottom surface of the original base 192. The guide lever 67 described above (see FIG. 5) is positioned to the right of the paper conveying guide 195.

The glass surface 194 is formed by embedding a glass plate in the original base 192 so that the top surface of the original base 192 is flat. The glass surface 194 has a rectangular shape in a plan view, with the longitudinal dimension following the longitudinal dimension of the original base 192.

The original base 192 has a built-in CCD sensor (not shown) for scanning an original, and a scanning motor (not shown) for scanning the CCD sensor (not shown) in confrontation with the glass surface 194.

The CCD sensor (not shown) is supported on the inner side of the glass surface 194 so as to be capable of moving left to right and is normally in standby on the left edge of the glass surface 194. During a normal scanning operation, the scanning motor (not shown) scans the CCD sensor (not shown) from left to right, with the sensor confronting the glass surface 194.

The paper conveying guide 195 extends in the left-to-right direction and is formed in a convex curve facing upward, following but separated from the top surface of the ceiling in the developer casing 152 of the developing section 134, when the scanning unit 7 is closed and the process unit mounting opening 11 in the upper section of the main casing 2 is closed.

As shown in FIG. 2, the original holding cover 193 has a rectangular plate shape in a plan view similar to the shape of the original base 192 and includes an ADF (automatic document feeder) device 196 disposed on the left end of the top of the original holding cover 193 for automatically scanning documents. The ADF device 196 is provided with a casing 197, an original conveying roller (not shown), an original conveying motor (not shown), and an original sensor (not shown). The casing 197 is box-shaped and elongated in the front-to-rear direction. The original conveying roller (not shown) and the original conveying motor (not shown) are built into the casing 197. An original document tray 198 is provided on the right wall of the casing 197 in the vertical center thereof. The original document tray 198 has a thin plate shape that has a substantially trapezoidal shape in a plan view. The bottom edge of the trapezoidal shape is supported on the ADF device 196 as the base edge, while the distal edges extend rightward in a substantially horizontal direction. Sheets of an original document can be stacked on the original document tray 198.

A feeding hole 199 for introducing an original document into the casing 197 is formed in the right wall of the casing 197 above the original document tray 198. An original discharge opening 200 for discharging the original document from the casing 197 is formed in the right wall of the casing 197 below the original document tray 198. The feeding hole 199 and original discharge opening 200 are both rectangular in shape and elongated in the front-to-rear direction.

The rear edge of the original holding cover 193 is pivotably supported on the rear edge of the original base 192 by a hinge 201. A grip part 70 is formed as a depression in the front edge of the original holding cover 193.

As shown in FIG. 1, the rear edge of the original holding cover 193 pivots about the hinge 201 while the front edge moves vertically. An operator exposes the glass surface 194 on the original base 192 by gripping the grip part 70 and lifting the front edge of the original holding cover 193 upward and covers the glass surface 194 of the original base 192 by pulling the front edge of the original holding cover 193 downward. Hence, the original holding cover 193 can be freely opened or closed over the glass surface 194 of the original base 192.

The operator first lifts the front edge of the original holding cover 193 upward and places an original document on the glass surface 194. Next, the operator lowers the front edge of the original holding cover 193 downward and presses buttons on the control panel 13 of the main casing 2 to begin a scanning operation. At this time, the scanning motor (not shown) scans the CCD sensor (not shown) from left to right in confrontation with the original document on the glass surface 194 for scanning image data on the document.

After scanning is complete, the operator again lifts the front edge of the original holding cover 193 upward and removes the original from the glass surface 194. After the CCD sensor (not shown) has completed scanning, the scanning motor (not shown) automatically moves the CCD sensor (not shown) to the left edge of the glass surface 194 and places the CCD sensor (not shown) in standby.

When automatically scanning a document with the ADF device 196, the scanning sensor (not shown) detects when an original document is set in the original document tray 198. Unlike the normal scanning operation described above, the CCD sensor (not shown) is fixed in an automatic document scanning position not shown in the drawings. When the operator presses buttons on the control panel 13 to being the scanning operation, a document conveying motor (not shown) drives a document conveying roller (not shown) to rotate. The rotation of the document conveying roller (not shown) conveys the original document leftward so that the document is introduced into the casing 197 through the feeding hole 199 shown in FIG. 2. The document being scanned is conveyed along an original conveying path (not shown). When the original document is opposite the CCD sensor (not shown), the CCD sensor (not shown) is scanned to read image data from the original. Subsequently, the original document is conveyed rightward through the original discharge opening 200 and discharged onto the top surface of the original holding cover 193.

The image-forming unit 5 shown in FIG. 1 creates image data based on the original data scanned by the CCD sensor (not shown) to form an image on the paper 3, as described above.

In the laser printer 1 of the preferred embodiment, a left wall 20 of the accommodating section is provided in the main casing 2 between the process unit 9 and toner cartridge 8. Using the left wall 20 as reference, the process unit 9 and toner cartridge 8 can be detachably mounted in the main casing 2, thereby avoiding a drop in precision for positioning the process unit 9 and toner cartridge 8 relative to the main casing 2. Accordingly, the process unit 9 and toner cartridge 8 can be disposed in the main casing 2 at precise positions.

Hence, this construction can improve the operability of the process unit 9 and toner cartridge 8, and particularly the ease of replacement operations. Further, by providing the left wall 20 between the process unit 9 and toner cartridge 8, the process unit 9 and toner cartridge 8 are independently mounted in the main casing 2, enabling the process unit 9 and toner cartridge 8 to be separately mounted in the main casing 2 or removed therefrom.

Further, the developer supply hole 171 and developer return hole 174 are formed in the process unit 9, as shown in FIG. 15, and the cartridge supply opening 96 and cartridge return opening 112 are formed in the toner cartridge 8, which accommodates toner. In addition, the left wall 20 is formed with the casing side supply hole 33 and casing side return hole 34. The casing side supply hole 33 is aligned with the developer supply hole 171 and cartridge supply opening 96 in the width direction, while the casing side return hole 34 is aligned with the developer return hole 174 and cartridge return opening 112 in the width direction.

With this construction, toner from the toner cartridge 8 can be supplied to the developing roller 154 through the developer supply hole 171, cartridge supply opening 96, and casing side supply hole 33.

The developer shutter 177 is also provided on the process unit 9 for opening and closing the developer supply hole 171 and developer return hole 174, and the outer cylinder part 91 is provided on the toner cartridge 8 for opening and closing the cartridge supply opening 96 and cartridge return opening 112. Hence, by opening the outer cylinder part 91 on the toner cartridge 8, in other words, by rotating the outer cylinder part 91 to the open position, the cartridge supply opening 96 is exposed, allowing toner to be supplied from the toner cartridge 8 to the casing side supply hole 33. By opening the developer shutter 177 on the process unit 9, in other words, by rotating the developer shutter 177 to the open position, the developer supply hole 171 is exposed, allowing toner to be received from the toner cartridge 8 through the casing side supply hole 33.

On the other hand, since the developer supply hole 171 and developer return hole 174 are closed by closing the developer shutter 177, in other words, by rotating the developer shutter 177 to the closed position, the passages between the developer supply hole 171 and casing side supply hole 33 and the developer return hole 174 and casing side return hole 34 are blocked, thereby restricting the migration of toner between the developer supply hole 171 and casing side supply hole 33 and between the developer return hole 174 and casing side return hole 34. Accordingly, it is possible to prevent toner from leaking from the developer supply hole 171 and developer return hole 174 when removing the process unit 9 from the main casing 2.

Further, since the cartridge supply opening 96 and cartridge return opening 112 are closed by closing the outer cylinder part 91, in other words, by rotating the outer cylinder part 91 to the closed position, passages between the cartridge supply opening 96 and casing side supply hole 33 and between the cartridge return opening 112 and casing side return hole 34 are blocked, thereby restricting the movement of toner between the cartridge supply opening 96 and casing side supply hole 33 and between the cartridge return opening 112 and casing side return hole 34. Accordingly, it is possible to prevent toner from leaking from the cartridge supply opening 96 and cartridge return opening 112 when removing the toner cartridge 8 from the main casing 2.

Further, since the opening and closing operations of the developer shutter 177 are independent from the opening and closing operations of the outer cylinder part 91, the developer supply hole 171 and developer return hole 174 can be opened and closed independently from the cartridge supply opening 96 and cartridge return opening 112. In this way, the toner cartridge 8 can be independently removed from the main casing 2 simply by closing the outer cylinder part 91 to close the cartridge supply opening 96 and cartridge return opening 112, and without operating the developer shutter 177. Similarly, the process unit 9 can be independently removed from the main casing 2 simply by closing the developer shutter 177 to close the developer supply hole 171 and developer return hole 174, and without operating the outer cylinder part 91.

As shown in FIG. 9, the toner cartridge 8 is disposed in the main casing 2 so as to confront the developing roller 154 in the width direction of the same. This configuration enables the laser printer 1 to be constructed with a smaller vertical dimension than a configuration that disposes the toner cartridge 8 in confrontation with the developing roller 154 in the vertical direction orthogonal to the width direction of the developing roller 154. Hence, the laser printer 1 can be made more compact.

As shown in FIG. 10, the shaft holding member 73 is provided on the left side surface of the left wall 20 in the main casing 2 opposing the process unit 9 for holding the right side of the process unit 9. The shaft holding member 73 can improve the precision of positioning the process unit 9 relative to the main casing 2.

More specifically, since the shaft holding member 73 holds the drum shaft 147 of the photosensitive drum 136 (see FIG. 18) in the process unit 9, the photosensitive drum 136 can be positioned more precisely in order to form an electrostatic latent image with excellent precision.

The shaft receiving groove 107 functioning to guide the drum shaft 147 is formed in the shaft holding member 73 on the left side of the left wall 20 and extends parallel to the left wall 20. Hence, both widthwise ends of the process unit 9 can be held in the main casing 2, thereby enabling the process unit 9 to be mounted and removed without interfering with the toner cartridge 8.

As shown in FIG. 15, the second casing shutter 71 is provided on the left wall 20 for opening and closing the casing side supply hole 33 and casing side return hole 34 from the left side surface thereof. Hence, when the second casing shutter 71 is opened to open the casing side supply hole 33 and the developer shutter 177 is opened to open the developer supply hole 171, the casing side supply hole 33 and developer supply hole 171 are in communication with each other.

The first casing side shutter 37 is provided on the left wall 20 for opening and closing the casing side supply hole 33 and casing side return hole 34 from the right side surface. Hence, by opening the first casing side shutter 37 by rotating the first casing side shutter 37 to the open position to open the casing side supply hole 33 and by opening the outer cylinder part 91 to open the cartridge supply opening 96, the casing side supply hole 33 and cartridge supply opening 96 are in communication with each other.

In this way, toner can be supplied from the toner cartridge 8 to the casing side supply hole 33, and the process unit 9 can receive toner from the toner cartridge 8 through the developer supply hole 171 and casing side supply hole 33.

On the other hand, since the passage between the developer supply hole 171 and casing side supply hole 33 is blocked by closing the second casing shutter 71, in other words, by rotating the second casing shutter 71 to the closed position to close the casing side supply hole 33, the migration of toner between the developer supply hole 171 and casing side supply hole 33 can be restricted, thereby preventing the leakage of toner from the left side of the casing side supply hole 33 when the process unit 9 is removed from the main casing 2. Further, the casing side return hole 34 is closed by closing the second casing shutter 71, thereby preventing the leakage of toner from the left side of the casing side return hole 34.

The opening and closing operations of the developer shutter 177 are performed in association with the opening and closing operations of the second casing shutter 71. Accordingly, the developer supply hole 171 and casing side supply hole 33 can be opened simultaneously when the process unit 9 is mounted in the main casing 2 so that toner can be smoothly received from the toner cartridge 8. Similarly, the developer supply hole 171 and casing side supply hole 33 can be closed simultaneously when removing the process unit 9 from the main casing 2 so as to prevent the leakage of toner from both the developer supply hole 171 and casing side supply hole 33. Hence, this construction can improve operability.

Further, since the passage between the cartridge supply opening 96 and casing side supply hole 33 is blocked when the first casing side shutter 37 is closed to close the casing side supply hole 33, in other words, when the first casing side shutter 37 is rotated to the closed position, the migration of toner between the cartridge supply opening 96 and casing side supply hole 33 can be restricted. Accordingly, it is possible to prevent the leakage of toner from the right side of the casing side supply hole 33 when removing the toner cartridge 8 from the main casing 2. Further, since the casing side return hole 34 is closed when closing the first casing side shutter 37, it is possible to prevent the leakage of toner from the right side of the casing side return hole 34.

Opening and closing operations of the outer cylinder part 91 are performed in association with opening and closing operations of the first casing side shutter 37. Accordingly, the cartridge supply opening 96 and casing side supply hole 33 are opened simultaneously when the toner cartridge 8 is mounted in the main casing 2 so that toner can be smoothly supplied from the toner cartridge 8. Further, the cartridge supply opening 96 and casing side supply hole 33 are closed simultaneously when removing the toner cartridge 8 from the main casing 2, preventing the leakage of toner from both the cartridge supply opening 96 and casing side supply hole 33. Hence, this construction can improve operability.

Further, since the second casing shutter 71 opens and closes in association with the opening and closing operations of the scanning unit 7, as shown in FIGS. 4 and 10, this construction can further improve operability.

As shown in FIG. 15, toner is supplied from the toner cartridge 8 to the developing roller 154 via the developer supply hole 171 and received from the developing roller 154 via the developer return hole 174. Further, toner is supplied to the developer supply hole 171 via the cartridge supply opening 96 and is received from the developer return hole 174 via the cartridge return opening 112. Hence, the casing side supply hole 33 allows the passage of toner from the cartridge supply opening 96 to the developer supply hole 171, while the casing side return hole 34 allows the passage of toner from the developer return hole 174 to the cartridge return opening 112.

Specifically, toner accommodated in the toner cartridge 8 is conveyed through the cartridge supply opening 96 to the casing side supply hole 33 and supplied from the casing side supply hole 33 to the developing roller 154 of the process unit 9 via the developer supply hole 171. On the other hand, part of the toner supplied to the developing roller 154 is conveyed to the casing side return hole 34 through the developer return hole 174 and is received from the casing side return hole 34 in the toner cartridge 8 via the cartridge return opening 112. In this way, toner can be circulated between the toner cartridge 8 and process unit 9.

In the laser printer 1 of the preferred embodiment, the toner cartridge 8 includes the developer passage section 87 and the developer accommodating section 88 accommodating toner to be supplied to the developing roller 154, as shown in FIG. 12.

As shown in FIG. 15, a plurality of agitating members, specifically the passage section agitator 97 and cartridge auger 102, is provided in the developer passage section 87 so that toner accommodated in the developer passage section 87 can be sufficiently agitated.

Further, the passage section rotational shaft 103 and cartridge rotational shaft 108 of the passage section agitator 97 and cartridge auger 102, respectively, are disposed parallel to each other while at different positions in a radial direction of the substantially cylindrically shaped developer passage section 87 (see FIG. 16). With this configuration, toner accommodated in the developer passage section 87 can be uniformly agitated in the radial direction rather than agitated locally.

By providing the developer accommodating section 88 in addition to the developer passage section 87, as shown in FIG. 14, a sufficient amount of toner can be accommodated in the toner cartridge 8. Further, the accommodating section agitating mechanisms 122 provided in the developer accommodating section 88 can reliably convey toner from the developer accommodating section 88 to the developer passage section 87.

In the developer passage section 87 shown in FIG. 15, the cartridge supply opening 96 is formed in the left inner side wall 93 for supplying toner to the developing roller 154. Hence, toner can be supplied to the developing roller 154 through the cartridge supply opening 96 in the width direction.

Since the directions in which toner is conveyed by the passage section agitator 97 and the cartridge auger 102 are different, driving both the passage section agitator 97 and cartridge auger 102 to rotate stirs the toner in two different conveying directions, rather than one, thereby effectively agitating the toner.

Further, by transferring toner agitated in one conveying direction by the passage section agitator 97 to the cartridge auger 102 in the developer passage section 87, the toner can be conveyed in a direction different from the conveying direction of the passage section agitator 97.

Specifically, the passage section agitator 97 conveys toner in a circumferential direction in the developer passage section 87, while the cartridge auger 102 conveys the toner in the axial direction (width direction) of the developer passage section 87.

Accordingly, toner can be effectively agitated throughout the entire developer passage section 87. Further, toner stirred in the circumferential direction can be conveyed in the width direction of the developer passage section 87.

Further, since the cartridge auger 102 conveys toner toward the cartridge supply opening 96, the toner accommodated in the developer passage section 87 can be reliably supplied onto the developing roller 154 through the cartridge supply opening 96.

Further, the cartridge auger 102 can convey toner stirred in the circumferential direction of the developer passage section 87 by the passage section agitator 97 to the cartridge supply opening 96 along the width direction of the developer passage section 87.

Further, since the cartridge rotational shaft 108 extends in the width direction, i.e. the direction in which the cartridge auger 102 conveys toner, the cartridge auger 102 can convey toner along the cartridge rotational shaft 108.

Further, since the cartridge rotational shaft 108 of the cartridge auger 102 coincides with the cartridge supply opening 96 in a direction conforming to its axis (width direction), the cartridge auger 102 can reliably convey toner to the cartridge supply opening 96. Accordingly, toner accommodated in the developer passage section 87 can be reliably supplied to the developing roller 154 through the cartridge supply opening 96.

In the developer passage section 87, the cartridge return opening 112 is also formed in the left inner side wall 93 in which the cartridge supply opening 96 is formed for receiving toner from the developing roller 154. Therefore, toner can be circulated between the developer passage section 87 and developing roller 154 via the cartridge supply opening 96 and cartridge return opening 112.

As shown in FIG. 9, the toner cartridge 8 is disposed in the main casing 2 so as to confront the developing roller 154 in the width direction thereof. Hence, both the toner supply side and return side can be configured to convey toner substantially horizontally between the toner cartridge 8 and process unit 9, unlike a structure in which the toner cartridge 8 confronts the developing roller 154 vertically, thereby circulating toner more smoothly.

As shown in FIG. 15, the guide wall 99 is provided in the developer passage section 87 for guiding toner received through the cartridge return opening 112 to the passage section agitator 97. When the guide wall 99 is used to guide toner to the passage section agitator 97 in this way, the passage section agitator 97 can easily agitate the toner and transfer the toner to the cartridge auger 102. Toner transferred to the cartridge auger 102 is subsequently conveyed to the cartridge supply opening 96.

Hence, since the cartridge return opening 112 can smoothly convey received toner to the cartridge supply opening 96, toner can be smoothly circulated between the developer passage section 87 and developing roller 154.

Further, by providing the interference preventing wall 100 in the developer passage section 87 for preventing the passage section agitator 97 from interfering with the cartridge auger 102 (see FIG. 16), it is possible to prevent damage to the passage section agitator 97 and cartridge auger 102 caused by such interference.

Further, the passage section rotational shaft 103 and cartridge rotational shaft 108 are coupled together through the engagement of the passage section agitator gear 63 and cartridge auger gear 110 so that the drive force for rotating the passage section rotational shaft 103 is transmitted to the cartridge rotational shaft 108. Accordingly, it is not necessary to provide separate drive mechanisms for rotating the passage section rotational shaft 103 and cartridge rotational shaft 108, thereby reducing the number of required parts.

Further, the cartridge supply opening 96 and cartridge return opening 112 are uncovered by opening the outer cylinder part 91 to open the first casing side shutter 37. In other words, by rotating the outer cylinder part 91 to the open position, the cartridge supply opening 96 and cartridge return opening 112 are uncovered by rotating the first casing side shutter 37 to the open position. Hence, toner can be conveyed between the developer passage section 87 and developing roller 154. On the other hand, the cartridge supply opening 96 and cartridge return opening 112 are closed by closing the outer cylinder part 91 to close the first casing side shutter 37. In other words, by rotating the outer cylinder part 91 to the closed position the cartridge supply opening 96 and cartridge return opening 112 are closed by rotating the first casing side shutter 37 to the closed position. Hence, the path between the developer passage section 87 and developing roller 154 is blocked, restricting the movement of toner therebetween.

Since the outer cylinder part 91 and first casing side shutter 37 open and close in association with the opening and closing operations of the cover 17, operability can be improved.

Further, the developer passage section 87 is provided with the outer cylinder part 91, and the inner cylinder part 90 disposed on the inside of the outer cylinder part 91 and having the cartridge supply opening 96 and cartridge return opening 112. Hence, by moving the outer cylinder part 91 relative to the inner cylinder part 90, in other words, by rotating the outer cylinder part 91 between the open position and the closed position, the cartridge supply opening 96 and cartridge return opening 112 can easily be opened and closed with the outer cylinder part 91.

While the control panel 13 is disposed on the top wall 10 of the main casing 2 in the preferred embodiment described above, the control panel 13 may be provided on the original base 192 instead. With this configuration, the control panel 13 moves together with the scanning unit 7 so that the process unit mounting opening 11 can be opened wider to further facilitate replacement of the process unit 9.

Further, the process unit 9 is integrally provided with the drum section 133 and developing section 134 and is detachably mounted in the main casing 2 in the preferred embodiment described above. However, the laser printer 1 may be configured so that the developing section 134 is detachably mounted in the drum section 133 while the drum section 133 is mounted in the main casing 2, for example.

Further, while the paper tray 51 is detachably mounted on the main casing 2 in the preferred embodiment described above, the paper tray 51 may be integrally formed with the main casing 2 instead. In this case, a front wall is not formed on the paper tray 51, but the interior of the paper tray 51 is open on the front side, and the paper 3 is accommodated in the paper tray 51 via the paper tray mounting opening 15.

Further, while the discharge tray 185 is integrally formed with the main casing 2, the discharge tray 185 may be detachably mounted on the main casing 2 as the paper tray 51 in the preferred embodiment.

Although the present invention has been described with respect to specific embodiments, it will be appreciated by one skilled in the art that a variety of changes may be made without departing from the scope of the invention.

Figure 19:
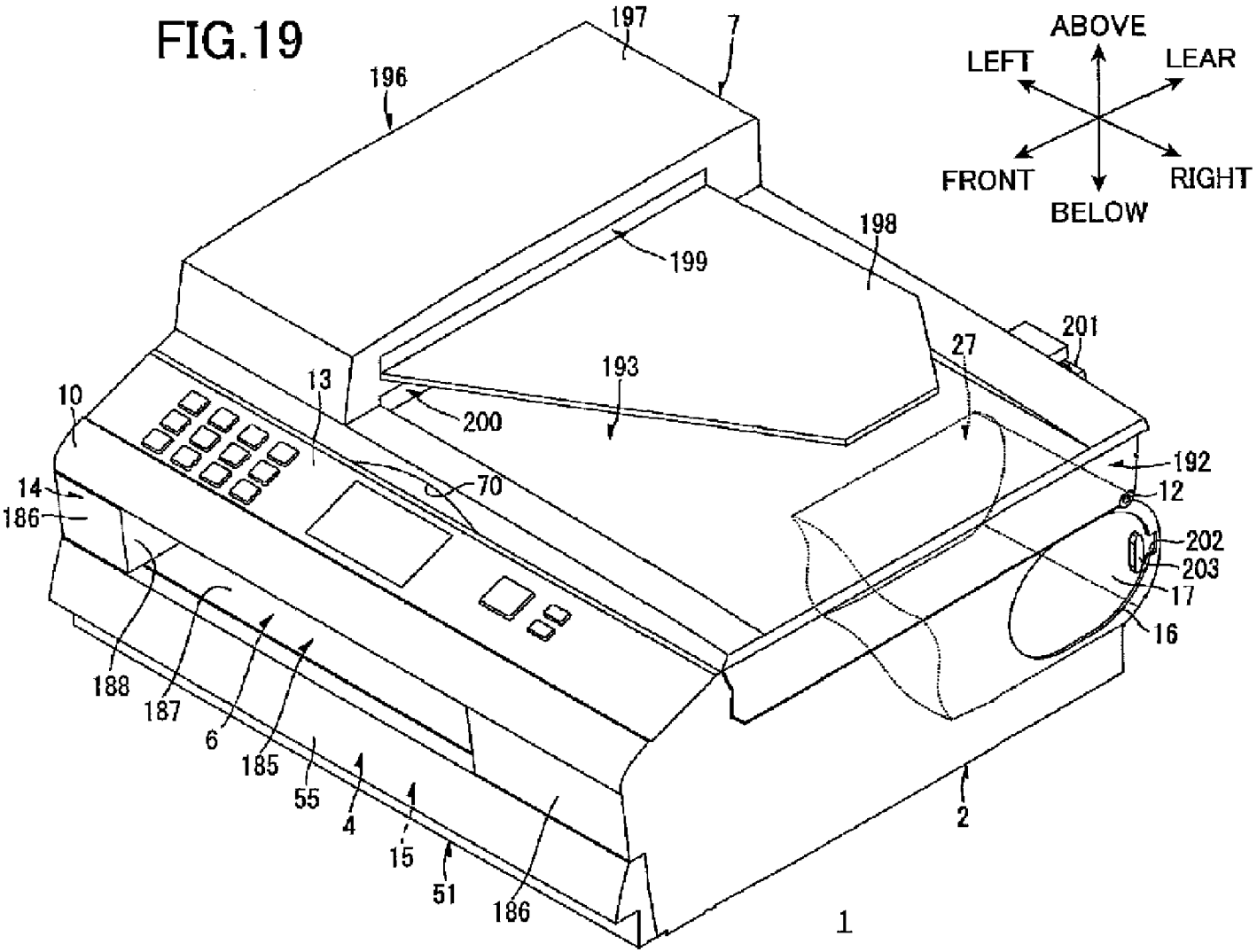
FIG. 19 is a perspective view of the laser printer according to another embodiment from a perspective diagonally above and rightward of the front side thereof.

In a main casing 2 according to the second variation shown in FIG. 19, the cartridge mounting opening 16 and cover 17 are provided on the right wall of the main casing 2 near the rear edge thereof.

The cartridge mounting opening 16 is formed in an elliptical shape in a side view elongated in the front-to-rear direction and corresponds to the side surface shape of the toner cartridge 8 according to the second variation described later. The cartridge mounting opening 16 is formed with a rear portion protruding a step rearward. The protruding portion is formed in a substantially rectangular shape in a side view and will be referred to as a mounting opening recessed part 202 below.

The cover 17 is shaped slightly larger than the cartridge mounting opening 16. A cover grip part 203 elongated vertically and protruding rightward is provided on the right side surface of the cover 17 near the rear edge thereof. The cover 17 is supported on the left side surface of the right side wall of the main casing 2 and is capable of sliding in the front-to-rear direction.

Figure 20A:
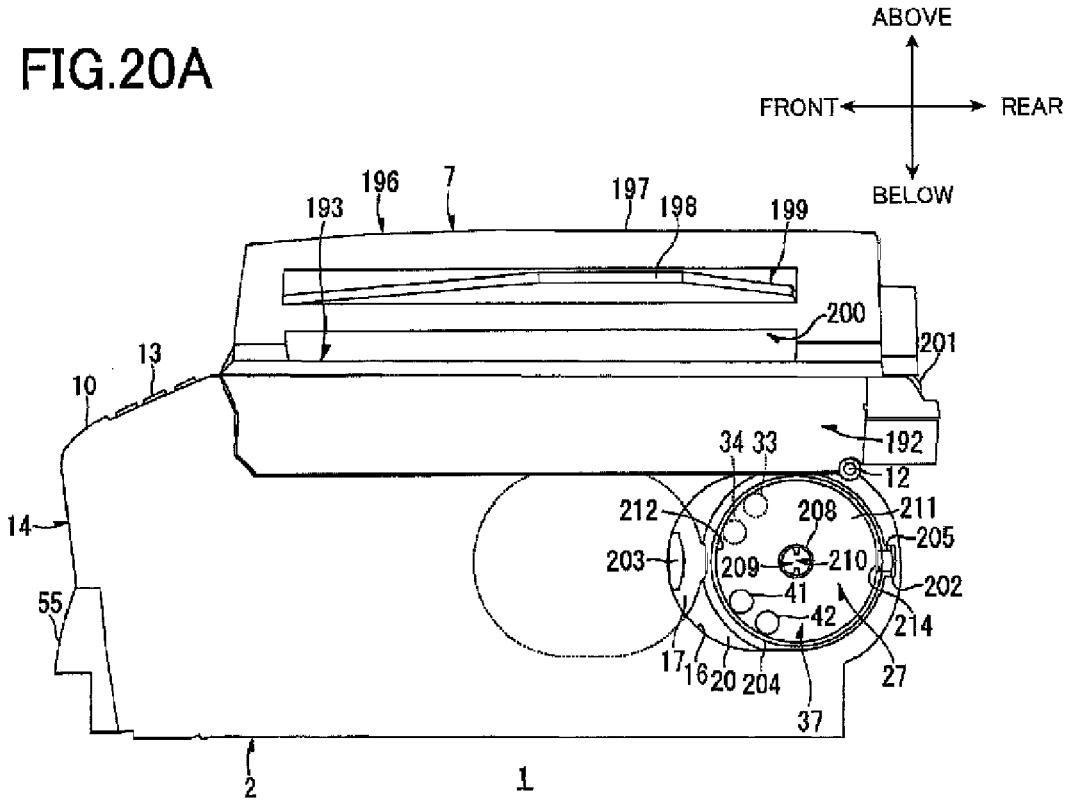
FIG. 20A is a right side view of the laser printer in FIG. 19 showing the cover in the open position when the toner cartridge is not mounted in the casing.
Figure 20B:
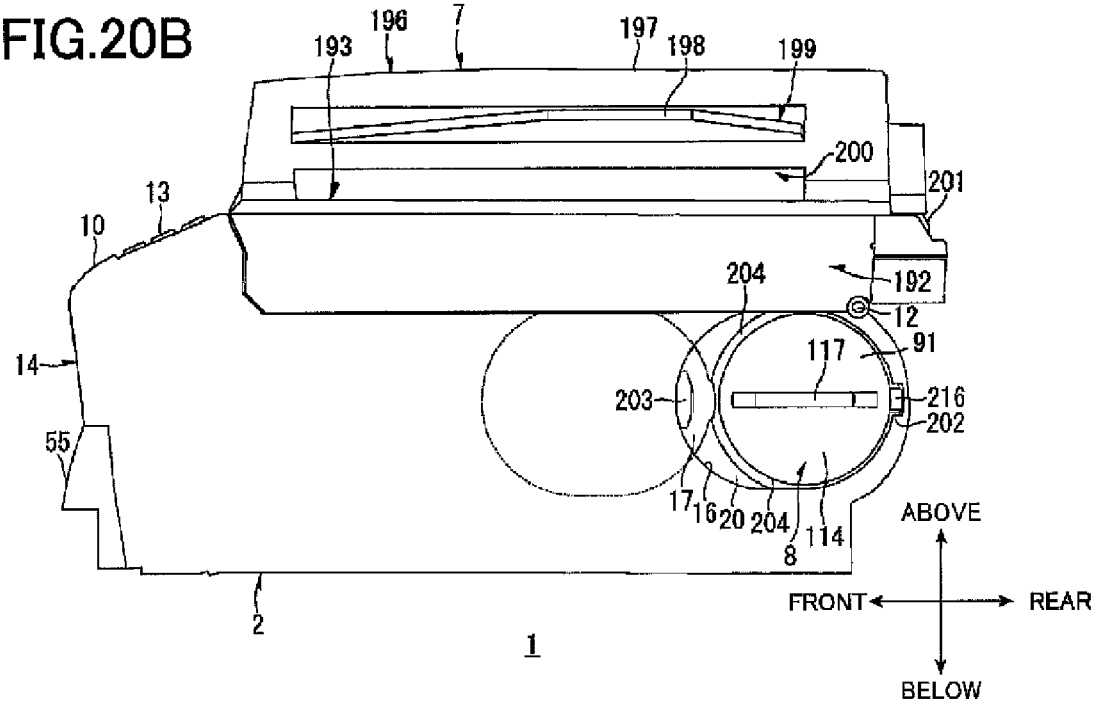
FIG. 20B is a right side view of the laser printer in FIG. 19 showing the cover in the open position when the toner cartridge is mounted in the casing.

Specifically, the cover 17 moves rearward when the operator grips the cover grip part 203 and pulls the cover grip part 203 rearward. In this way, the cover 17 can close the cartridge mounting opening 16. As in the preferred embodiment described above, the position of the cover 17 at this time is the closed position. However, when the operator grips the cover grip part 203 and pulls the cover grip part 203 forward, the cover 17 moves forward, as shown in FIGS. 20A and 20B, thereby revealing the cartridge mounting opening 16. As in the preferred embodiment described above, the position of the cover 17 at this time is the open position. When the cover 17 is in the open position, the cover grip part 203 contacts the portion on the right wall of the main casing 2 forming the front edge of the cartridge mounting opening 16, restricting movement of the cover 17 farther forward from the open position.

Figure 21A:
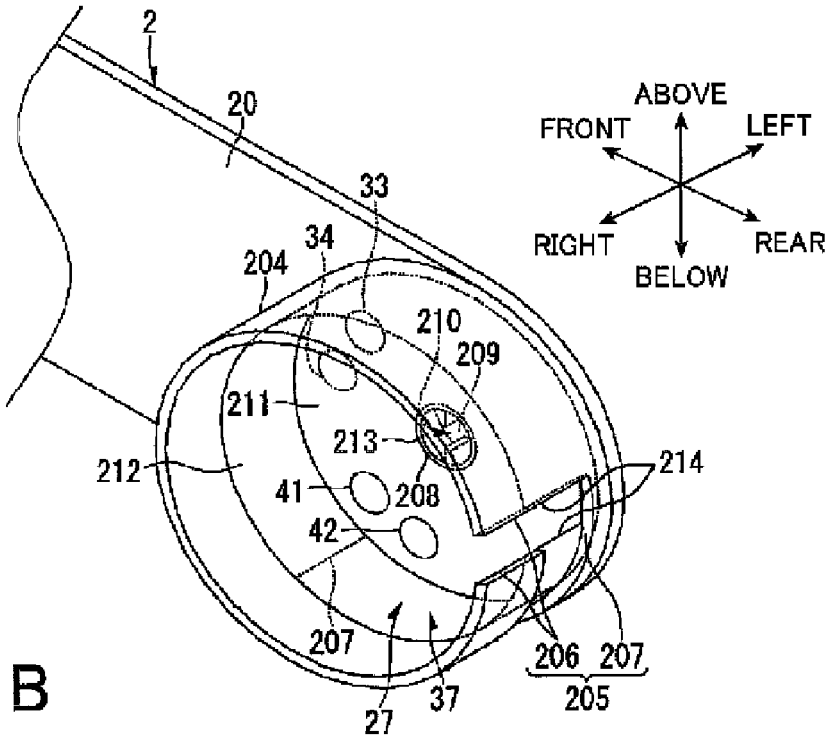
FIG. 21A is a perspective view showing the region around the first casing shutter according to the second variation from a perspective diagonally above and rightward of the front side thereof when the first casing shutter is in the closed position.

A cartridge accommodating wall 204 is provided on the right side surface of the left wall 20 described above at a position corresponding to the cartridge mounting opening 16 in the width direction. The cartridge accommodating wall 204 is formed in a ring shape extending from the left wall 20 to a position just inside the cartridge mounting opening 16. The cartridge accommodating space 27 of the main casing 2 is a space that defined by the cartridge accommodating wall 204 (see FIG. 20A). As shown in FIG. 21A, an accommodating section notch 205 is formed in the rear edge of the cartridge accommodating wall 204. The accommodating section notch 205 penetrates the cartridge accommodating wall 204 in the thickness direction and is integrally provided with a widthwise notch part 206 and a circumferential notch part 207. The widthwise notch part 206 extends in the width direction from the right edge of the cartridge accommodating wall 204 toward the left edge thereof. The circumferential notch part 207 extends continuously from the left edge of the widthwise notch part 206 along the circumferential direction of the cartridge accommodating wall 204 to the bottom edge of the cartridge accommodating wall 204.

The casing side supply hole 33, casing side return hole 34, and a drive gear exposing hole 208 are formed in the left wall 20. The positions and shapes of the casing side supply hole 33 and casing side return hole 34 are identical to those in the preferred embodiment described above. The drive gear exposing hole 208 is formed in the circular center of the cartridge accommodating wall 204 and penetrates the left wall 20 in the width direction. A drive gear 209 coupled to a drive motor (not shown) disposed on the left side of the left wall 20 is exposed through the drive gear exposing hole 208. A connecting hole 210 is formed as a leftward recess in the right side surface of the drive gear 209 exposed through the drive gear exposing hole 208. The connecting hole 210 has a substantially figure eight shape in a front view.

The first casing side shutter 37 according to the second variation is disposed inside the cartridge accommodating wall 204.

The first casing side shutter 37 is integrally provided with a first casing shutter disc wall 211, and a first casing shutter circumferential wall 212.

The first casing shutter disc wall 211 is formed as a thin plate having a circular shape in a side view having a peripheral edge that follows the inner peripheral surface of the cartridge accommodating wall 204. A shutter gear exposing hole 213, the first casing shutter supply opening 41, and the first casing shutter return opening 42 are formed in the first casing shutter disc wall 211.

The shutter gear exposing hole 213 is formed in the circular center of the first casing shutter disc wall 211 with substantially the same dimensions as the drive gear exposing hole 208. The shutter gear exposing hole 213 penetrates the first casing shutter disc wall 211 in the width direction. The shapes of the first casing shutter supply opening 41 and first casing shutter return opening 42 are identical to those in the preferred embodiment described above. The first casing shutter supply opening 41 and first casing shutter return opening 42 are formed in the first casing shutter disc wall 211 along the peripheral edge thereof.

The first casing shutter circumferential wall 212 has a thin ring shape extending rightward from the outer edge of the first casing shutter disc wall 211. One circumferential portion of the first casing shutter circumferential wall 212 is cut out in the width direction. The widthwise dimension of the first casing shutter circumferential wall 212 is substantially the same as the widthwise dimension of the circumferential notch part 207 in the accommodating section notch 205. The interval between edges of the first casing shutter circumferential wall 212 in the peripheral direction within a cutout part 214 that the part cut out from the first casing shutter circumferential wall 212 is substantially equivalent to the circumferential dimension of the widthwise notch part 206 in the accommodating section notch 205. Hereinafter, the part is referred to as a cutout part 214.

The first casing side shutter 37 is supported on the inner peripheral surface of the cartridge accommodating wall 204 so as to be capable of rotating in the circumferential direction. More specifically, the first casing side shutter 37 can freely rotate between the open position and the closed position, as described above in the preferred embodiment.

When the first casing side shutter 37 is in the closed position shown in FIG. 21A, the casing side supply hole 33 and casing side return hole 34 are closed from the right side by the portion of the first casing shutter disc wall 211 excluding the first casing shutter supply opening 41 and first casing shutter return opening 42. At this time, the widthwise notch part 206 in the accommodating section notch 205 of the cartridge accommodating wall 204 is continuous with the cutout part 214 of the first casing shutter circumferential wall 212 in the width direction.

Figure 21B:
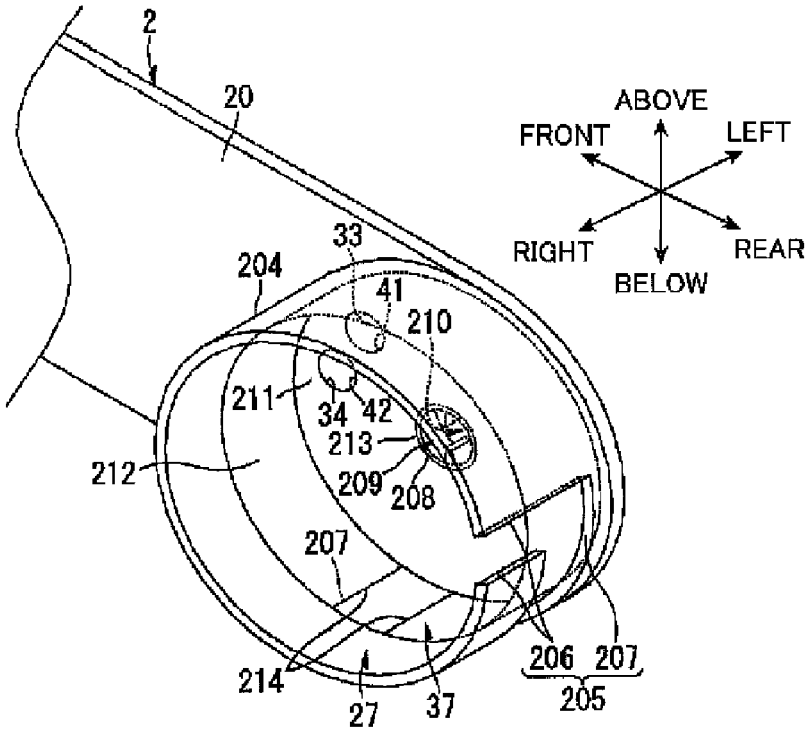
FIG. 21B is a perspective view showing the region around the first casing shutter according to the second variation from a perspective diagonally above and rightward of the front side thereof when the first casing shutter is in the open position.

On the other hand, the first casing side shutter 37 is in the open position shown in FIG. 21B when rotated about 90° clockwise in a right side view from the closed position. When the first casing side shutter 37 is in the open position, the first casing shutter supply opening 41 and casing side supply hole 33 are in communication, and the first casing shutter return opening 42 and casing side return hole 34 are in communication. At this time, the widthwise notch part 206 and cutout part 214 are not continuous in the width direction, and the cutout part 214 is positioned on the lower edge of the cartridge accommodating wall 204. More specifically, the front peripheral edge of the first casing shutter circumferential wall 212 forming the cutout part 214 is substantially aligned with the lower edge of the circumferential notch part 207 along a radial direction of the first casing shutter circumferential wall 212.

As shown in FIG. 22, the toner cartridge 8 according to the second variation does not include the toner accommodating section 88 and the handle 89 (see FIG. 11).

Figure 22A:
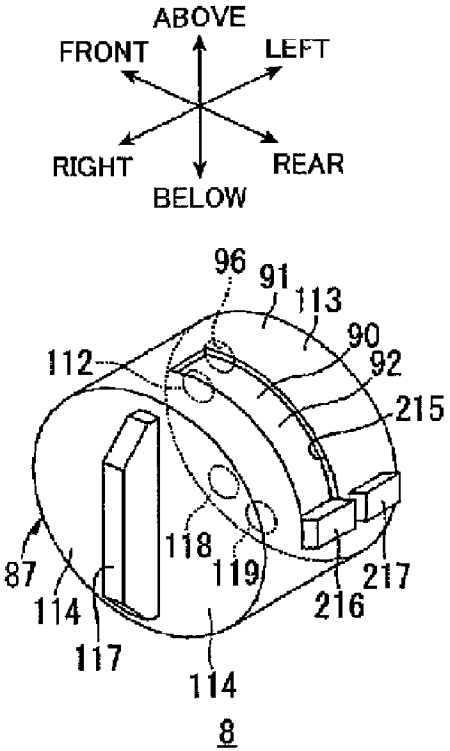
FIG. 22A is a perspective view showing the toner cartridge according to the second variation from diagonally above and rightward of the front side thereof when the outer cylinder part is in the closed position.
Figure 22B:
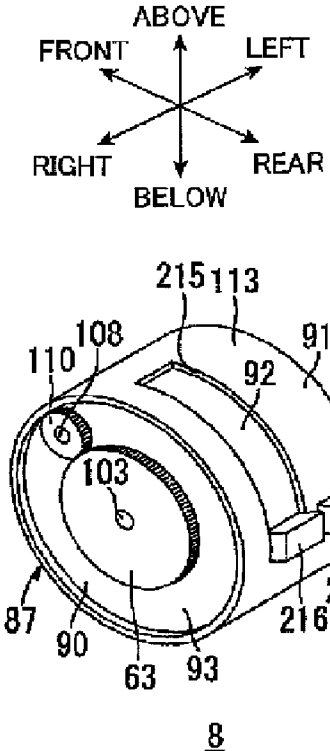
FIG. 22B is a perspective view of the toner cartridge from diagonally above and rightward of the front side thereof when the right outer side wall is removed from the structure in FIG. 22A.
Figure 22C:
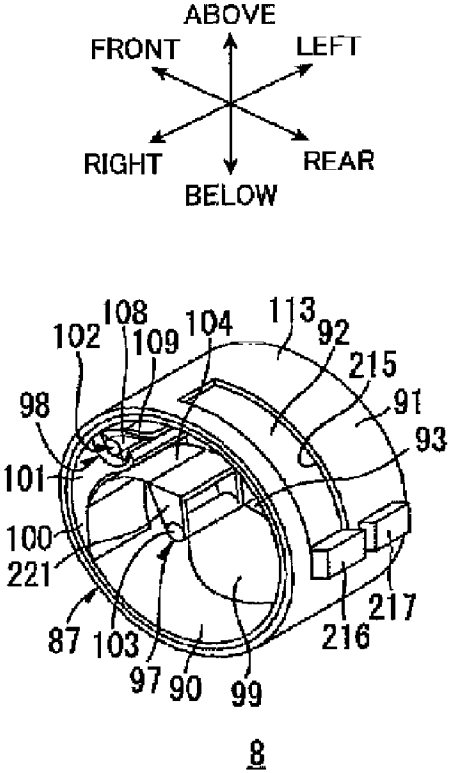
FIG. 22C is a perspective view of the toner cartridge from diagonally above and rightward of the front side thereof when the right inner side wall is removed from the structure in FIG. 22B.
Figure 22D:
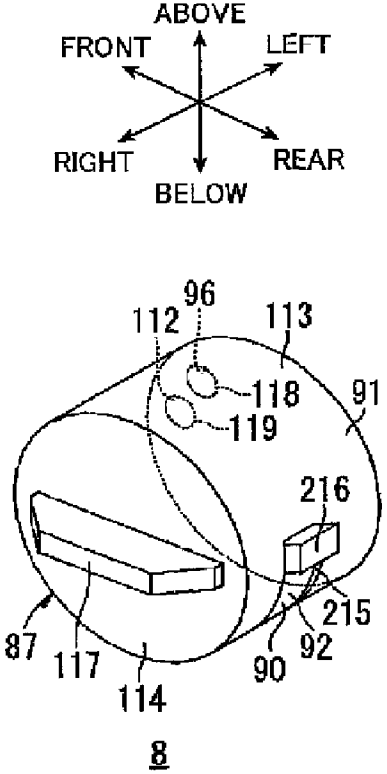
FIG. 22D is a perspective view showing the toner cartridge according to the second variation from diagonally above and rightward of the front side thereof when the outer cylinder part is in the open position.
Figure 23A:
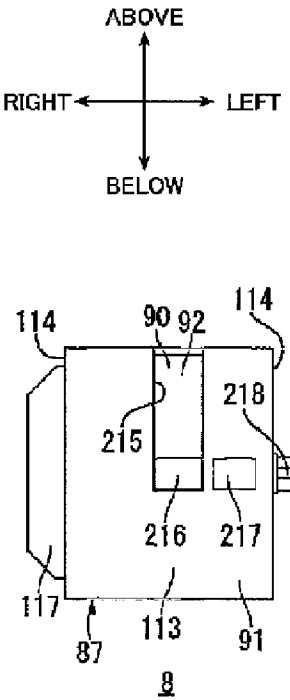
FIG. 23A is a front view of the toner cartridge when the outer cylinder part is in the closed position.

A protrusion guide groove 215 is equivalent to about one-fourth the circumference of the outer cylinder wall 113 and is formed substantially in the widthwise center of the outer cylinder wall 113 in the toner cartridge 8 according to the second variation, as shown in FIGS. 22A and 23A. The protrusion guide groove 215 penetrates the outer cylinder wall 113 in the thickness direction. Further, an outer cartridge protrusion 217 protrudes radially outward from the outer cylinder wall 113 at a position slightly leftward from the lower edge of the protrusion guide groove 215. The outer cartridge protrusion 217 is shaped substantially like a parallelepiped with a width dimension slightly smaller than the width dimension of the circumferential notch part 207 in the accommodating section notch 205 (see FIG. 21) and a vertical dimension (circumferential dimension) slightly smaller than the circumferential dimension of the widthwise notch part 206 in the accommodating section notch 205 and the cutout part 214 in the first casing side shutter 37. Further, the side surface shape of the outer cartridge protrusion 217 is smaller than the side surface shape of the mounting opening recessed part 202 formed in the cartridge mounting opening 16 (see FIG. 20B).

Further, as shown in FIG. 22A, an inner cartridge protrusion 216 is provided on the rear end of the inner cylindrical wall 92 in the inner cylinder part 90 at a position corresponding to the protrusion guide groove 215 and protrudes radially outward, and specifically toward the rear. The inner cartridge protrusion 216 is shaped substantially like a parallelepiped and has a vertical dimension (circumferential dimension) equivalent to the vertical dimension of the outer cartridge protrusion 217 and a width dimension smaller than the width of the protrusion guide groove 215. The side surface shape of the inner cartridge protrusion 216 is smaller than the side surface shape of the mounting opening recessed part 202 formed in the cartridge mounting opening 16 (see FIG. 20A). When the inner cylinder part 90 is accommodated in the outer cylinder part 91, the inner cartridge protrusion 216 is exposed externally from the protrusion guide groove 215. More specifically, the inner cartridge protrusion 216 is always exposed from the protrusion guide groove 215 while the outer cylinder part 91 rotates between the open position and closed position described above. When the outer cylinder part 91 is in the closed position (see FIG. 22A), the inner cartridge protrusion 216 contacts the lower edge of the protrusion guide groove 215. When the outer cylinder part 91 is in the open position (see FIG. 22D), the inner cartridge protrusion 216 contacts the upper edge of the protrusion guide groove 215.

The cartridge protrusion 117 described above is oriented vertically on the right outer side wall 114 when the outer cylinder part 91 is in the closed position (see FIG. 22A). The cartridge protrusion 117 is oriented in the front-to-rear direction when the outer cylinder part 91 is in the open position (see FIG. 22D). The internal structure of the inner cylinder part 90 including the passage section agitator 97, guide wall 99, interference preventing wall 100, and cartridge auger 102; and the passage section agitator gear 63 and cartridge auger gear 110 are identical to those in the preferred embodiment described above (see FIGS. 22B, 22C, 23B, and 23C).

Figure 23B:
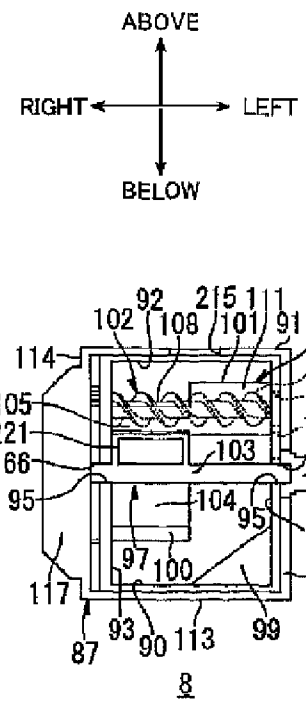
FIG. 23B is a front cross-sectional view of the toner cartridge in FIG. 23A.
Figure 23C:
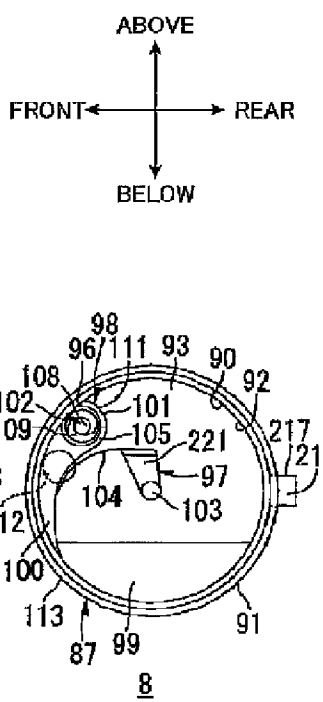
FIG. 23C is a side cross-sectional view of the toner cartridge in FIG. 23A.
Figure 23D:
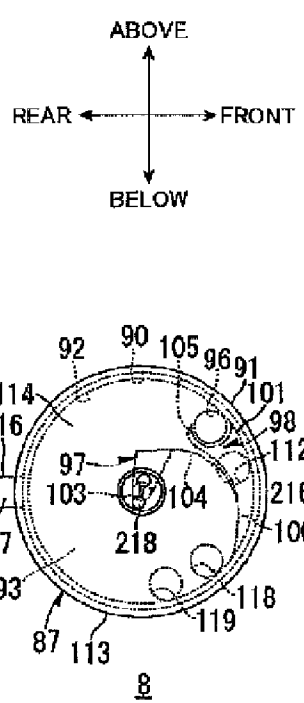
FIG. 23D is a left side view of the toner cartridge in FIG. 23A.
Figure 23E:
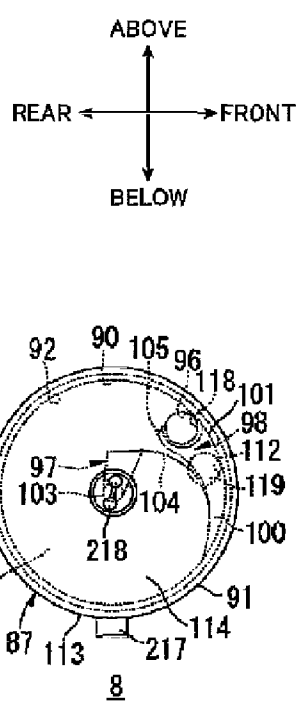
FIG. 23E is a left side view of the toner cartridge when the outer cylinder part is in the open position.

However, an idler gear 218 is provided in the toner cartridge 8 according to the second variation on the left end of the passage section rotational shaft 103 in the passage section agitator 97, as shown in FIG. 23B, and is incapable of rotating relative to the passage section rotational shaft 103. The idler gear 218 is shaped substantially like a figure eight in a left side view (see FIGS. 23D and 23E) and is exposed externally through the left outer side wall 114.

When mounting the toner cartridge 8 in the main casing 2, the operator first moves the cover 17 to the open position shown in FIG. 20A to expose the cartridge mounting opening 16. At this time, the first casing side shutter 37 is in the closed position. Next, the operator grips the cartridge protrusion 117 on the toner cartridge 8, while the outer cylinder part 91 is in the closed position shown in FIG. 24A, and moves the toner cartridge 8 leftward while keeping the toner cartridge 8 aligned with the cartridge mounting opening 16 and cartridge accommodating space 27 in the width direction.

Figure 24A:
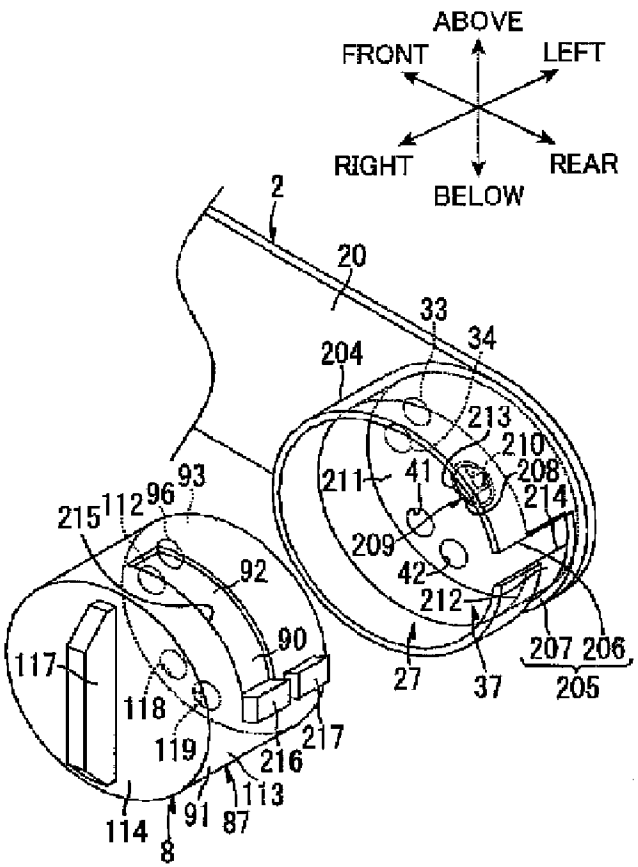
FIG. 24A is a perspective view of the toner cartridge and casing from diagonally above and rightward of the rear side thereof for illustrating mounting and removal of the toner cartridge relative to the casing when the toner cartridge is removed from the main casing.

At this time, the inner cartridge protrusion 216 and outer cartridge protrusion 217 are aligned with the mounting opening recessed part 202 of the cartridge mounting opening 16 in a side view (see FIG. 20A), and the widthwise notch part 206 of the cartridge accommodating wall 204 is aligned with the cutout part 214 of the first casing side shutter 37 (see FIG. 24A). While the toner cartridge 8 is moved leftward, the inner cartridge protrusion 216 and outer cartridge protrusion 217 pass through the mounting opening recessed part 202 in the width direction and arrive at the widthwise notch part 206 and cutout part 214 (see FIG. 24B).

Figure 24B:
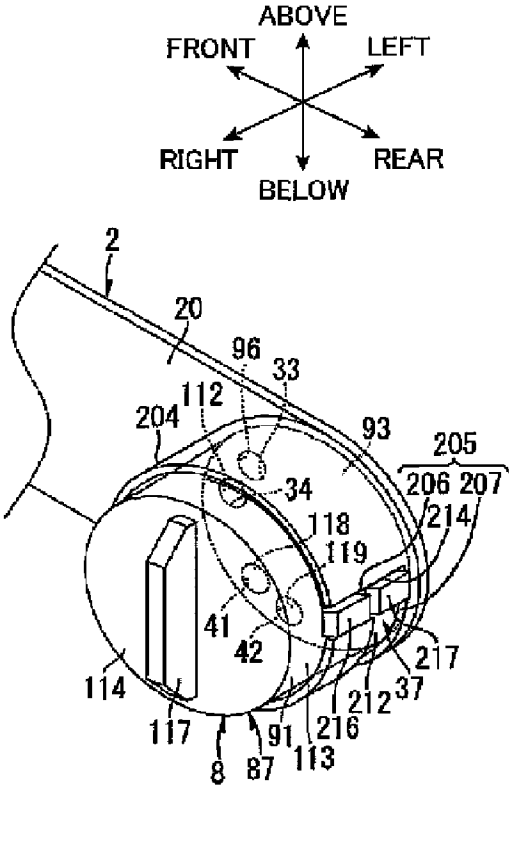
FIG. 24B is a perspective view of the toner cartridge and main casing from diagonally above and rightward of the rear side thereof for illustrating mounting and removal of the toner cartridge relative to the main casing when the toner cartridge is mounted in the main casing while the outer cylinder part is in the closed position.
Figure 24C:
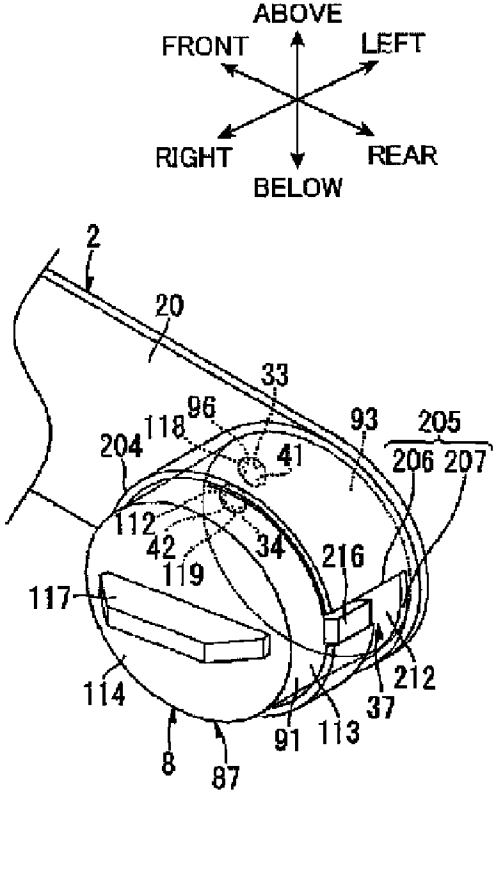
FIG. 24C is a perspective view of the toner cartridge and main casing from diagonally above and rightward of the rear side thereof for illustrating mounting and removal of the toner cartridge relative to the main casing when the toner cartridge is mounted in the main casing while the outer cylinder part is in the open position.

More specifically, as shown in FIG. 24B, the outer cartridge protrusion 217 is positioned in the cutout part 214 in the width direction, and the inner cartridge protrusion 216 is positioned in the widthwise notch part 206 to the right of the cutout part 214 and circumferential notch part 207. In other words, the outer cartridge protrusion 217 is inserted in the cutout part 214 formed in the first casing shutter circumferential wall 212 of the first casing side shutter 37. Further, the inner cartridge protrusion 216 is inserted in the cartridge accommodating wall 204 in a region of the widthwise notch part 206 to the right of the circumferential notch part 207.

Further, the idler gear 218 of the toner cartridge 8 (see FIG. 23B) is fitted into the connecting hole 210 of the drive gear 209 exposed from the drive gear exposing hole 208 formed in the left wall 20 and the shutter gear exposing hole 213 formed in the first casing side shutter 37 and is engaged therewith (see FIG. 24A). At this point, the toner cartridge 8 is completely accommodated in the cartridge accommodating space 27.

Next, the operator grips the cartridge protrusion 117 and twists the cartridge protrusion 117 clockwise in a right side view, thereby rotating the outer cylinder part 91, with the outer cartridge protrusion 217 inserted in the first casing shutter circumferential wall 212, together with the first casing side shutter 37 clockwise in a right side view, i.e. toward the open position, as described above. Through this rotation, the outer cartridge protrusion 217 moves along the circumferential notch part 207 of the cartridge accommodating wall 204. However, since the inner cartridge protrusion 216 is gripped by the cartridge accommodating wall 204 as described above, the inner cylinder part 90 does not rotate together with the outer cylinder part 91, but maintains the same orientation prior to rotating the outer cylinder part 91. When the outer cartridge protrusion 217 contacts the lower edge of the circumferential notch part 207 (see FIG. 21B), the outer cylinder part 91 and first casing side shutter 37 have arrived in their corresponding open positions (see FIGS. 20B, 21B, 22D, 23E, and 24C).

Figure 25:
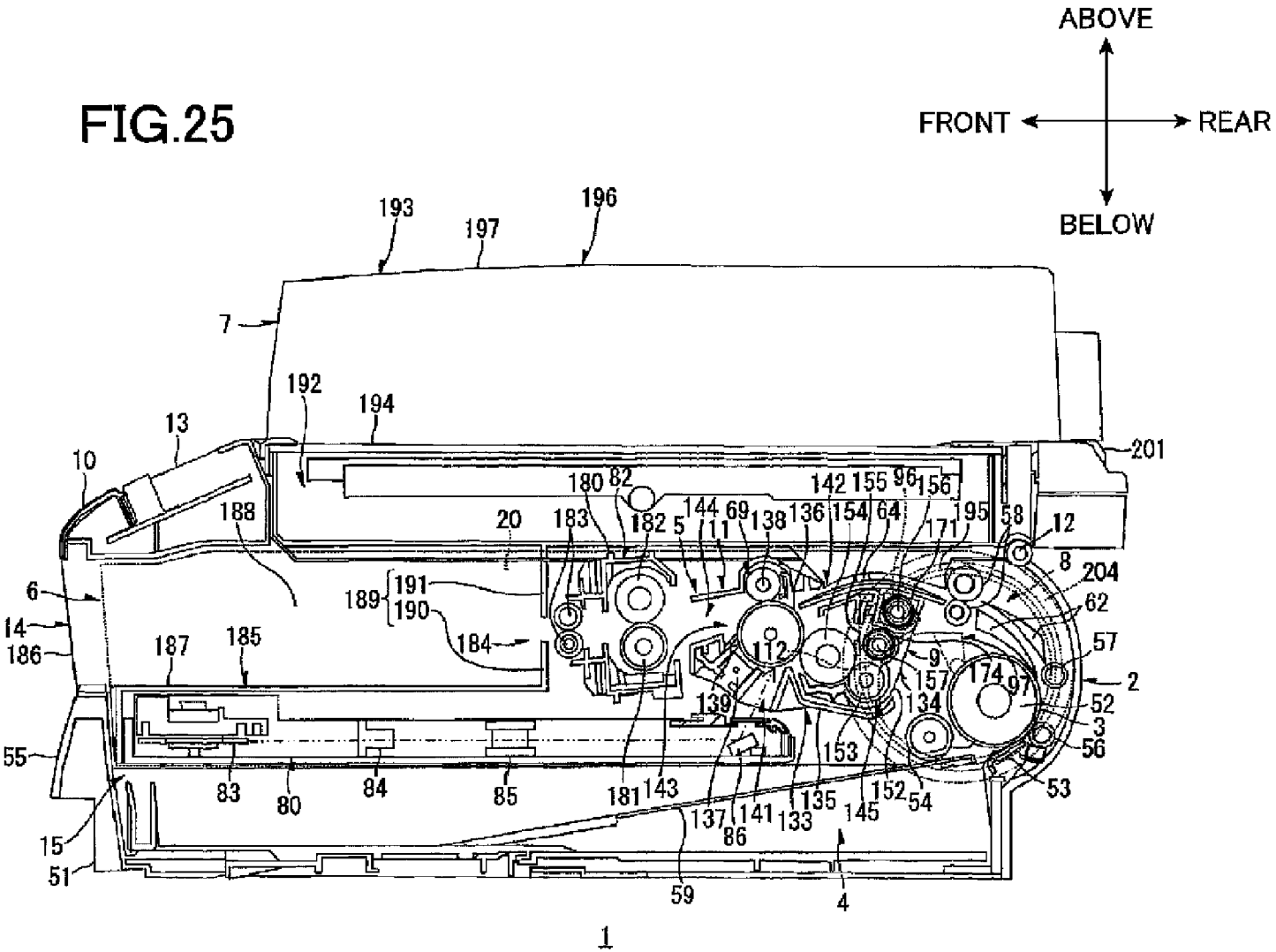
FIG. 25 is a side cross-sectional view of the laser printer in FIG. 19.

As in the preferred embodiment described above, the cartridge supply opening 96 of the toner cartridge 8 is aligned with the developer supply hole 171 of the process unit 9 in the width direction and in communication therewith, while the cartridge return opening 112 of the toner cartridge 8 is aligned with the developer return hole 174 of the process unit 9 in the width direction and in communication therewith, as shown in FIG. 25.

Since the outer cartridge protrusion 217 is positioned inside the circumferential notch part 207 (see FIG. 24C), the toner cartridge 8 is positioned relative to the cartridge accommodating wall 204 in the width direction. Accordingly, the toner cartridge 8 cannot be removed from the right side of the cartridge accommodating space 27.

Subsequently, when the operator moves the cover 17 to the closed position to cover the cartridge mounting opening 16, the operation for mounting the toner cartridge 8 in the main casing 2 is complete (see FIG. 19).

When the drive motor (not shown) is driven in this state, the drive force from the motor is transmitted to the idler gear 218 of the toner cartridge 8 (see FIG. 23E) via the connecting hole 210 in the drive gear 209 (see FIG. 20A) to rotate the idler gear 218. As in the preferred embodiment described above, the passage section agitator 97 rotates clockwise in a left side view along with the rotation of the idler gear 218, enabling toner to be circulated between the toner cartridge 8 and process unit 9.

On the other hand, when removing the toner cartridge 8 from the main casing 2, the operator first moves the cover 17 to the open position to reveal the cartridge mounting opening 16, as shown in FIG. 20B. Next, with the outer cylinder part 91 in the open position shown in FIG. 24C, the operator grips the cartridge protrusion 117 on the toner cartridge 8 and twists the cartridge protrusion 117 counterclockwise in a right side view, thereby rotating the outer cylinder part 91 together with the first casing side shutter 37 counterclockwise in the right side view. Through this rotation, the outer cartridge protrusion 217 (see FIG. 24B) moves along the circumferential notch part 207 in the cartridge accommodating wall 204. However, the inner cylinder part 90 does not rotate together with the outer cylinder part 91, as described above. When the outer cartridge protrusion 217 contacts the top edge of the circumferential notch part 207 (see FIG. 24B), the outer cylinder part 91 and first casing side shutter 37 have completed movement to the closed position. At this time, the inner cartridge protrusion 216 and outer cartridge protrusion 217 are aligned with the mounting opening recessed part 202 (see FIG. 20B) and the widthwise notch part 206 in a side view, as shown in FIG. 24B. By gripping the cartridge protrusion 117 and pulling rightward, the operator pulls the toner cartridge 8 from the right side, while the inner cartridge protrusion 216 and outer cartridge protrusion 217 pass sequentially through the widthwise notch part 206 and mounting opening recessed part 202 in the width direction (see FIG. 24A). The toner cartridge 8 is completed detached from the main casing 2 when pulled to the right of the cartridge mounting opening 16.

What is claimed is:

1. An image-forming device comprising:

a casing;

a developing unit that is detachably mounted in the casing and formed with a first opening, the developer unit having a developer carrying member carrying a developer, the developing unit including one end, the developer carrying member being rotatable about a rotational axis extending in an axial direction;

a first shutter configured to open and close the first opening;

a developer cartridge that is configured to be detachably mounted in the casing, accommodates the developer, and is formed with a second opening, the second opening being in alignment with the first opening when the developing unit and the developer cartridge are mounted in the casing;

a second shutter configured to open and close the second opening;

an alignment member that is configured to be disposed between the developing unit and the developer cartridge when the developing unit and the developer cartridge are mounted in the casing, the alignment member being formed with a third opening, the third opening being in alignment with the first opening and the second opening in a predetermined direction parallel to the axial direction and being, as viewed in the predetermined direction, overlapped with the first opening and the second opening when the developing unit and the developer cartridge are mounted in the casing, the alignment member including a support member configured to support the one end of the developing unit.

2. The image-forming device according to claim 1, wherein the casing is formed with a fourth opening for mounting and removing the developing unit to and from the casing, and wherein the image-forming device further comprises:

a third shutter that is disposed in the alignment member and configured to open and close the third opening, opening and closing operations of the first shutter being performed in association with opening and closing operation of the third shutter; and a cover member, wherein the third shutter opens and closes in association with the opening and closing operations of the cover member.

3. The image-forming device according to claim 1, wherein opening and closing operations of the first shutter are performed independently of opening and closing operations of the second shutter.

4. The image-forming device according to claim 1, wherein the developing unit includes an image-carrying member on which an electrostatic latent image is formed, the image-carrying member having a shaft, and wherein the support member supports the shaft of the image-carrying member.

5. The image-forming device according to claim 4, wherein the support member is formed with a shaft receiving groove for guiding the shaft of the image-carrying member, the shaft receiving groove extending in parallel to the alignment member.

6. The image-forming device according to claim 1, further comprising a third shutter that is disposed in the alignment member and moves in association with opening and closing operations of the second shutter.

7. The image-forming device according to claim 1, wherein the first opening includes:

a first supply opening for supplying the developer toward the developer carrying member; and a first return opening for receiving the developer from the developer carrying member, wherein the second opening includes:

a second supply opening for supplying the developer toward the first supply opening; and a second return opening for receiving the developer from the first return opening, and wherein the third opening includes:

a third supply opening for conveying the developer from the second supply opening to the first supply opening; and a third return opening for conveying the developer from the first return opening to the second return opening.

* * * * *